US012116771B2

(12) United States Patent
Rafezy et al.

(10) Patent No.: US 12,116,771 B2
(45) Date of Patent: Oct. 15, 2024

(54) RAPID ASSEMBLY CONSTRUCTION MODULES AND METHODS FOR USE

(71) Applicant: MITEK HOLDINGS, INC., Wilmington, DE (US)

(72) Inventors: Behzad Rafezy, Laguna Niguel, CA (US); Quang Minh Huynh, San Diego, CA (US); Henry Gallart, Mission Viejo, CA (US)

(73) Assignee: MITEK HOLDINGS, INC., Wilmington, DE (US)

( * ) Notice: Subject to any disclaimer, the term of this patent is extended or adjusted under 35 U.S.C. 154(b) by 0 days.

(21) Appl. No.: 17/646,579

(22) Filed: Dec. 30, 2021

(65) Prior Publication Data

US 2022/0205234 A1 Jun. 30, 2022

Related U.S. Application Data

(60) Provisional application No. 63/132,865, filed on Dec. 31, 2020.

(51) Int. Cl.

| | |
|---|---|
| ***E04B 1/343*** | (2006.01) |
| ***E04B 1/344*** | (2006.01) |
| ***E04B 2/58*** | (2006.01) |
| ***E04B 5/10*** | (2006.01) |
| ***E04B 7/02*** | (2006.01) |

(52) U.S. Cl.
CPC ..... *E04B 1/3445* (2013.01); *E04B 1/34384* (2013.01); *E04B 2/58* (2013.01); *E04B 5/10* (2013.01); *E04B 7/026* (2013.01)

(58) Field of Classification Search
CPC ..... E04B 1/3445; E04B 1/34384; E04B 2/58; E04B 5/10; E04B 7/026
USPC ..... 52/143
See application file for complete search history.

(56) References Cited

U.S. PATENT DOCUMENTS

| | | | | |
|---|---|---|---|---|
| 1,400,709 | A | 12/1921 | Worthington | |
| 3,103,709 | A | 9/1963 | Bolt | |
| 3,289,382 | A | 12/1966 | Der Lely | |
| 3,292,331 | A | 12/1966 | Sams | |
| 3,331,170 | A | 7/1967 | Neville et al. | |
| 3,332,170 | A * | 7/1967 | Bangs | F25D 23/063 52/404.1 |

(Continued)

FOREIGN PATENT DOCUMENTS

| | | |
|---|---|---|
| AU | 2010202450 A1 | 1/2011 |
| AU | 2013201792 | 10/2013 |

(Continued)

OTHER PUBLICATIONS

International Search Report and Written Opinion from PCT/US21/65663, dated Jun. 1, 2022, 18 pages.

*Primary Examiner* — James J Buckle, Jr.
(74) *Attorney, Agent, or Firm* — Stinson LLP

(57) ABSTRACT

A module for use in constructing a building includes a ceiling assembly. Wall assemblies are configured for attachment to opposite sides of the ceiling assembly generally at tops of the wall assemblies. A floor assembly is configured for attachment generally to bottoms of the wall assemblies. Connector plates are attached to the wall assemblies. The connector plates are configured to receive fasteners for attaching the ceiling assembly and floor assembly to the wall assemblies. A method of construction using the modules is also disclosed.

22 Claims, 64 Drawing Sheets

(56) References Cited

U.S. PATENT DOCUMENTS 3,377,755 A 4/1968 Stucky et al.
3,391,507 A 7/1968 Downing
3,596,949 A 8/1971 Turpen
3,653,698 A 4/1972 Jenner
3,703,058 A 11/1972 Klett et al.
3,724,141 A 4/1973 Kelleher
3,733,763 A 5/1973 Drucker
3,758,998 A 9/1973 Ollis et al.
3,780,480 A 12/1973 Cvijanovic et al.
3,782,061 A 1/1974 Minutoli et al.
3,805,461 A 4/1974 Jagoda
3,822,519 A 7/1974 Antoniou
3,835,601 A 9/1974 Kelbish
3,882,649 A 5/1975 Mah
3,921,355 A 11/1975 Pennecot
3,952,462 A * 4/1976 Heise ..... E04B 2/7854 52/669
3,965,627 A 6/1976 Fencl
3,990,193 A 11/1976 Ray et al.
3,994,110 A 11/1976 Ropella
4,050,211 A 9/1977 Wahman
4,050,215 A 9/1977 Fisher
4,073,102 A 2/1978 Fisher
4,099,360 A 7/1978 Outram
4,166,343 A * 9/1979 O'Brian ..... E04B 1/3445 296/173
4,228,628 A 10/1980 Schlomann
4,289,680 A 9/1981 Kimura
4,357,784 A 11/1982 Grady, II
4,372,091 A 2/1983 Brown et al.
4,599,829 A 7/1986 Dimartino, Sr.
4,614,071 A 9/1986 Sams et al.
4,635,412 A 1/1987 Le Poittevin
4,694,621 A 9/1987 Locke
4,715,159 A 12/1987 Hijazi
4,936,069 A * 6/1990 Hunter ..... E04C 2/292 52/794.1
4,964,060 A 10/1990 Hartsog
4,986,038 A 1/1991 Backer
4,987,719 A 1/1991 Goodson, Jr.
5,072,569 A 12/1991 Vantassel
5,107,639 A * 4/1992 Morin ..... E04B 1/3445 220/6
5,245,802 A 9/1993 Davis
5,253,460 A 10/1993 Simenoff
5,317,857 A 6/1994 Allison
5,359,825 A 11/1994 Makarov
5,371,990 A 12/1994 Salahuddin
5,392,580 A 2/1995 Baumann
5,402,615 A 4/1995 Knott et al.
5,440,844 A 8/1995 Chihara et al.
5,461,832 A 10/1995 Smith
5,481,834 A 1/1996 Kowalczyk et al.
5,509,241 A 4/1996 Coconis et al.
5,567,089 A 10/1996 Akamine
5,644,871 A 7/1997 Cohen et al.
5,678,369 A 10/1997 Ishikawa et al.
5,706,614 A 1/1998 Wiley, Jr
5,715,637 A 2/1998 Hesterman et al.
5,749,196 A 5/1998 Bangma
5,755,063 A 5/1998 Ohnishi et al.
5,755,072 A 5/1998 Lingafelter
5,761,854 A 6/1998 Johnson
5,785,904 A 7/1998 Abou-Rached
5,848,499 A 12/1998 Schildge, Jr.
5,848,511 A 12/1998 Scales
5,890,332 A 4/1999 Skidmore et al.
5,964,067 A 10/1999 Lehner et al.
6,009,679 A 1/2000 Larsen
6,050,044 A 4/2000 Mcintosh
6,085,469 A * 7/2000 Wolfe ..... E04B 7/04 52/270
6,096,416 A 8/2000 Altenberg
6,178,714 B1 1/2001 Carney
6,182,407 B1 2/2001 Turpin et al.
6,227,397 B1 5/2001 Kim
6,298,619 B1 * 10/2001 Davie ..... E04B 7/22 52/270
6,390,719 B1 5/2002 Chan
6,557,316 B2 5/2003 Van Der Heijden
6,625,937 B1 9/2003 Parker et al.
6,701,288 B1 3/2004 Normann et al.
6,718,722 B2 4/2004 Worrell et al.
6,757,643 B2 6/2004 Gavin et al.
6,801,218 B2 10/2004 Susnjara
6,871,453 B2 3/2005 Locke
6,912,487 B1 6/2005 Garcia et al.
6,968,653 B2 * 11/2005 Stapleton, Jr. ..... E04B 1/3445 52/79.5
6,996,945 B2 2/2006 Doty
7,096,163 B2 8/2006 Reghetti
7,244,079 B1 7/2007 Blomquist et al.
7,246,044 B2 7/2007 Imamura et al.
7,292,908 B2 11/2007 Borne et al.
7,295,955 B2 11/2007 Sit
7,305,803 B2 12/2007 Correa et al.
7,341,620 B2 3/2008 Walter et al.
7,347,028 B1 3/2008 Bin-Nun et al.
7,406,804 B2 8/2008 Den Daas
7,412,805 B2 8/2008 Parrish
7,496,487 B2 2/2009 Wakelam et al.
7,510,097 B2 * 3/2009 Spindel ..... B65D 11/1826 220/651
7,594,361 B2 9/2009 Tragant Ruano
7,636,650 B2 12/2009 Khalil
7,643,966 B2 1/2010 Adachi et al.
7,658,039 B2 2/2010 Ziegelman
7,712,281 B2 5/2010 Bott
7,735,292 B2 6/2010 Massie
7,770,346 B2 8/2010 Elliott
7,827,738 B2 11/2010 Abrams
7,845,130 B2 12/2010 Tonyan et al.
7,856,787 B2 12/2010 Fujihashi et al.
7,874,111 B2 1/2011 Guldimann
7,883,288 B2 2/2011 Jorna
7,894,920 B2 2/2011 Mifsud et al.
7,897,235 B1 3/2011 Locher et al.
7,934,345 B2 5/2011 Marsh et al.
8,046,957 B2 11/2011 Towersey et al.
8,052,002 B2 * 11/2011 Spindel ..... B65D 5/18 220/651
8,121,820 B2 2/2012 Walch
8,180,597 B2 5/2012 Connor et al.
8,181,415 B2 5/2012 Mancine
8,186,110 B2 5/2012 Green
8,201,370 B1 6/2012 Goodwin
8,204,619 B2 6/2012 Heil
8,244,608 B2 8/2012 Wood
8,281,528 B2 10/2012 Clarke
8,315,840 B2 11/2012 Mangon
8,316,610 B2 11/2012 Adams
8,347,579 B2 1/2013 Gan
8,365,473 B2 2/2013 Bjerre
8,414,816 B2 4/2013 Korman et al.
8,417,488 B2 4/2013 Klipfel, III
8,429,857 B2 4/2013 Melrose
8,429,867 B2 4/2013 Robinson
8,448,410 B2 5/2013 Korman et al.
8,482,558 B2 7/2013 Morello et al.
8,528,294 B2 9/2013 Vanker et al.
8,549,796 B2 10/2013 Heather
8,601,759 B2 12/2013 Bucheger
8,621,788 B2 1/2014 Tedesco et al.
8,639,482 B2 1/2014 Rasmussen et al.
8,661,757 B2 3/2014 Miller
8,671,632 B2 3/2014 Pilz
8,707,631 B2 * 4/2014 Scouten ..... E05D 11/00 52/68
8,732,599 B2 5/2014 Reghetti et al.
8,762,877 B2 6/2014 Loberg et al.
8,768,655 B2 7/2014 Singh et al.
8,818,924 B2 8/2014 Wayne et al.

(56) References Cited

U.S. PATENT DOCUMENTS 8,851,096 B2 10/2014 De Villenfagne De Sorinnes et al.
8,887,472 B2 11/2014 Vanker et al.
8,893,447 B1 11/2014 Harris et al.
8,893,450 B2 11/2014 Zohar
8,898,989 B2 12/2014 Phillips
8,898,990 B2 12/2014 Drew
8,904,724 B1 12/2014 Hanson
8,943,759 B2 * 2/2015 Warner ..... E04H 1/12 52/79.5
8,954,297 B2 2/2015 Teller et al.
9,019,266 B2 4/2015 Hoguet
9,062,451 B1 6/2015 Wilson, Jr. et al.
9,080,326 B2 7/2015 Johnson
9,103,109 B2 8/2015 Armstrong et al.
9,115,504 B2 8/2015 Wallance
9,201,987 B2 12/2015 Hinners et al.
9,213,785 B2 12/2015 Plewe
9,221,599 B2 * 12/2015 Brennan, Jr. ..... B65D 90/08
9,243,398 B2 1/2016 Liberman
9,260,864 B2 2/2016 Cole et al.
9,267,260 B2 2/2016 Macdonald et al.
9,290,931 B2 3/2016 Grace
9,366,020 B2 6/2016 Farnsworth
9,387,981 B2 * 7/2016 Meijers ..... B65D 88/522
9,441,359 B1 9/2016 Hsieh
9,458,619 B2 10/2016 Bowron et al.
9,489,472 B2 11/2016 Lee et al.
9,501,805 B2 11/2016 Mclean
9,528,263 B2 12/2016 Lightfoot
9,593,480 B2 3/2017 Vandenbempt
9,598,855 B2 3/2017 Lee
9,611,637 B2 4/2017 Dynon
9,650,791 B2 5/2017 Cole et al.
9,677,272 B2 6/2017 Vanker et al.
9,702,138 B1 7/2017 Rutherford
9,758,983 B2 9/2017 Simmons et al.
9,760,099 B2 9/2017 Noureldin et al.
9,828,769 B2 11/2017 Ariba et al.
9,834,954 B2 12/2017 Becher et al.
9,898,557 B2 2/2018 Sarao et al.
9,920,512 B1 3/2018 Eisold et al.
9,938,720 B2 4/2018 Urheim
9,959,370 B2 5/2018 Grivetti
9,988,812 B2 * 6/2018 Kalinowski ..... E04B 2/721
10,066,392 B2 9/2018 Miller et al.
10,196,173 B2 2/2019 Tiramani
10,208,475 B2 2/2019 Heather et al.
10,229,227 B2 3/2019 Wright et al.
10,254,745 B2 4/2019 Cunney et al.
10,273,685 B2 4/2019 Martinez
10,282,491 B2 5/2019 Lederman et al.
10,289,757 B2 5/2019 Mcclure et al.
10,344,436 B2 7/2019 Guven
10,346,768 B2 7/2019 Schnackel
10,359,148 B2 7/2019 Lindblom et al.
10,378,201 B2 8/2019 Coombes
10,387,582 B2 8/2019 Lewis et al.
10,402,506 B2 9/2019 Bumbalough et al.
10,430,526 B2 10/2019 Marceau et al.
10,450,737 B2 10/2019 Bowron
10,452,790 B2 10/2019 Kim et al.
10,458,114 B2 10/2019 Lestini et al.
10,526,781 B2 1/2020 Lestini et al.
10,584,484 B2 3/2020 Cohen
10,590,646 B2 3/2020 Visser
10,672,045 B2 6/2020 Grivetti
10,678,962 B2 6/2020 Vanker et al.
10,695,795 B2 6/2020 Bailey
11,109,519 B2 * 8/2021 Deighton ..... E04B 1/34321
2001/0047251 A1 11/2001 Kemp
2002/0129001 A1 9/2002 Levkoff et al.
2003/0000155 A1 1/2003 Zwerenz
2003/0014223 A1 1/2003 Phillips et al.
2004/0073410 A1 4/2004 Maly et al.
2004/0194396 A1 10/2004 Shanni
2004/0231256 A1 11/2004 Ohnishi
2004/0236561 A1 11/2004 Smith et al.
2006/0042874 A1 3/2006 Foster et al.
2006/0059824 A1 3/2006 Barbisch
2006/0070321 A1 4/2006 Au
2006/0090414 A1 5/2006 Ye
2006/0150534 A1 7/2006 Window
2006/0174798 A1 8/2006 Churchill
2006/0217941 A1 9/2006 Soteros
2007/0074465 A1 4/2007 Kuan
2007/0091119 A1 4/2007 Jezyk et al.
2007/0130873 A1 6/2007 Fisher
2007/0265927 A1 11/2007 Salter
2008/0005300 A1 1/2008 Grayson et al.
2008/0053003 A1 3/2008 Hockemeyer et al.
2008/0209820 A1 * 9/2008 Muir ..... E04B 1/3445 52/79.5
2008/0229698 A1 9/2008 Ulguner
2008/0249756 A1 10/2008 Chaisuparasmikul
2009/0144029 A1 6/2009 Brandt et al.
2009/0239059 A1 9/2009 Kipp et al.
2009/0271154 A1 10/2009 Coad et al.
2009/0292509 A1 11/2009 Thompson et al.
2009/0301028 A1 12/2009 Pfoff
2010/0024318 A1 2/2010 Zhang et al.
2010/0223876 A1 9/2010 Jones
2010/0269419 A1 * 10/2010 Gyory ..... E04B 1/3483 52/79.5
2011/0082701 A1 4/2011 Sagar
2011/0167758 A1 7/2011 Daadoush
2011/0173907 A1 7/2011 Katsalidis
2011/0179741 A1 7/2011 Yen
2011/0191069 A1 8/2011 Madsen et al.
2011/0213480 A1 9/2011 Zila et al.
2011/0257938 A1 10/2011 Eyers et al.
2012/0006369 A1 1/2012 Cantin
2012/0037622 A1 2/2012 Cantin
2012/0151851 A1 6/2012 Cantin
2012/0240501 A1 9/2012 Spiegel
2012/0279142 A1 11/2012 Michaud
2013/0055671 A1 3/2013 Bruce
2013/0124250 A1 5/2013 Crawley et al.
2013/0283190 A1 10/2013 Wilson
2013/0338970 A1 12/2013 Reghetti
2014/0013699 A1 1/2014 Gallinat et al.
2014/0248814 A1 9/2014 Handermann
2014/0278280 A1 9/2014 Pardo-Fernandez
2014/0298745 A1 10/2014 Rechenmacher et al.
2014/0318036 A1 10/2014 Eom
2015/0121775 A1 5/2015 Lippert
2015/0199456 A1 7/2015 Simpson
2015/0211230 A1 7/2015 Jimenez Horwitz
2015/0310136 A1 10/2015 Maletz
2016/0001760 A1 1/2016 Brown
2016/0017601 A1 1/2016 Bottin
2016/0019321 A1 1/2016 Zahner et al.
2016/0024779 A1 1/2016 Clus et al.
2016/0040443 A1 2/2016 Stephenson et al.
2016/0160515 A1 6/2016 Wallance
2016/0168845 A1 6/2016 Ito et al.
2016/0348369 A1 12/2016 Godfrey et al.
2017/0013047 A1 1/2017 Hubbard et al.
2017/0051503 A1 * 2/2017 Kalinowski ..... E05D 1/04
2017/0072641 A1 3/2017 Grivetti
2017/0130475 A1 5/2017 Park
2017/0138044 A1 5/2017 Malakauskas et al.
2017/0146055 A1 5/2017 Lowrey
2017/0277814 A1 9/2017 Simmons
2017/0306621 A1 10/2017 Laursen
2017/0350150 A1 12/2017 Rdlinger
2017/0370091 A1 12/2017 Dragan
2018/0121571 A1 5/2018 Ramoutar et al.
2018/0135295 A1 5/2018 Bowron
2018/0137227 A1 5/2018 Ishii et al.
2018/0187411 A1 7/2018 Shang
2018/0245352 A1 8/2018 Duranleau
2018/0260497 A1 9/2018 Vanker et al.
2018/0268087 A1 9/2018 Tierney et al.

(56) References Cited

U.S. PATENT DOCUMENTS

| | | | |
|---|---|---|---|
| 2018/0300433 | A1 | 10/2018 | Maxam et al. |
| 2018/0347175 | A1 | 12/2018 | Anderson et al. |
| 2019/0010692 | A1 | 1/2019 | Segall |
| 2019/0012408 | A1 | 1/2019 | Forbes et al. |
| 2019/0022619 | A1 | 1/2019 | Moonen et al. |
| 2019/0024364 | A1 | 1/2019 | Lestini |
| 2019/0078321 | A1 | 3/2019 | Bowron |
| 2019/0112801 | A1 | 4/2019 | Suzuki et al. |
| 2019/0127976 | A1 | 5/2019 | Donnelly |
| 2019/0147120 | A1 | 5/2019 | Benjamin et al. |
| 2019/0153720 | A1 | 5/2019 | Bonlin |
| 2019/0188338 | A1 | 6/2019 | Srivastava et al. |
| 2019/0211542 | A1 | 7/2019 | Murray |
| 2019/0226198 | A1 | 7/2019 | Morgan |
| 2019/0228115 | A1 | 7/2019 | Bergin et al. |
| 2019/0234063 | A1 | 8/2019 | Garcia-Abril Ruiz |
| 2019/0257072 | A1 | 8/2019 | Rulquin et al. |
| 2019/0309508 | A1 | 10/2019 | Titov et al. |
| 2019/0330838 | A1 | 10/2019 | Bowron |
| 2020/0019078 | A1 | 1/2020 | Tzomik et al. |
| 2020/0033251 | A1 | 1/2020 | Dou et al. |
| 2020/0051187 | A1 | 2/2020 | Walker et al. |
| 2020/0095758 | A1 | 3/2020 | Wong et al. |
| 2020/0102737 | A1 | 4/2020 | Hon |
| 2020/0104431 | A1 | 4/2020 | Ginsberg |
| 2020/0159723 | A1 | 5/2020 | Goyal |
| 2020/0165809 | A1 | 5/2020 | Cohen |
| 2020/0190788 | A1 | 6/2020 | Binder |
| 2020/0199863 | A1 | 6/2020 | Binder |
| 2020/0231381 | A1 | 7/2020 | Indbo et al. |
| 2020/0242849 | A1 | 7/2020 | Cini |
| 2020/0332512 | A1 | 10/2020 | Smith et al. |
| 2021/0180315 | A1 | 6/2021 | Marshall |
| 2021/0293015 | A1 | 9/2021 | Gottschling |
| 2022/0220721 | A1* | 7/2022 | Tiramani ..... E04C 2/48 |
| 2022/0220723 | A1* | 7/2022 | Tiramani ..... B32B 15/095 |
| 2022/0228361 | A1* | 7/2022 | Hoddinott ..... E04H 1/02 |
| 2022/0364354 | A1 | 11/2022 | Rafezy |
| 2024/0011283 | A1 | 1/2024 | Bellissimo et al. |

FOREIGN PATENT DOCUMENTS

| | | | |
|---|---|---|---|
| BR | 202014016959 | U2 | 3/2016 |
| CN | 2220387 | Y | 2/1996 |
| CN | 2911046 | Y | 6/2007 |
| CN | 200967999 | Y | 10/2007 |
| CN | 201351309 | Y | 11/2009 |
| CN | 101812862 | A | 8/2010 |
| CN | 201665915 | U | 12/2010 |
| CN | 201738448 | U | 2/2011 |
| CN | 102241524 | A | 11/2011 |
| CN | 102241524 | B | 11/2011 |
| CN | 202370144 | U | 8/2012 |
| CN | 202882111 | U | 4/2013 |
| CN | 203531219 | U | 4/2014 |
| CN | 203580250 | U | 5/2014 |
| CN | 104074304 | A | 10/2014 |
| CN | 104612259 | A | 5/2015 |
| CN | 104631637 | A | 5/2015 |
| CN | 204608987 | U | 9/2015 |
| CN | 204703300 | U | 10/2015 |
| CN | 103321299 | B | 2/2016 |
| CN | 105649196 | A | 6/2016 |
| CN | 105844041 | A | 8/2016 |
| CN | 106007642 | A | 10/2016 |
| CN | 106400965 | A | 2/2017 |
| CN | 107090913 | A | 8/2017 |
| CN | 206376370 | U | 8/2017 |
| CN | 105863067 | B | 12/2017 |
| CN | 107464284 | A | 12/2017 |
| CN | 206707011 | U | 12/2017 |
| CN | 107679275 | A | 2/2018 |
| CN | 207003702 | U | 2/2018 |
| CN | 207348228 | U | 5/2018 |
| CN | 207392494 | U | 5/2018 |
| CN | 108301512 | A | 7/2018 |
| CN | 108416129 | A | 8/2018 |
| CN | 207901787 | U | 9/2018 |
| CN | 108733932 | A | 11/2018 |
| CN | 109117514 | A | 1/2019 |
| CN | 208401780 | U | 1/2019 |
| CN | 109577489 | A | 4/2019 |
| CN | 208733873 | U | 4/2019 |
| CN | 107060099 | B | 5/2019 |
| CN | 109808031 | A | 5/2019 |
| CN | 209083070 | U | 7/2019 |
| CN | 209324043 | U | 8/2019 |
| CN | 209435148 | U | 9/2019 |
| CN | 110306672 | A | 10/2019 |
| CN | 209509229 | U | 10/2019 |
| CN | 110414170 | A | 11/2019 |
| CN | 209603284 | U | 11/2019 |
| CN | 209620260 | U | 11/2019 |
| CN | 110727979 | A | 1/2020 |
| CN | 110805310 | A | 2/2020 |
| CN | 111339592 | A | 6/2020 |
| CN | 211172399 | U | 8/2020 |
| DE | 3936501 | A1 | 5/1991 |
| DE | 102016106929 | A1 | 3/2018 |
| EP | 1160388 | A2 | 12/2001 |
| EP | 2093344 | A1 | 8/2009 |
| EP | 2849101 | A1 | 3/2015 |
| ES | 2646420 | B1 | 12/2017 |
| FR | 2433414 | A1 | 3/1980 |
| FR | 2529928 | A1 | 1/1984 |
| GB | 1391035 | A | 4/1975 |
| GB | 2168401 | B | 9/1988 |
| IN | 201236032 | Y | 5/2009 |
| JP | 07268963 | A | 10/1995 |
| JP | 11193575 | A | 7/1999 |
| JP | 2001297123 | A | 10/2001 |
| JP | 3102414 | U | 7/2004 |
| JP | 2005312248 | A | 11/2005 |
| JP | 2005316645 | A | 11/2005 |
| JP | 2007132102 | A | 5/2007 |
| JP | 2008158793 | A | 7/2008 |
| JP | 4503982 | B2 | 7/2010 |
| JP | 5133738 | B2 | 1/2013 |
| JP | 5747395 | B1 | 7/2015 |
| JP | 2017084250 | A | 5/2017 |
| JP | 6157807 | B2 | 7/2017 |
| JP | 2018048476 | | 3/2018 |
| JP | 2018048476 | A | 3/2018 |
| KR | 2001193182 | Y1 | 8/2000 |
| KR | 2003072638 | A | 3/2002 |
| KR | 2005080076 | A | 7/2005 |
| KR | 2007074282 | A | 1/2006 |
| KR | 2011040086 | A | 10/2009 |
| KR | 2011053101 | A | 11/2009 |
| KR | 1363739 | B1 | 2/2014 |
| KR | 1389386 | B1 | 4/2014 |
| KR | 1020160044091 | A | 4/2016 |
| RU | 182308 | U1 | 8/2018 |
| RU | 192865 | U1 | 10/2019 |
| WO | 2008075554 | A1 | 6/2008 |
| WO | 2011010300 | A2 | 1/2011 |
| WO | 2011010300 | A8 | 3/2012 |
| WO | 2012070281 | A1 | 5/2012 |
| WO | 2012099531 | A1 | 7/2012 |
| WO | 2013044301 | A1 | 4/2013 |
| WO | 2013161824 | A1 | 10/2013 |
| WO | 2014171628 | A1 | 10/2014 |
| WO | 2016034027 | A1 | 3/2016 |
| WO | 2017058117 | A1 | 4/2017 |
| WO | 2017063417 | A1 | 4/2017 |
| WO | 2017086881 | A1 | 5/2017 |
| WO | 2017198836 | A1 | 11/2017 |
| WO | 2018101891 | A1 | 6/2018 |
| WO | 2019043926 | A1 | 3/2019 |
| WO | 2019057162 | A1 | 3/2019 |
| WO | 2019075521 | A1 | 4/2019 |
| WO | 2019219286 | A1 | 11/2019 |

(56) References Cited

FOREIGN PATENT DOCUMENTS

| | | | |
|---|---|---|---|
| WO | 2020047033 | A1 | 3/2020 |
| WO | 2020114069 | A1 | 6/2020 |
| WO | 2020122307 | A1 | 6/2020 |

* cited by examiner

RAPID ASSEMBLY CONSTRUCTION MODULES AND METHODS FOR USE

CROSS-REFERENCE TO RELATED APPLICATION

This application claims priority to U.S. Provisional Patent Application Ser. No. 63/132,865, filed Dec. 31, 2020, and which is hereby incorporated by reference in its entirety.

BACKGROUND

The present disclosure is directed to construction modules that can be rapidly assembled for use in the construction of a building framework. The module provides a system configured for rapidly erecting a building framework at a construction site or work site. Additionally, in some embodiments, the disassembled module can be stacked together with other modules for transporting multiple modules within a single transportation vehicle of standard over-the-road configuration.

SUMMARY

In one aspect, a module for use in constructing a building, the module generally comprising a ceiling assembly. The module also includes wall assemblies configured for attachment to opposite sides of the ceiling assembly generally at tops of the wall assemblies. The module also includes a floor assembly configured for attachment generally to bottoms of the wall assemblies. The module also includes a plurality of connector plates attached to the wall assemblies and configured to receive fasteners for attaching the ceiling assembly and floor assembly to the wall assemblies to form a module. The module so formed is configured to be placed with other modules to form at least a portion of the building.

In another aspect, a module for use in constructing a building generally comprises a ceiling assembly including a plurality of ceiling units each including a plurality of ceiling members fixedly attached together such that each ceiling unit is a self-contained unit formed separately from any other ceiling unit. The ceiling units are operatively coupled to each other. The module also includes wall assemblies configured for attachment to opposite sides of the ceiling assembly generally at tops of the wall assemblies. The module also includes a floor assembly configured for attachment generally to bottoms of the wall assemblies. The ceiling assembly, wall assemblies, and floor assembly form a module configured to be placed with other modules to form at least a portion of the building.

In yet another aspect, a method of assembling a module for a building generally comprises attaching a first wall assembly to a first longitudinal side of a floor assembly generally at a bottom of the first wall assembly. A second wall assembly is attached to a second longitudinal side of the floor assembly generally at a bottom of the second wall assembly. A first ceiling unit is coupled to a second ceiling unit to at least in part form a ceiling assembly, where each of the ceiling units includes a plurality of ceiling members fixedly attached together. Each ceiling unit is a self-contained unit formed separately from any other ceiling unit. The ceiling assembly is attached generally to tops of the first and second wall assemblies.

In still another aspect, a method of building a modular building generally comprises fabricating modules at a manufacturing facility such that each module is made up of separate component parts. Loading the component parts onto a semi-trailer with the component parts separated from each other and arranged so that a width of the loaded components does not exceed a predetermined dimension. Transporting the component parts of the frame on the semi-trailer to a desired location. Assembling the component parts from the load on the semi-trailer to form at least part of one module. Transporting an assembled module to the construction site.

Other features of the present invention will be apparent from the following description.

DESCRIPTION OF THE DRAWINGS

Corresponding reference characters indicate corresponding parts throughout the several views of the drawings.

DESCRIPTION

Figure 1:
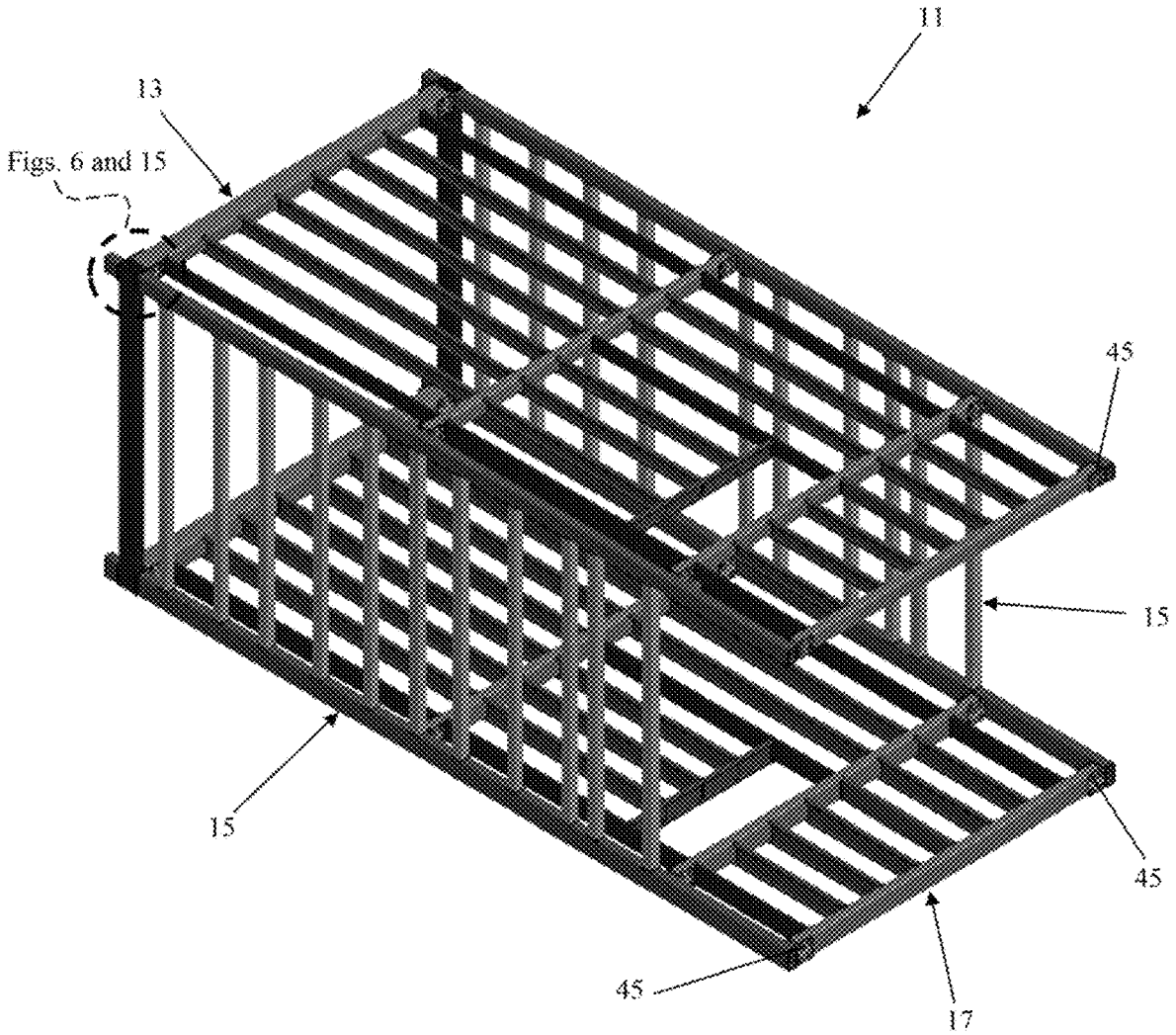
FIG. 1 is a perspective of a modular steel cage or "skeleton frame" as assembled.
Figure 2:
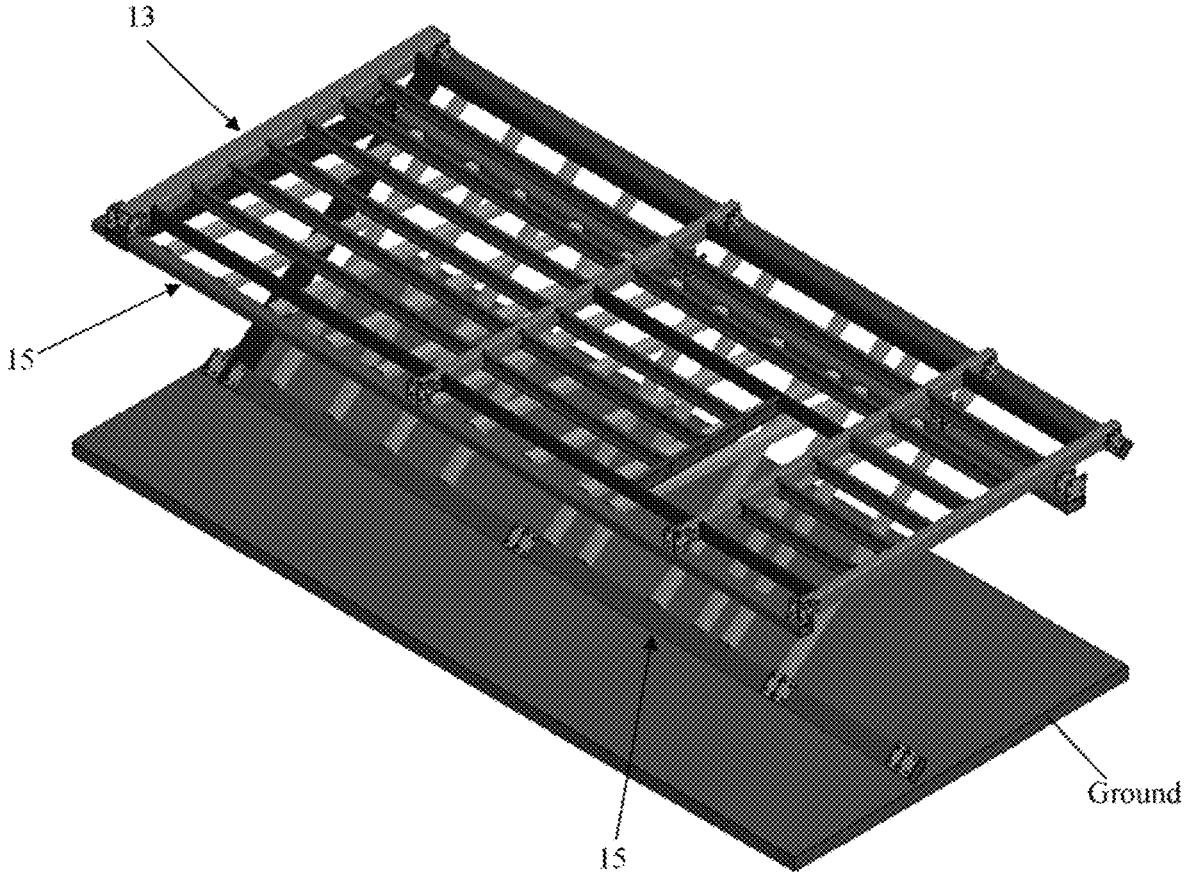
FIG. 2 is a perspective showing ceiling and wall components of the skeleton frame being lifted from a collapsed configuration.
Figure 2A:
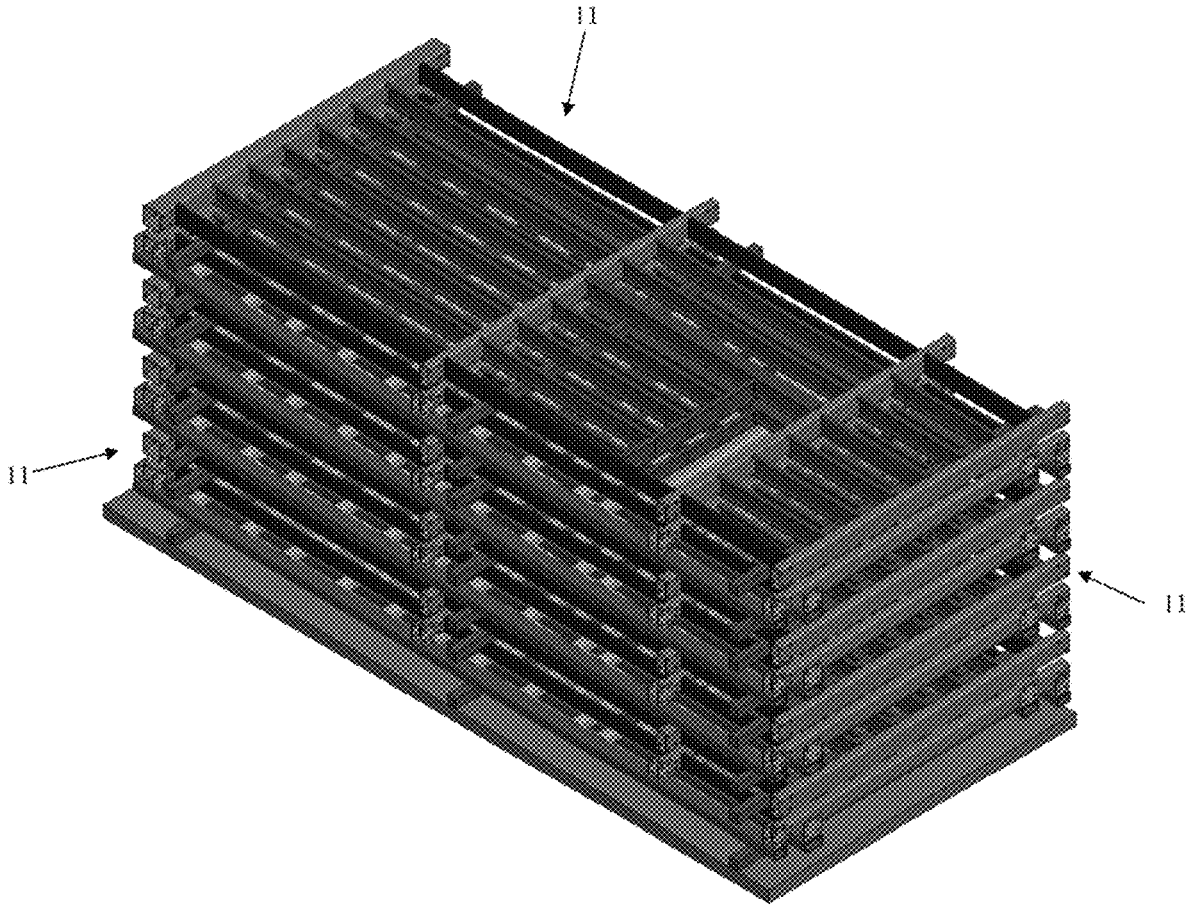
FIG. 2A is a perspective showing multiple collapsed skeleton frames stacked on top of each other.
Figure 2B:
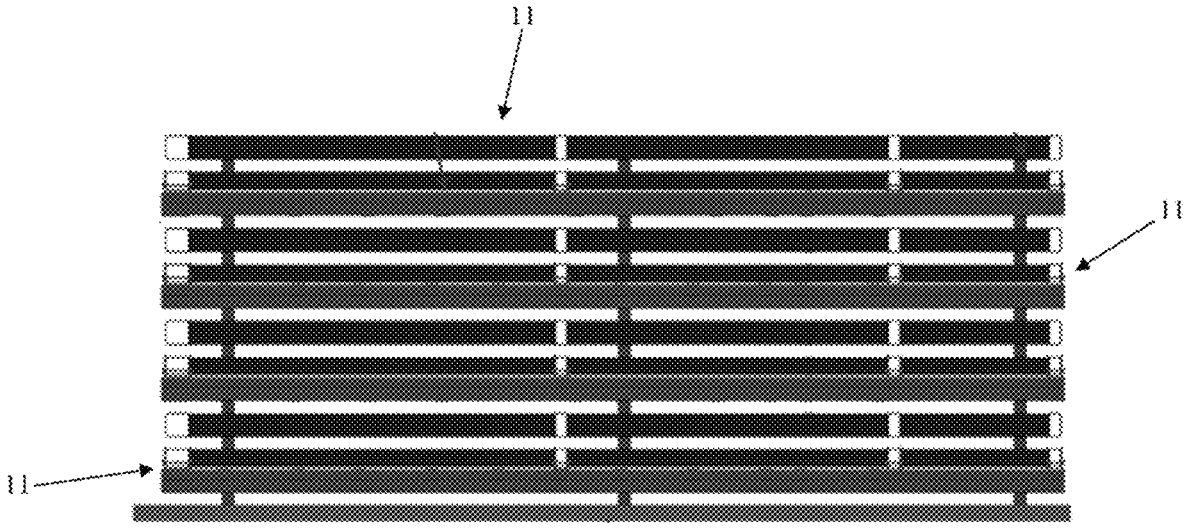
FIG. 2B is a side view of FIG. 2A.
Figure 3:
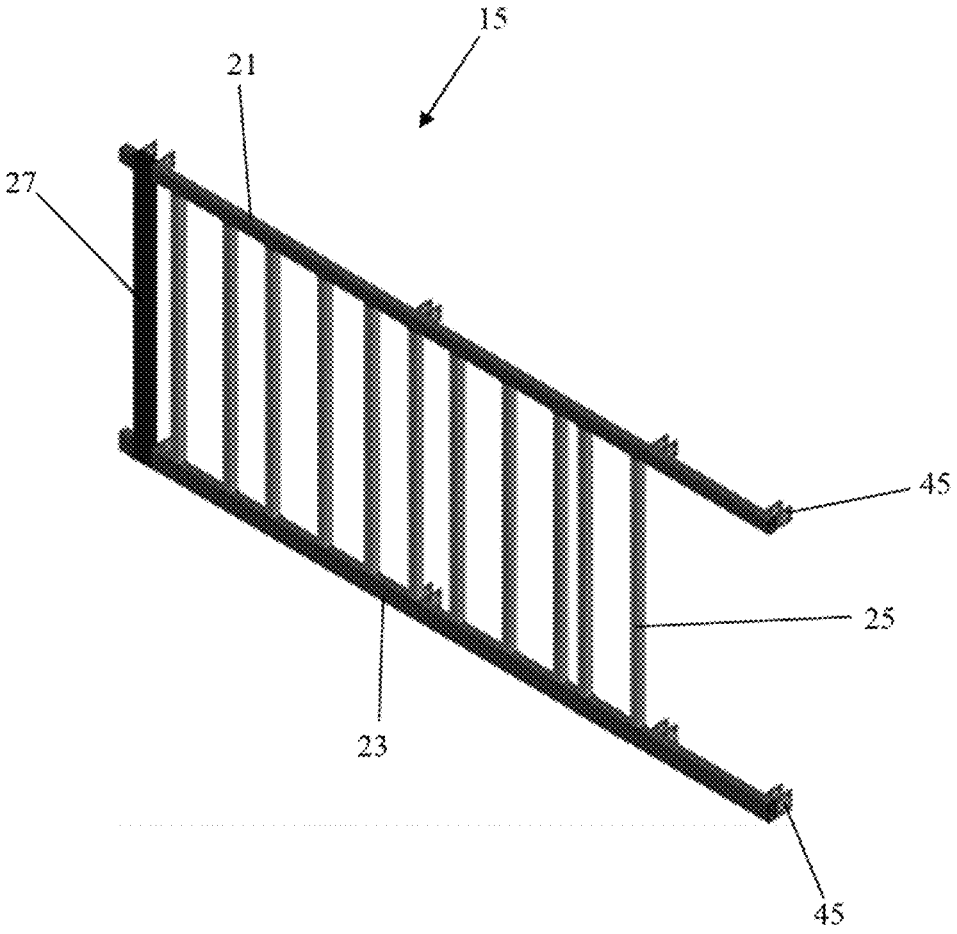
FIG. 3 is a perspective of a wall assembly of the skeleton frame.
Figure 4:
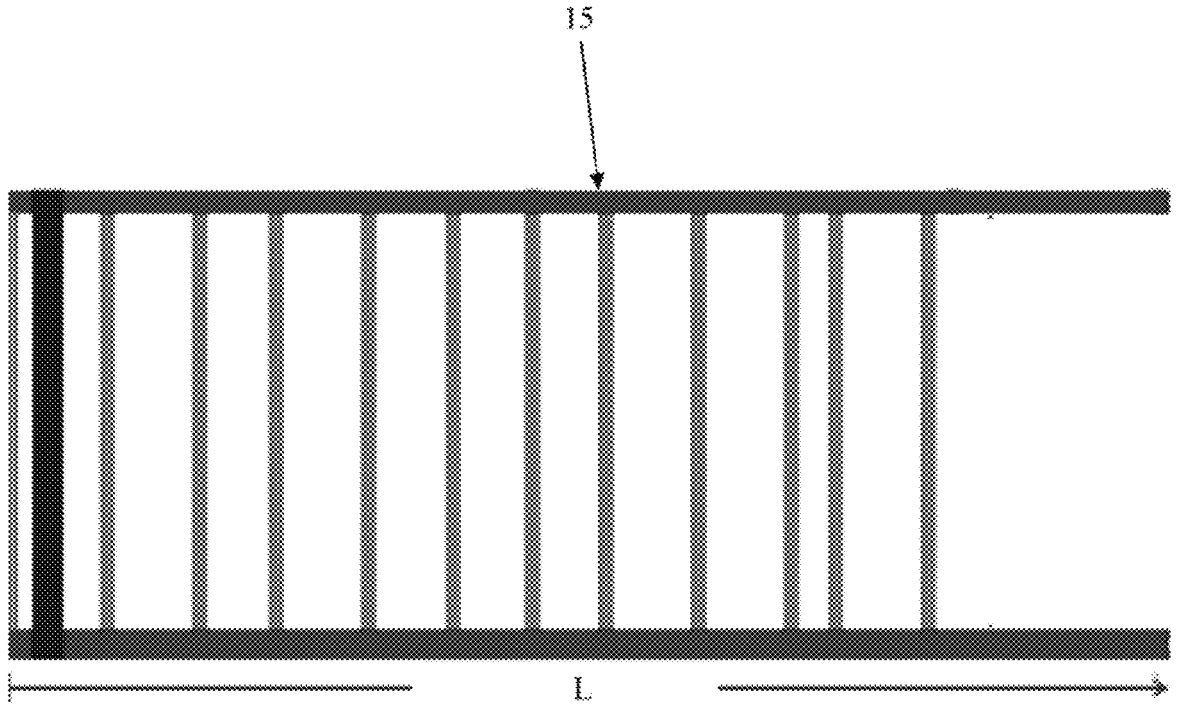
FIG. 4 is an elevation view of the wall assembly.
Figure 17:
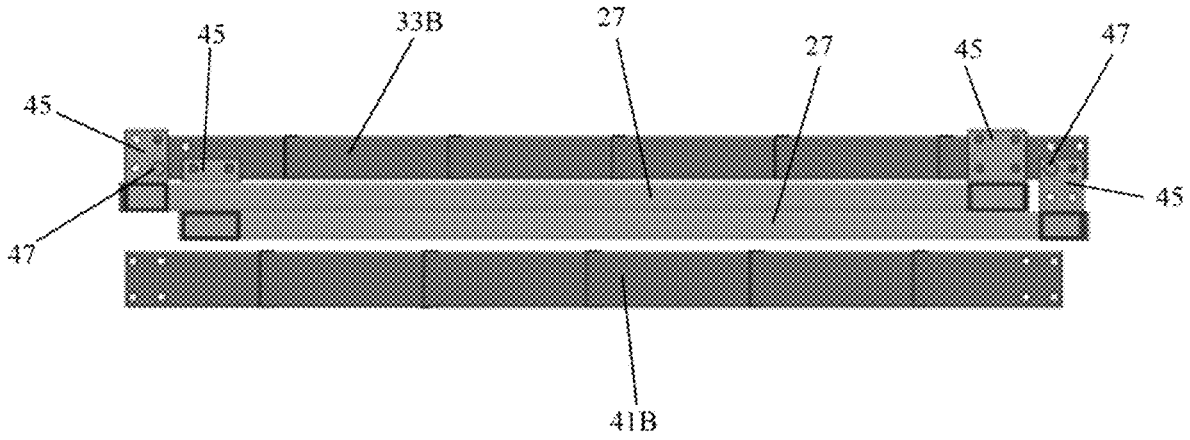
FIG. 17 is the end view of FIG. 16, but further including the floor assembly.
Figure 18:
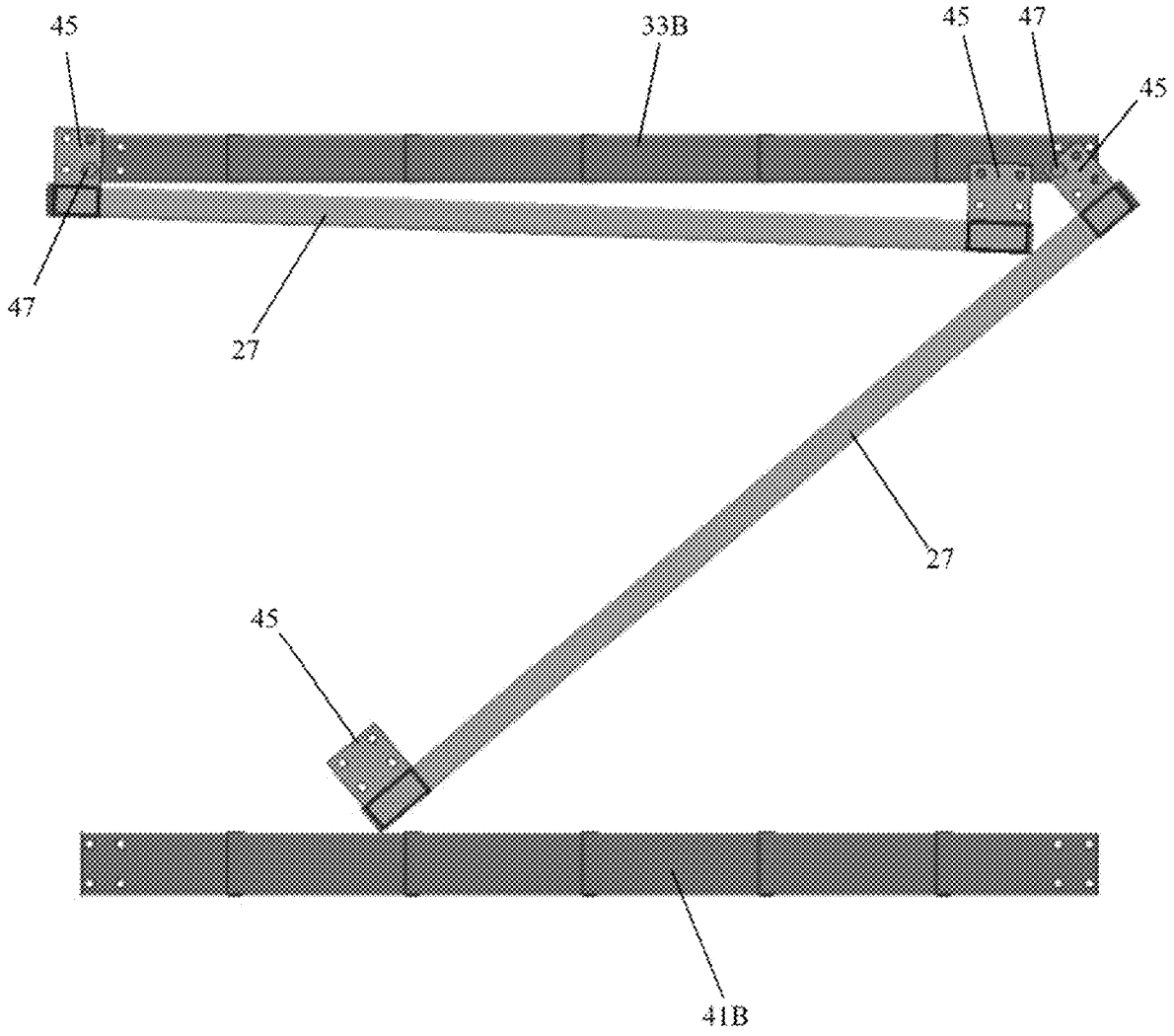
FIG. 18 is a schematic illustration of erecting the skeleton frame.
Figure 19:
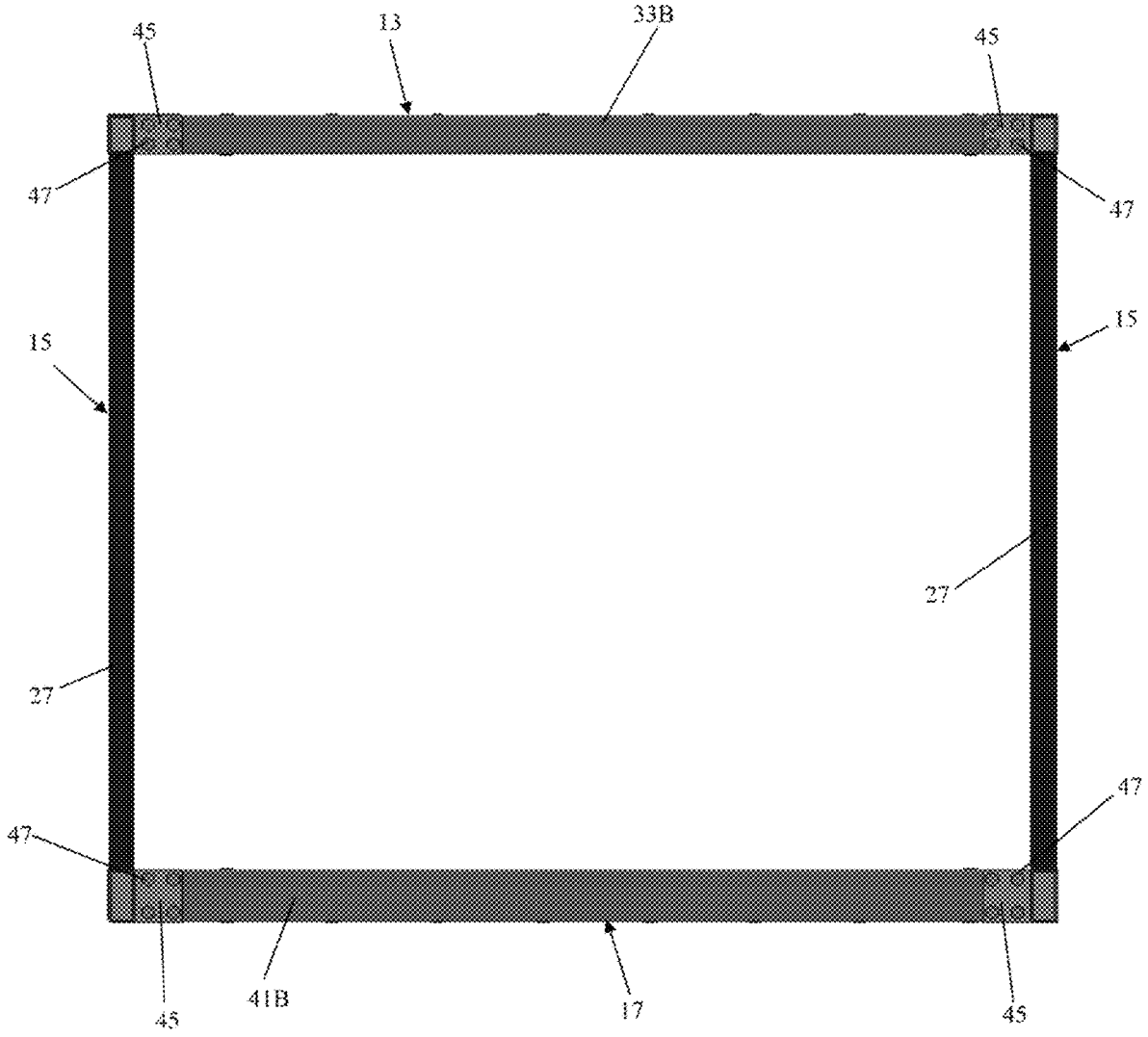
FIG. 19 is an end view of the erected skeleton frame.
Figure 20:
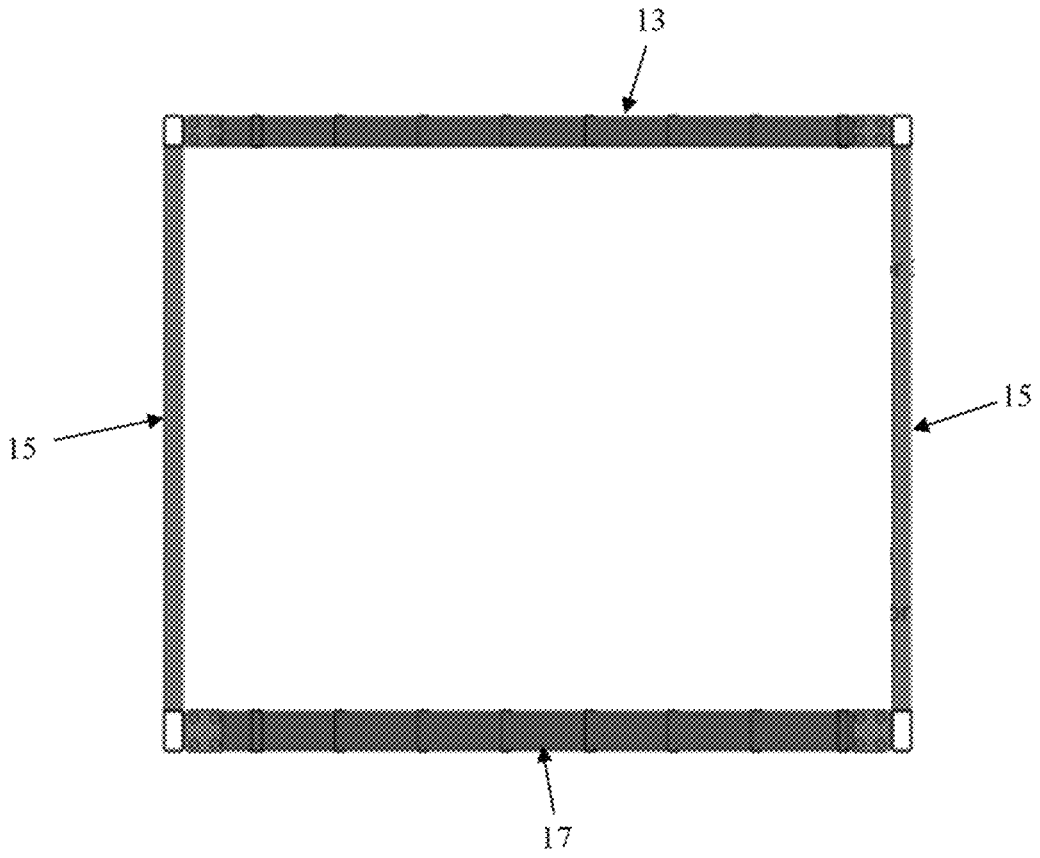
FIG. 20 is a cross section of the erected skeleton frame.
Figure 21:
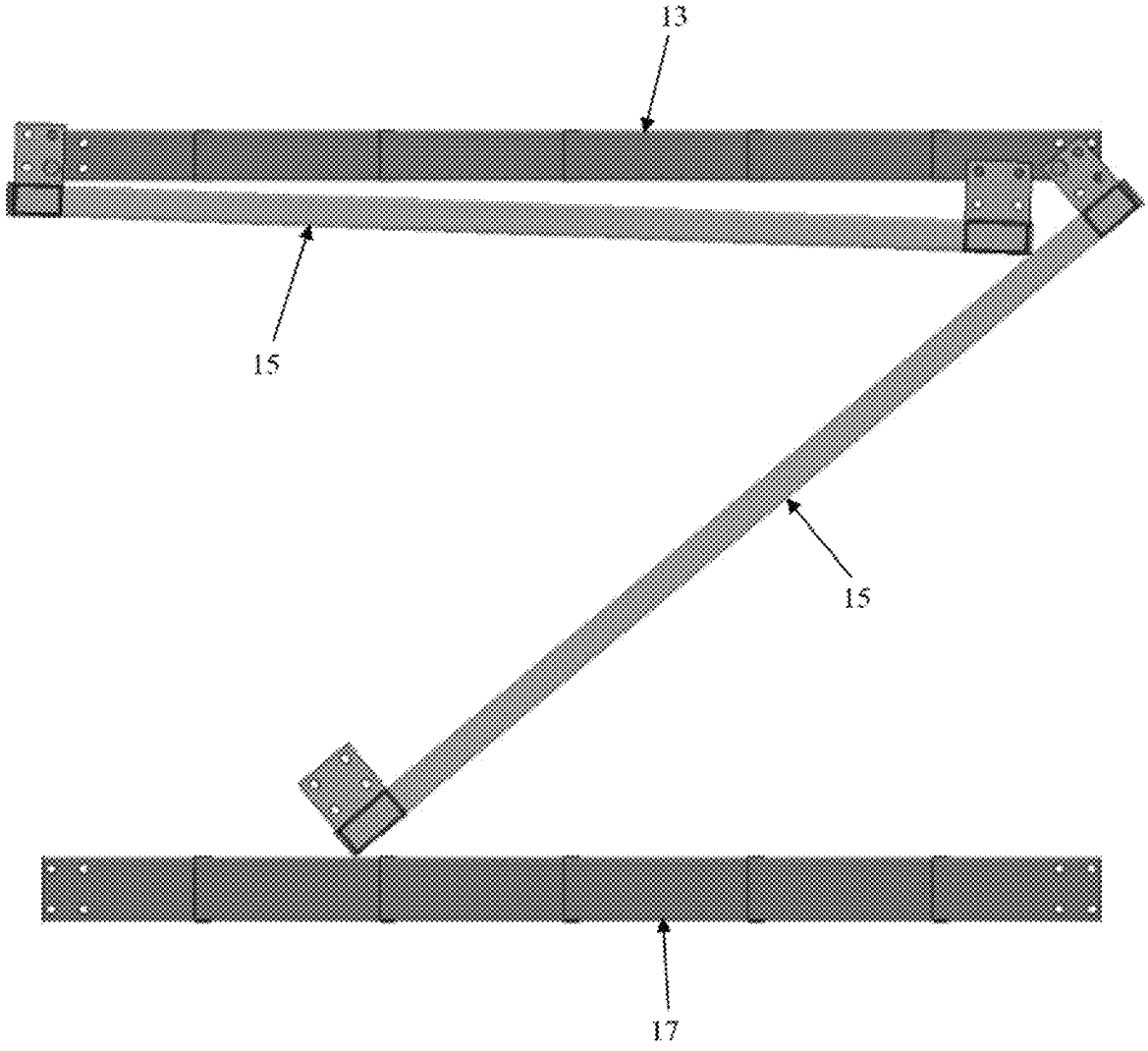
FIG. 21 is a schematic illustration showing how the frame might be collapsed.

Referring to FIGS. 1-2B, an expandable and collapsible steel module or "skeleton frame" of the present disclosure is generally indicated at 11. The skeleton frame 11 may be used in the construction of a building framework and may also be referred to as a "skeleton", "frame", "steel cage", or "cage". For example, multiple assembled steel modular skeleton frames 11 may be stacked on top of each other and disposed side-by-side to form the framework of a building. In the illustrated embodiment, the frame 11 comprises a ceiling assembly 13, a pair of wall assemblies 15 attachable to opposite sides of the ceiling assembly, and a floor assembly 17 attachable to bottoms of the wall assemblies. The wall assemblies 15 may be movably (e.g., pivotably) attached to the ceiling assembly 13 so that initially, the frame 11 may be formed in a collapsed or flattened state (FIGS. 2 and 17). The collapsed state allows multiple collapsed frames 11 to be stacked on top of each other for transporting the frames to a construction site or work site (e.g., an assembly plant) by a single trailer (FIGS. 2A and 2B). In one embodiment, the frame is erected and other components are attached to the frame to create a completed volumetric module for installation at the construction site. For example, a substantially completed room, including drywall, paint/wall finishing, plumbing, electrical and even furniture could be installed and shipped to a construction site. As used herein, "module" or "collapsible steel module" may refer to the skeleton frame 11 or to a more fully or completely finished construction unit that includes additional components added to the module cage to partially or fully finish the interior.

The moveable connection between the wall assemblies 15 and the ceiling assembly 13 allows the wall assemblies to be quickly and easily unfolded from the collapsed state to the expanded (erected) state. As will be explained in greater detail below, once the ceiling assembly 13 is lifted, gravity helps the wall assemblies 15 to be rotated around a key bolt to configure the frame 11 from the collapsed state to the expanded state. Alternatively, the wall assemblies 15 may be movably attached to the floor assembly 17 (FIG. 22) such that the wall assemblies are unfolded upward to configure the frame 11 from the collapsed state to the expanded state.

Figure 23:
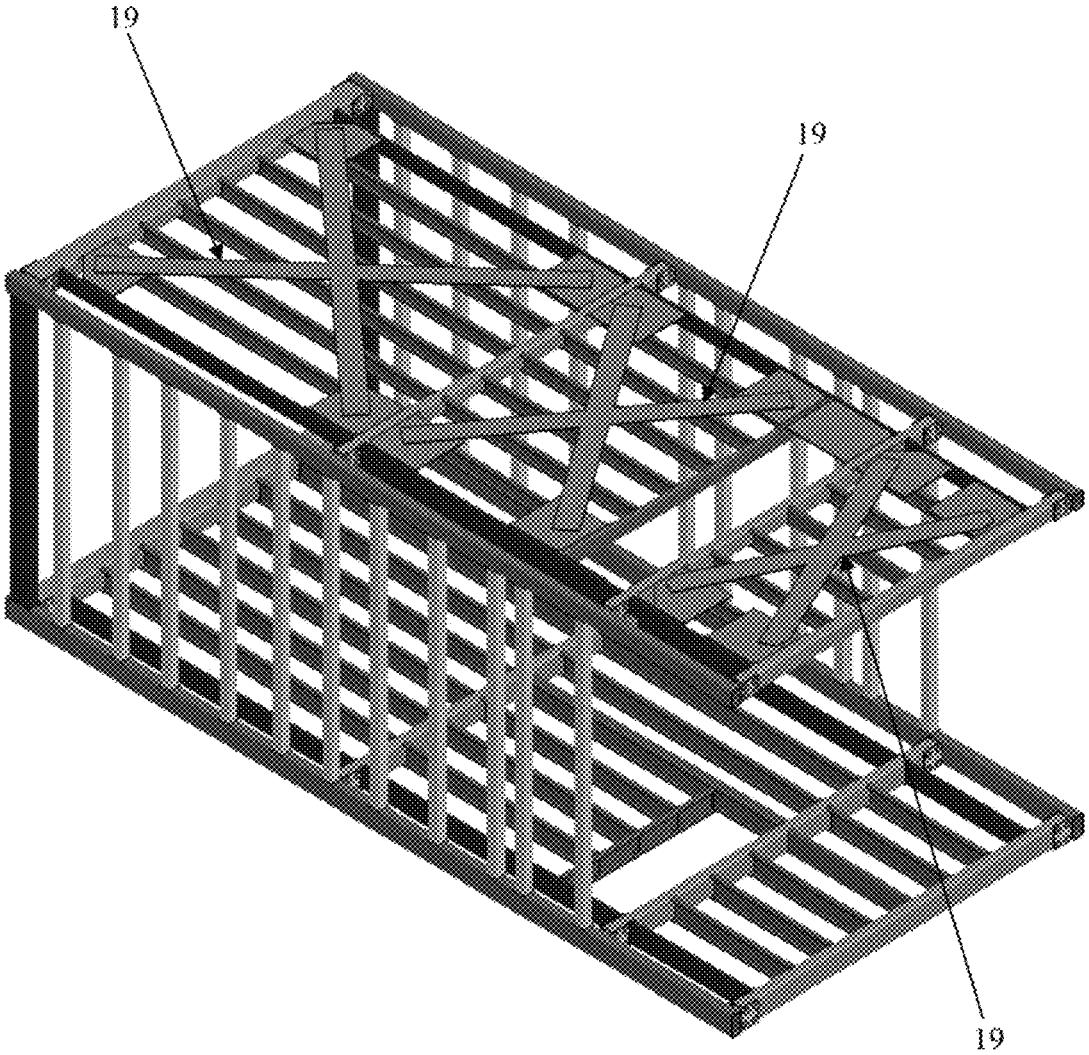
FIG. 23 is a perspective of a modular steel cage or "skeleton frame" of another embodiment as erected.

Additionally, the ceiling assembly 13 and floor assembly 17 may have bracing straps 19 (FIG. 23) for reinforcing the frame 11. However, the frame 11 can be configured to withstand the structural requirements to function as the building framework without additional straps. The assemblies 13, 15, 17 may also be transported in a separate/non-staked configuration and suitably attached together at the construction site. Moreover, the movable connection between the wall assemblies 15 and the ceiling assembly 13 and/or floor assembly 17 is not required. Thus, the frame 11 can be suitably erected by separately attaching the wall assemblies 15 to the floor assembly 17 and then attaching the ceiling assembly to the wall assemblies. Other orders of attachment of the assemblies 13, 15, 17 are also envisioned without departing from the scope of the disclosure.

Referring to FIGS. 3-6, each wall assembly 15 comprises a top member or beam 21, a bottom member or beam 23, and a plurality of first vertical members or studs 25 extending between the top and bottom members. The top and bottom members 21, 23 extend parallel to each other, and the first studs 25 extend parallel to each other. The first studs 25 are spaced inward from longitudinal ends of the top and bottom members 21, 23 such that the first studs extend from a top surface of the bottom member to a bottom surface of the top member. A second vertical member 27 is disposed on one of the longitudinal ends of the top and bottom members 21, 23 and extends generally from a bottom surface of the top member to a bottom surface of the top member such that the top and bottom of the second vertical member is flush with the top and bottom members, respectively. The second vertical members 27 extend parallel to the studs 25. In the illustrated embodiment, a single second vertical member 27 is shown. However, additional (e.g., two or four) second vertical members may be provided. For example, a second vertical member 27 may be disposed between two or more pairs of connection plates 45. Additionally, the single second vertical member 27 can be omitted.

In one embodiment, the top and bottom members 21, 23 may have a length L of between about 5 and about 60 feet. The length L of the top and bottom members 21, 23 may also define a length of the frame 11. In one embodiment, the first studs 25 may have a length or height of between about 6 and about 12 feet. A horizontal spacing between the first studs 25 may vary. In one embodiment, adjacent first studs are spaced between about 1 and about 72 inches apart. In one embodiment, the adjacent first studs are spaced between about 1 and about 11 inches apart. It will be understood that these dimensions are exemplary only, and that the components of the wall assemblies 15 may have other dimensions and spacings depending on the desired size and shape of the frame 11. In the illustrated embodiment, each of the top and bottom members 21, 23 and the second vertical members 27 have a hollow structural section that is rectangular in shape (built up box member or HSS tube section). However, the members could have other configurations without departing from the scope of the disclosure. For example, the members could comprise wide flange sections.

Figure 5:
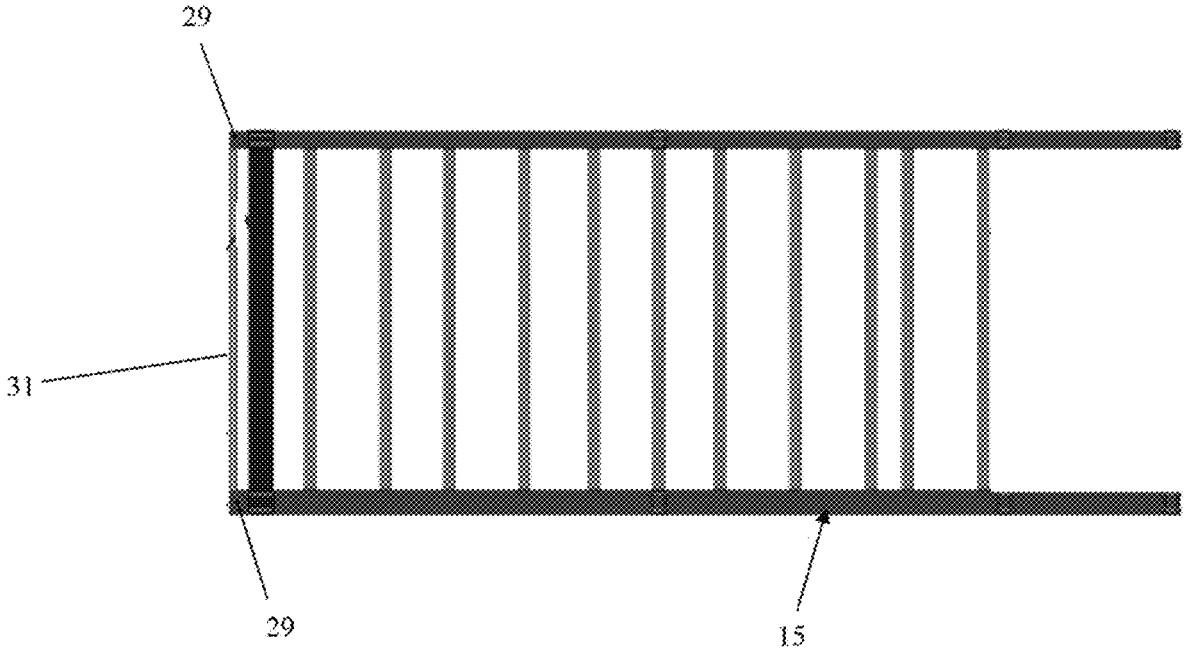
FIG. 5 is an elevation of a wall assembly having an alternative construction.
Figure 6:
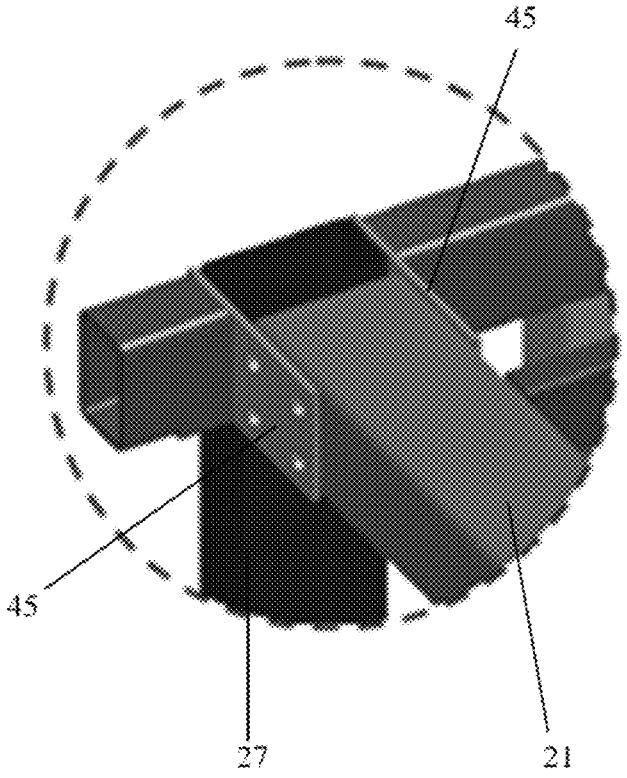
FIG. 6 is an enlarged fragmentary perspective of the frame of FIG. 1 showing connecting elements of a ceiling to a wall joint.
Figure 7:
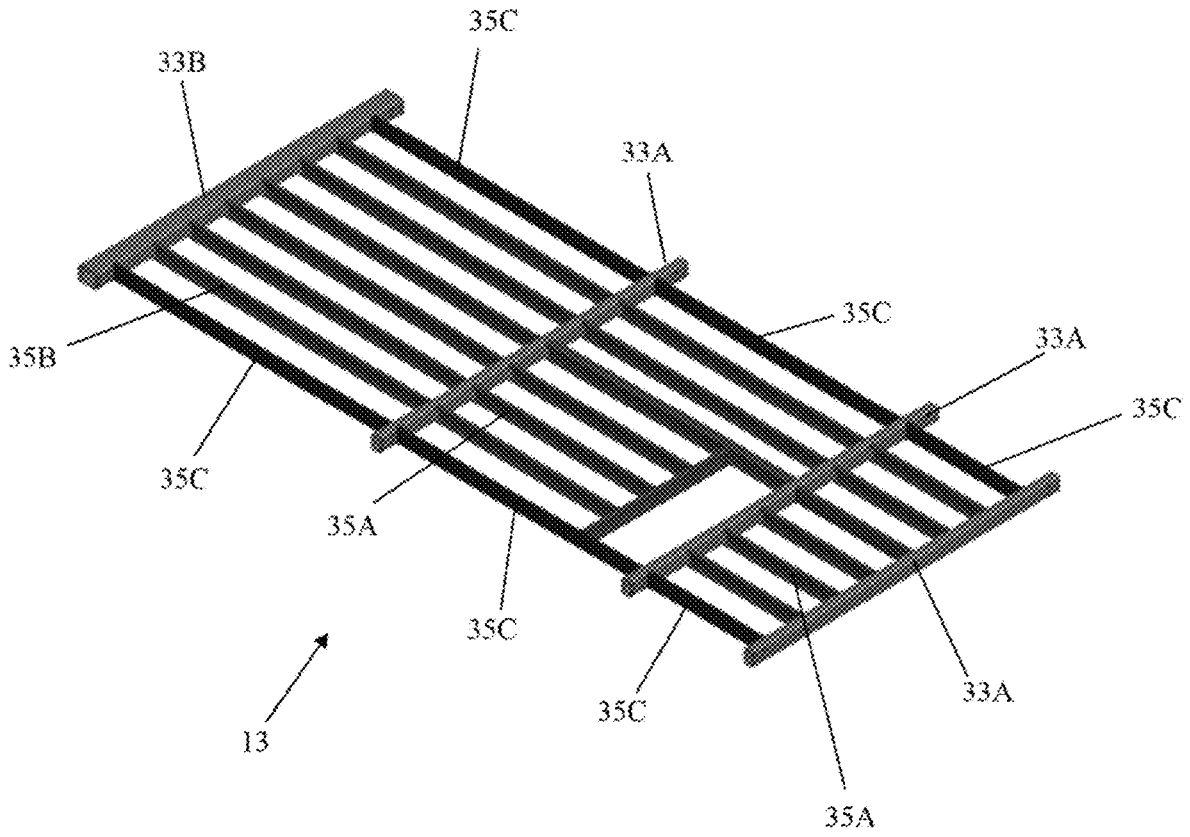
FIG. 7 is a perspective of a ceiling assembly.
Figure 8:
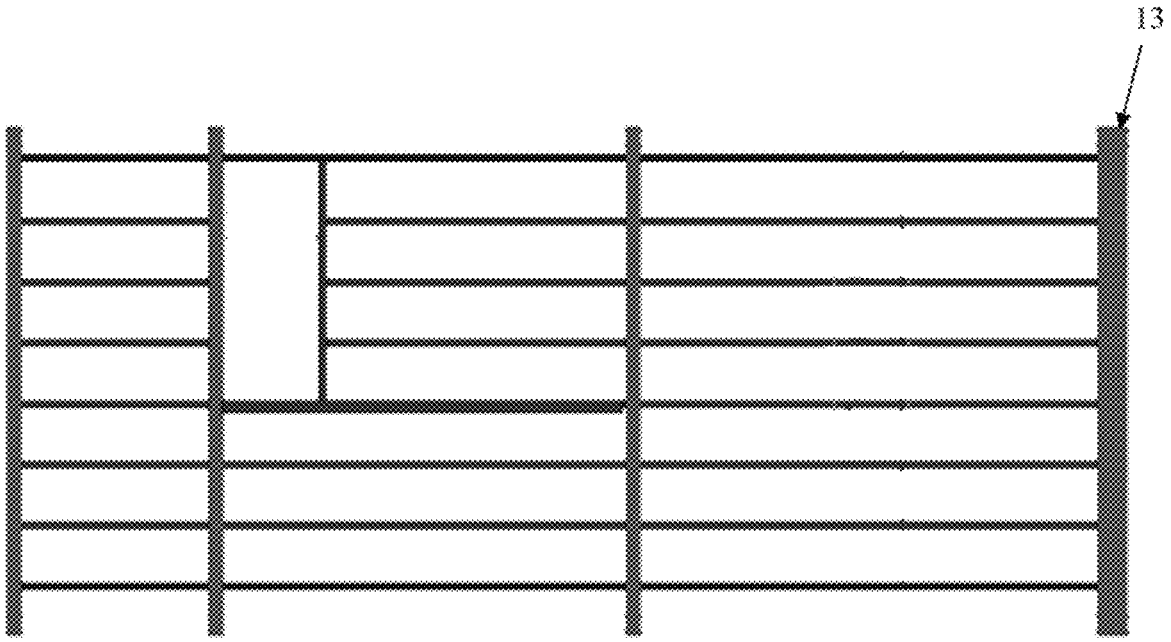
FIG. 8 is a plan view of the ceiling assembly.
Figure 9:
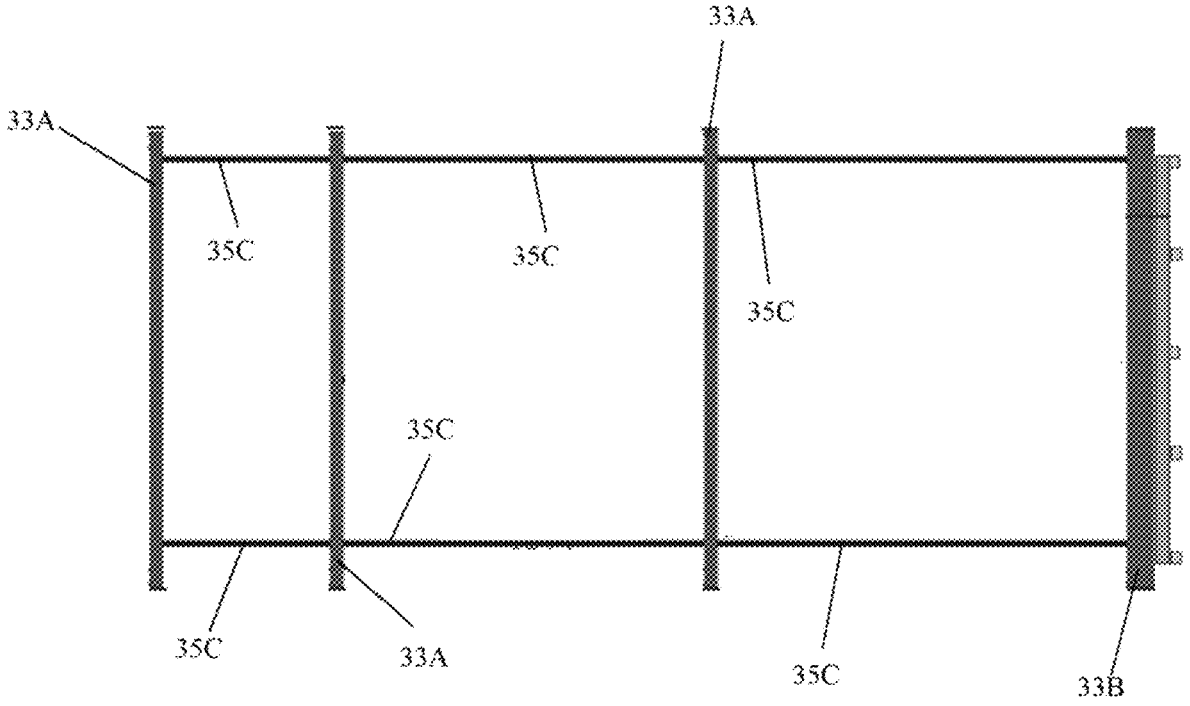
FIG. 9 is a plan view of a ceiling assembly without certain rafter components.
Figure 10:
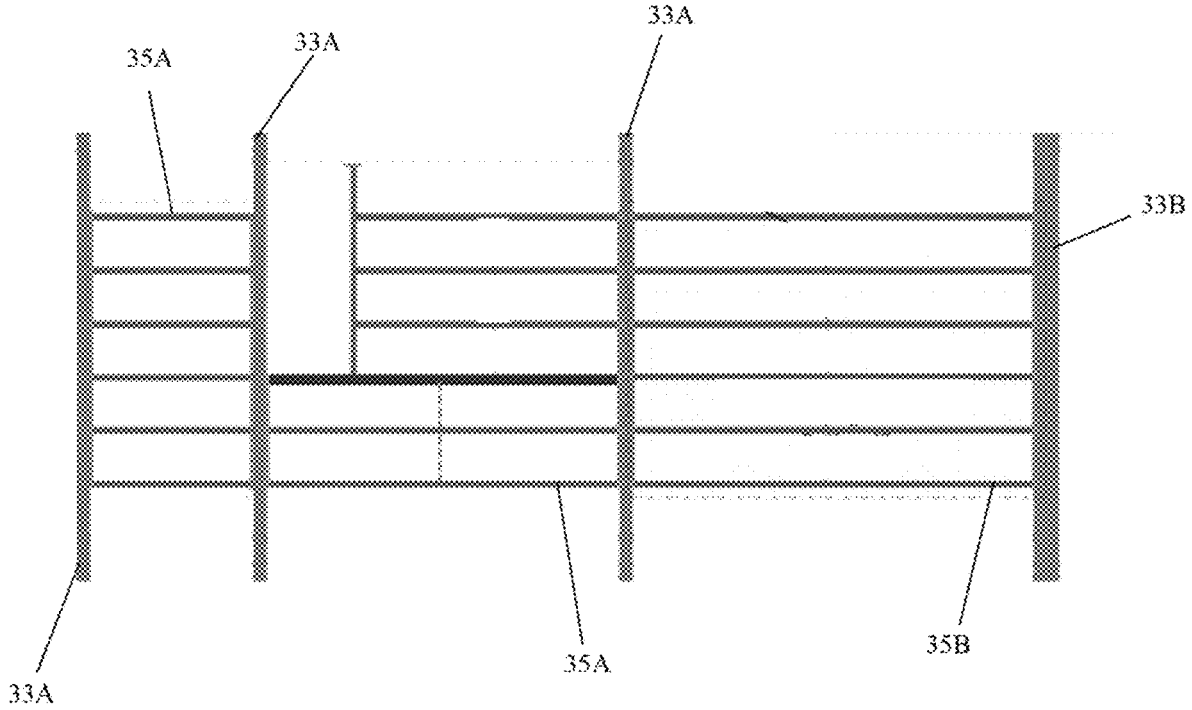
FIG. 10 is a plan view of the ceiling assembly without certain perimeter components.
Figure 11:
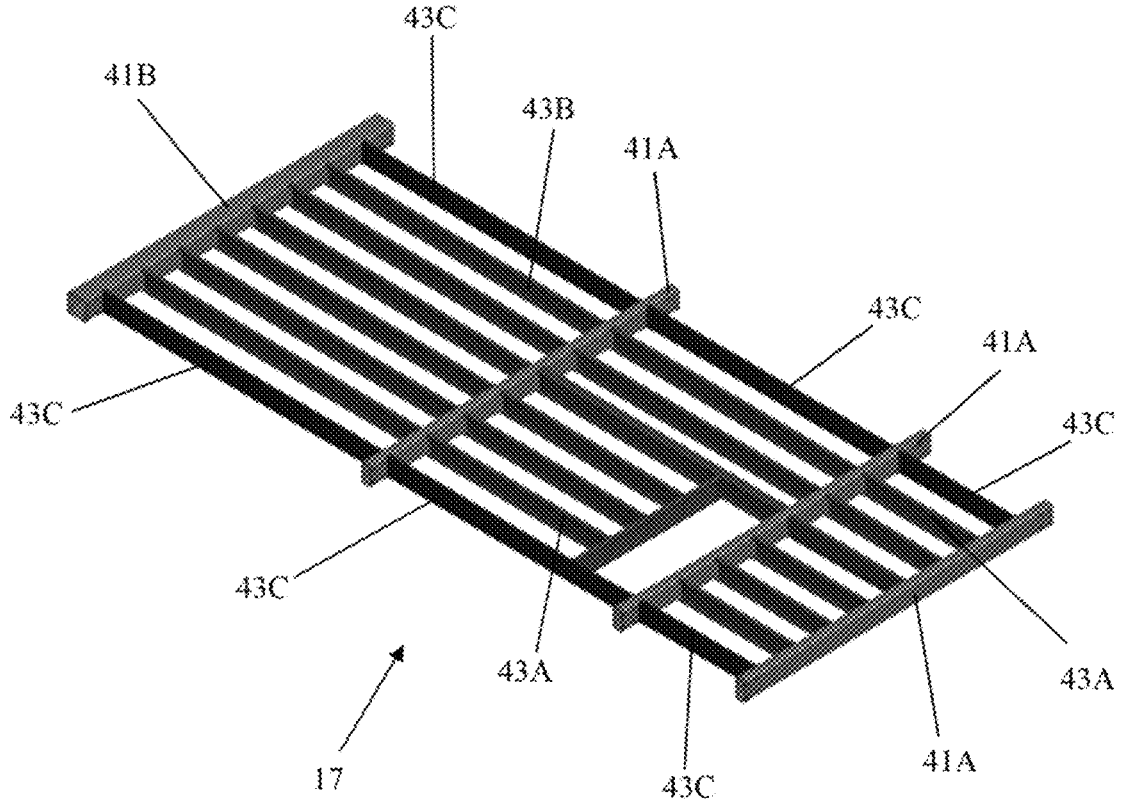
FIG. 11 is a perspective of a floor assembly.
Figure 12:
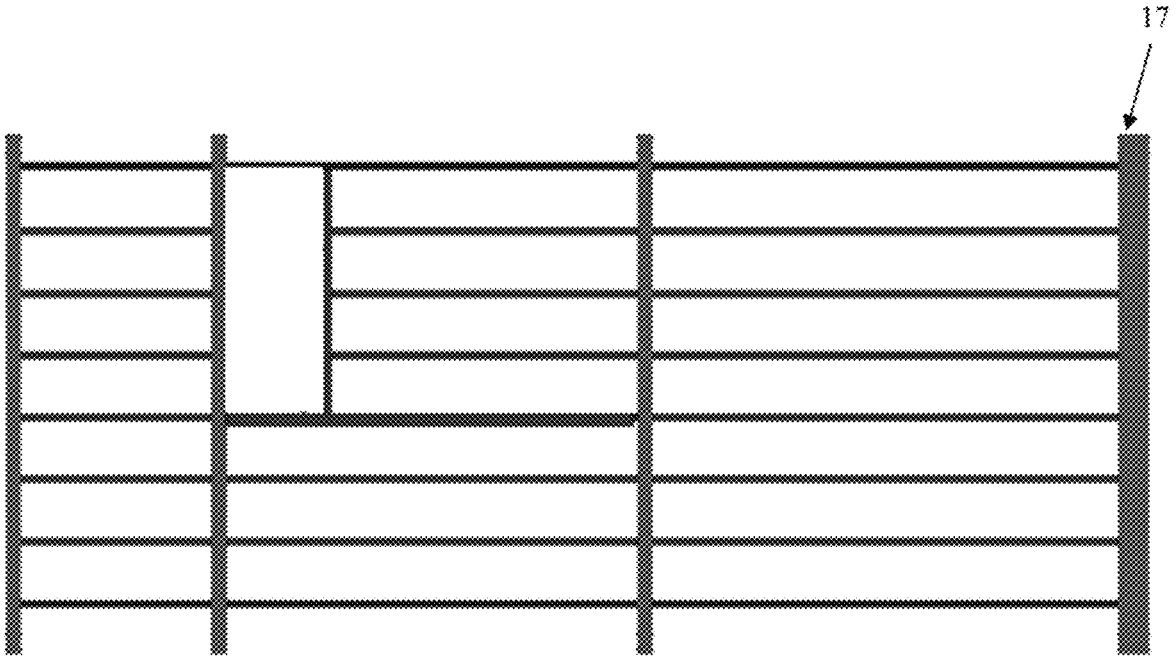
FIG. 12 is a plan view of the floor assembly.
Figure 13:
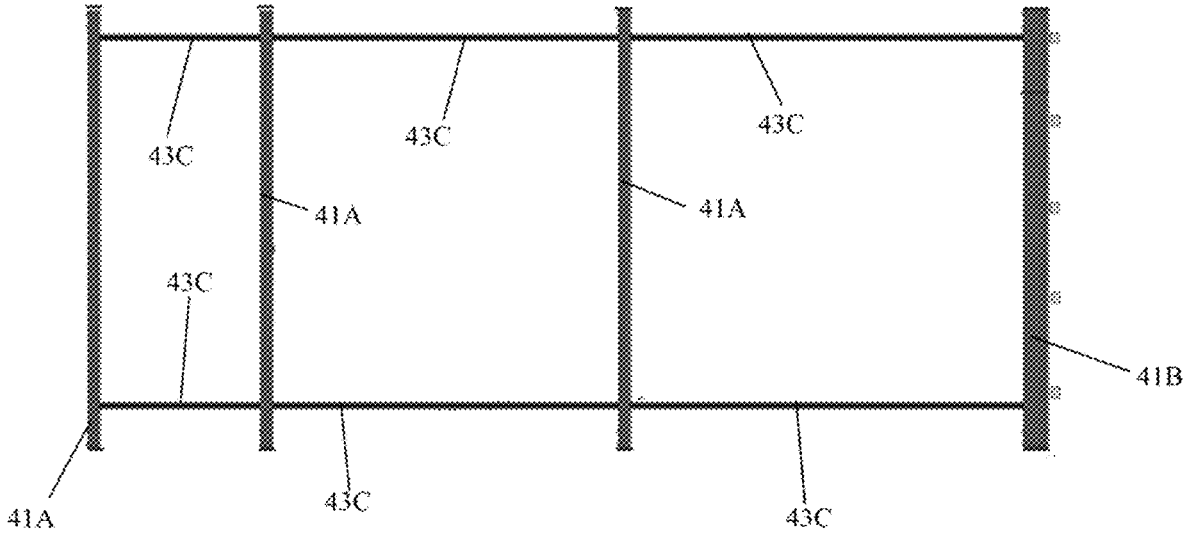
FIG. 13 is a plan view of the floor assembly without certain joist components.
Figure 14:
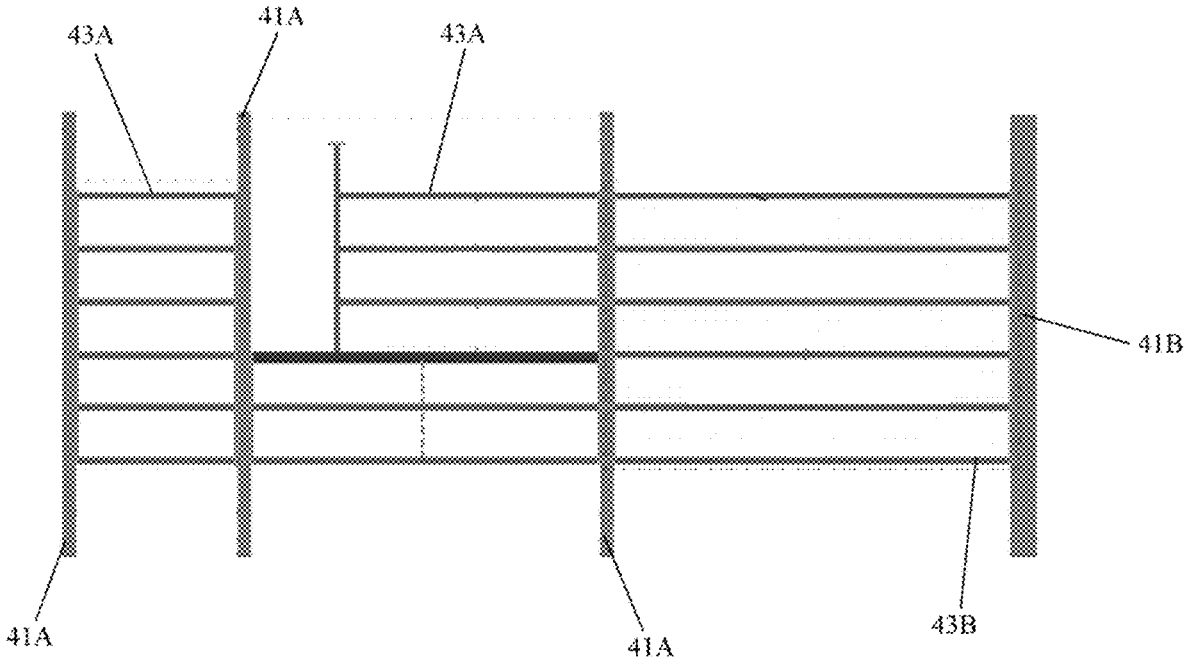
FIG. 14 is a plan view of a floor assembly without certain perimeter components.

Optional extension cross members/bars 29 may extend from the top and bottom of the second vertical member 27 generally parallel to and away from the top and bottom members 21, 23, respectively (FIGS. 5 and 6). A third vertical member 31 may extend between the optional extension bars 29.

Referring to FIGS. 7-10, the ceiling assembly 13 comprises a plurality of parallel ceiling members or beams 33 spaced apart along a length of the ceiling assembly, and a plurality of parallel horizontal ceiling members or rafters 35 extending between the beams. In particular, first beams 33A extend across the ceiling assembly 13, and first rafters 35A extend between the first beams. In the illustrated embodiment, one of the first beams 33A defines an end of the ceiling assembly 13, and the other first beams define intermediate portions of the ceiling assembly. A second beam 33B defines an opposite end of the ceiling assembly 13. Second ceiling members or rafters 35B extend between the second beam 33B and one of the first beams 33A. Third ceiling members or rafters 35C define the outermost ceiling members on the ceiling assembly 13 and extend between the first beams 33A and between the second beam 33B and one of the first beams. In one embodiment, the ceiling assembly 13 may have a length of between about 5 and about 60 feet. In one embodiment, the first and second beams 33A, 33B may have a length of between about 8 and about 15 feet. A horizontal spacing between the rafters 35 may vary. In one embodiment, adjacent rafters 35 are spaced between about 16 and about 24 inches apart. It will be understood that these ranges are exemplary only, and that the components of the ceiling assembly 13 may have other dimensions and spacings depending on the desired size and shape of the frame. The rafters 35 preferably extending in a direction parallel to the axis about which the wall assemblies 15 pivot with respect to the ceiling assembly 13.

In the illustrated embodiment, each of the first and second beams 33A, 33B and the third rafters 35C have a hollow structural section that is rectangular in shape (built up box member or HSS tube section), and each of the first and second rafters 35A, 35B has a channel shape. In one embodiment, the first beams 33A are 6×4 inch HSS tube sections, the second beam 33B is an 8×6 inch HSS tube section, and the third rafters 35C are $6\times2^{1/8}$ inch HSS tube sections. The first beams 33A may also be a 4×4 HSS tube section, and the second beam 33B may be a 6×6 HSS tube section. The ceiling members could still have other configurations without departing from the scope of the disclosure. Diagonal straps 19 (FIG. 23) may be attached to improve the in-plane stability of the ceiling assembly. However, as noted previously, the frame 11 can be configured to withstand the structural requirements to function as the building framework without additional straps or other reinforcement.

Referring to FIGS. 11-14, the floor assembly 17 comprises a plurality of parallel cross members/bars 41 spaced apart along a length of the ceiling assembly, and a plurality of parallel horizontal floor members or joists 43 extending between the bars. The floor assembly 17 is configured substantially similarly to the ceiling assembly 13. In particular, first bars 41A extend across the floor assembly 17, and first floor members or joists 43A extend between the first bars. In the illustrated embodiment, one of the first bars 41A defines an end of the floor assembly 17, and the other bars define intermediate portions of the floor assembly. A second cross member/bar 41B defines an opposite end of the floor assembly 17. Second floor members or joists 43B extend between the second bar 41B and one of the first bars 41A. Third floor members or joists 43C define the outermost floor members on the floor assembly 17 and extend between the first bars 41A and between the second bar 41B and one of the first bars. In one embodiment, the floor assembly 17 may have a length of between about 5 and about 60 feet. In one embodiment, the first and second bars 41A, 41B may have a length of between about 8 and about 15 feet. A horizontal spacing between the joists 43 may vary. In one embodiment, adjacent joists 43 are spaced between about 16 and about 24 inches apart. It will be understood that these ranges are exemplary only, and that the components of the floor assembly 17 may have other dimensions depending on the desired size and shape of the frame. In a preferred embodiment, the joists 43 extend parallel to the axes about which the wall assemblies 15 pivot with respect to the ceiling assembly 13.

In the illustrated embodiment, each of the first and second bars 41A, 41B and the third joists 43C have a hollow structural sections that are rectangular in shape (built up box member or HSS tube section), and each of the first and second joists 43A, 43B has a channel shape. In one embodiment, the first bars 41A are 8×4 inch HSS tube sections, the second bar 41B is an 8×8 inch HSS tube section, and the third joists 43C are $8\times2^{1/8}$ inch HSS tube sections. The second bar 41B may also be an 8×6 HSS tube section. The members could still have other configurations without departing from the scope of the disclosure.

Figure 15:
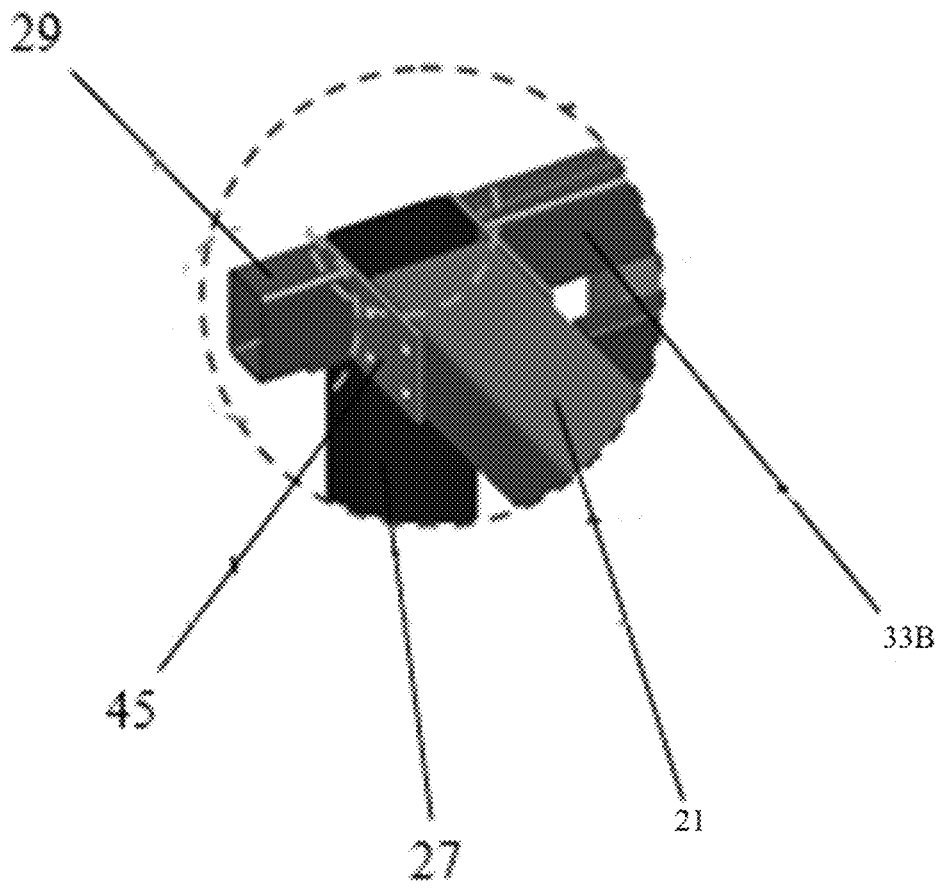
FIG. 15 is an enlarged fragmentary perspective of the frame of FIG. 1 showing the connecting elements of a ceiling to a wall joint.

Referring to FIGS. 1, 6, and 15, the wall assemblies 15 are attached to the ceiling assembly 13 along the sides of the ceiling assembly by connection plates 45. The connection plates 45 are fixedly attached to the top and bottom members 21, 23 of the wall assemblies 15. For example, the connection plates 45 may be welded to the top members. However, the connection plates 45 may be attached to the wall assemblies 15 by other means. In the illustrated embodiment, each connection plate 45 comprises a generally rectangular plate member defining a plurality of fastener holes. In the illustrated embodiment, each connection plate 45 defines four fastener holes. The fastener holes are located generally at the corners of the portion of the connection plate 45 exposed from top members 21, 23 such that the fastener holes are arranged generally in a square or rectangular shape. A first pair of fastener holes are located adjacent a free end of the connection plate 45, and a second pair of fastener holes are located adjacent the top member 21, 23 to which the connection plate is attached. It will be understood that the connection plates 45 may define other numbers of holes arranged in other locations on the plates without departing from the scope of the disclosure. In one embodiment, the connection plates 45 may be considered part of their respective wall assembly 15.

The connection plates 45 are arranged in pairs along the length of the beams 21, 23. In particular, the pairs of connection plates 45 are spaced such that each pair of connection plates 45 on the top members 21 is configured to receive one of the beams 33A, 33B on the ceiling assembly 13, and each pair of connection plates on the bottom members 23 are configured to receive one of the bars 41A, 41B on the floor assembly 17. Fasteners (e.g., bolts) 47 are received in the fastener holes of the connection plates 45 to attach the plates to the beams 33A, 33B on the ceiling assembly 13 and the bars 41A, 41B on the floor assembly 17. In one embodiment, the bolts 47 are slip critical bolts. Thus, the bolts 47 can be pre-tensioned to eliminate slippage once the frame 11 is erected. There are at least four pairs of connection plates 45 on each top and bottom member 21, 23. Thus, at least a total of 32 bolts are used to attach each top member 21 to one of the ceiling assembly 13 and each bottom member 23 to the floor assembly 17. It will be understood, however, that a different number of bolts may be used without departing from the scope of the disclosure. The attachment of the wall assemblies 15 to the ceiling assembly 13 and floor assembly 17 using the connection plates 45 creates a moment resisting column-to-beam type joint connection structure for resisting vertical moment loads.

Figure 16:
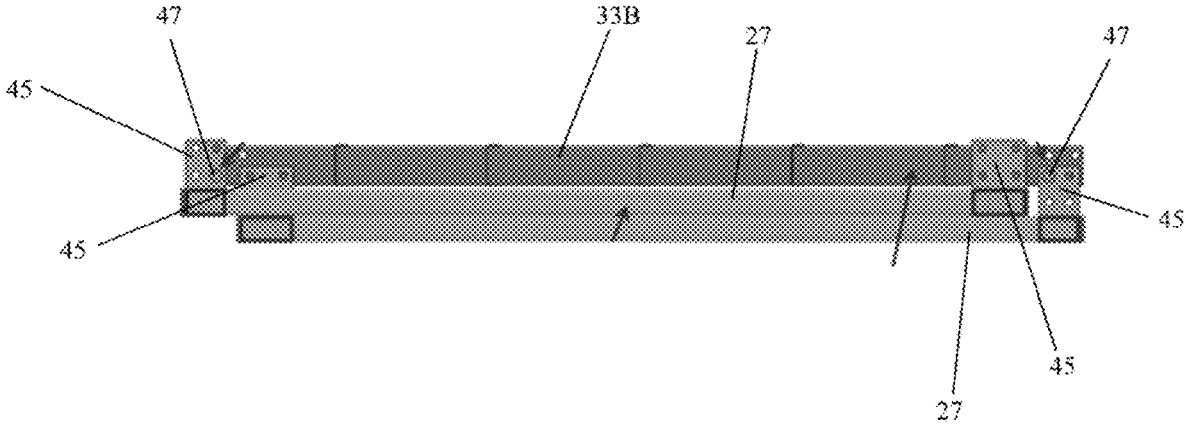
FIG. 16 is an end view showing the ceiling and wall assemblies in a collapsed configuration.

Referring to FIGS. 2, 16, and 17, the wall assemblies 15 can be attached to the ceiling assembly 13 in such a way to facilitate configuring the frame 11 in the collapsed state. In particular, the left wall assembly 15 (when viewed from the end view of FIG. 16) can be oriented horizontally below the ceiling assembly 13 and attached to the left side of the ceiling assembly such that a single fastener 47 is received in one of the pair of fastener holes in the connection plate 45 located adjacent the vertical member 27, through an aligned fastener hole in the beam 33B of the ceiling assembly and through a corresponding fastener hole in the other connection plate. In the illustrated embodiment, the single fastener 47 is received in the right-side fastener hole of the pair of fastener holes located adjacent the vertical member 27. In this position, the connection plates 45 on an opposite end of the vertical member 27 on the left wall assembly 15 are also positioned to receive the beam 33B of the ceiling assembly 13. The parallel arrangement of the vertical member 27 on the left wall assembly 15 and the rafter 33B on the ceiling assembly 13 facilitate stacking the assemblies in this manner. It will be understood that the opposite end of the left wall assembly 15 may be attached in a suitable manner to the opposite end of the ceiling assembly 13. The pairs of connection plates 45 are spaced along the top and bottom members 21, 23 of the left wall assembly 15 so as to receive and pivotably connect to the beams 33A, 33B of the ceiling assembly 13 in the collapsed state. It is envisioned that some of the connection plates 45 may not be pivotably connected to the left wall assembly 15.

The right wall assembly 15 (when viewed from the end view of FIG. 16) can be oriented horizontally below the left wall assembly 15 and attached to the right side of the ceiling assembly 13 such that a single fastener 47 is received in one of the pair of fastener holes located adjacent the free end of the connection plate 45. In the illustrated embodiment, the single fastener 47 is received in the left-side fastener hole of the pair of fastener holes located adjacent the free end of the connection plate 45. Attaching the end portion of the connection plate 45 to beam 33B positions the right wall assembly 15 below the left wall assembly 15 for a compact configuration where the ceiling assembly 13 and the two wall assemblies are stacked on top of each other. This location of the fastener 47 causes the right wall assembly 15 to be spaced farther away from the ceiling assembly 13 than the left wall assembly in the collapsed position. Further, in this position, the connection plates 45 on an opposite end of the vertical member 27 on the right wall assembly 15 are also positioned to receive the beam 33B of the ceiling assembly 13. The parallel arrangement of the vertical member 27 on the right wall assembly 15 and the beam 33B on the ceiling assembly 13 facilitate stacking the assemblies in this manner. It will be understood that the opposite end of the right wall assembly 15 may be attached in a suitable manner to the opposite end of the ceiling assembly 13. Thus, a total of only four fasteners can be used to configure the assemblies 13, 15 in this stacked configuration. The pairs of connection plates 45 are spaced along the top and bottom members 21, 23 of the right wall assembly 15 so as to receive the beams 33A, 33B of the ceiling assembly 13 in the collapsed state.

The location and geometry of the pivot connections and other components of the frame are particularly configured to permit the frame to be collapsed without interference of the wall assemblies with any part of the ceiling assembly. Moreover, the components are sized and connected together so that the wall assemblies 15 may lie substantially flat one upon the other in the collapse position.

The collapsed ceiling and wall assemblies 13, 15 can then be placed on top of the horizontally oriented floor assembly 17 (FIG. 17) to configure the entire frame 11 in the collapsed state. In this state, multiple frames 11 can be stacked on top of each other in a space-saving manner (FIG. 2B). Accordingly, the multiple frames 11 can be transported in a transportation vehicle in the collapsed state to a construction site or work site for subsequently erecting the frames during construction of a building framework. Additionally, the assemblies 13, 15, 17 can be stacked on top of each other for transport in a detached configuration such that the wall assemblies are free of attachment, moveable or otherwise, to the ceiling assembly or floor assembly.

Referring to FIGS. 18-21, the ("lift version") frame 11 can be reconfigured from the collapsed state into the expanded state by elevating the ceiling assembly 13 above the floor assembly 17 and pivoting the wall assemblies 15 downward until the second vertical members 27 of the wall assemblies are oriented substantially vertically. It will be understood, that the wall assemblies 15 pivot downward under the force of gravity as the ceiling assembly 13 is raised. In one embodiment, cables (not shown) may be attached between the ceiling assembly 13 and the wall assemblies 15 to control the rate of the pivoting movement of the wall assemblies. By pivoting the wall assemblies 15 such that they are oriented generally vertically, the fastener holes in the connection plates 45 will be aligned with fastener holes in the beam 33B of the ceiling assembly 13 for inserting fasteners in the remaining fastener holes of the connection plates to secure the wall assemblies 15 to the ceiling assembly. The connection plates 45 on the top members 21 of the wall assemblies 15 will also receive the beams 33A of the ceiling assembly 13 such that the fastener holes in the connection plates are aligned with fastener holes in beam 33A for fully attaching the wall assemblies to the ceiling assembly. The connection plates 45 on the bottom of the second vertical members 27 of the wall assemblies 15 can then be positioned to receive ends of the bar 41B of the floor assembly 17. The connection plates 45 on the bottom members 23 of the wall assemblies 15 will also receive the bars 41A of the floor assembly 17 such that the fastener holes in the connection plates are aligned with fastener holes in bars 41A. With the fastener holes in the connection plates 45 on the wall assemblies 15 aligned with the fastener holes in the bars 41A, 41B of the floor assembly 17, the wall assemblies can be secured to the floor assembly, thus fully erecting the frame 11 in the expanded state. This assembly method can be used when the assemblies are in a staked or non-stacked pre-assembled configuration. Accordingly, the wall assemblies 15 can be movably attached to the ceiling assembly 13 after the assemblies have been transported to the worksite.

Figure 22:
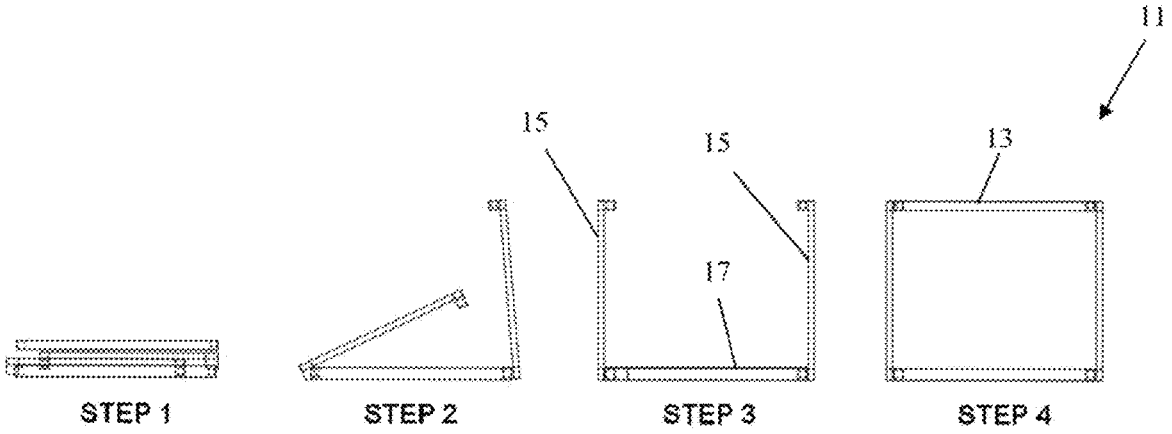
FIG. 22 is a schematic showing a sequence of erecting a skeleton frame of another embodiment in which the wall assemblies are pivotally connected to the floor assembly during transport.

Referring to FIG. 22, an alternative configuration ("standard version") of the frame 11 may be used where the wall assemblies 15 are first attached to the floor assembly 17 in the same manner in which the wall assemblies are first attached to ceiling assembly 13 in the previous embodiment. The wall assemblies 15 can then be pivoted upward and secured to the ceiling assembly 13. This assembly method can also be used when the assemblies are in a staked or non-stacked pre-assembled configuration.

Figure 24:
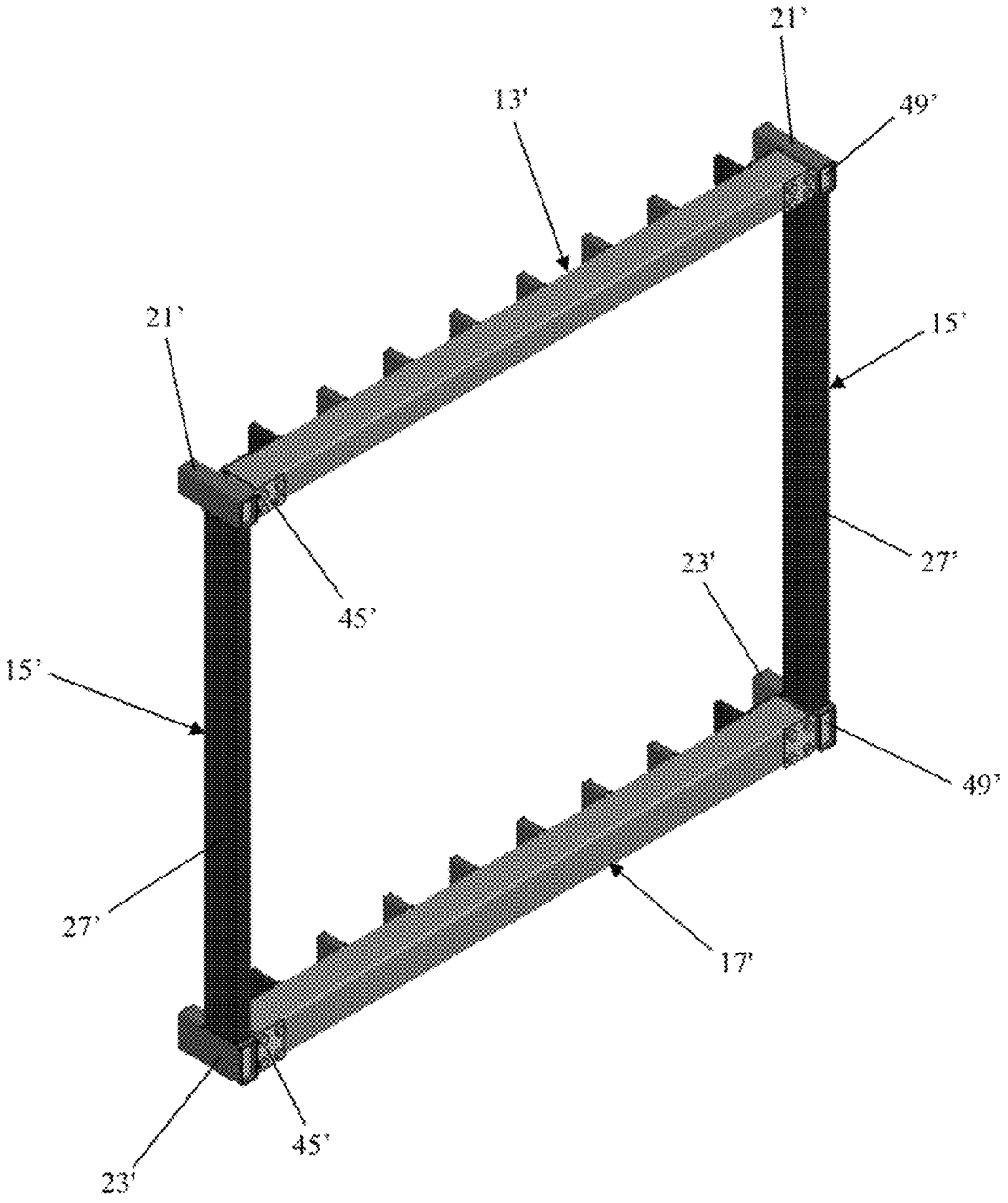
FIG. 24 is a perspective of a portion of a modular steel cage or skeleton frame of another embodiment.
Figure 25:
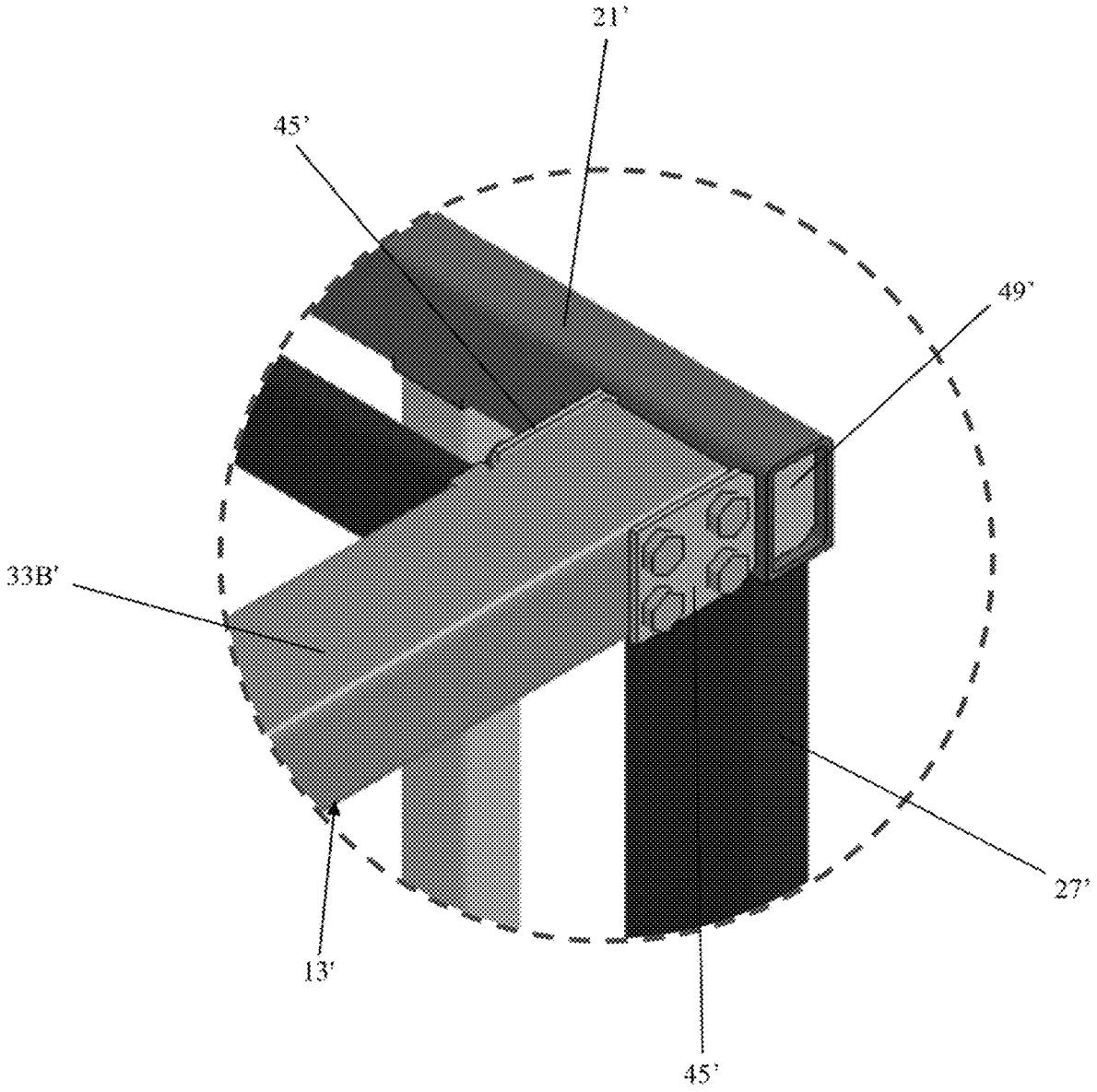
FIG. 25 is a fragmentary portion of the connection elements in FIG. 24.

Referring to FIGS. 24 and 25, in an alternative embodiment of the wall assemblies 15', top and bottom members 21', 23' may extend continuously all the way to both ends of the wall assembly. Thus, second vertical members 27' will extend from a top surface of the bottom member 23' to a bottom surface of the top member 21'. In this embodiment, the pair of connection plates 45' on the end of the wall assembly adjacent the second vertical member 27' may extend directly from the top and bottom members 21', 23' instead of extending from the second vertical member as is the case in the previous embodiment. Additionally, a continuity plate 49' may be provided in the top and bottom members 21', 23' to increase the strength and stiffness or the top and bottom members. The frame may otherwise be constructed and function in the same manner are previously described.

Figure 26:
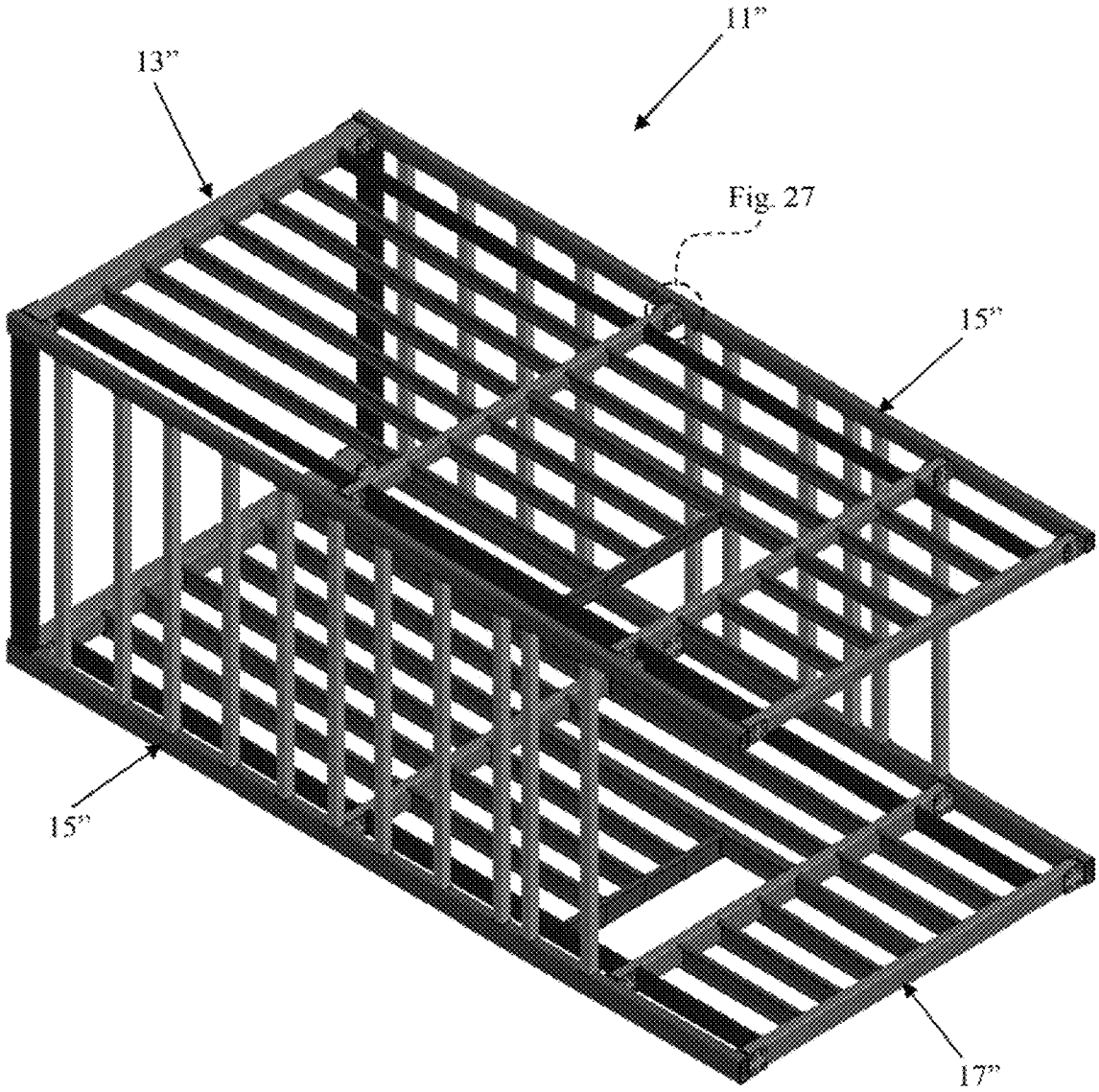
FIG. 26 is a perspective of a modular steel cage or skeleton frame of another embodiment as erected.
Figure 27:
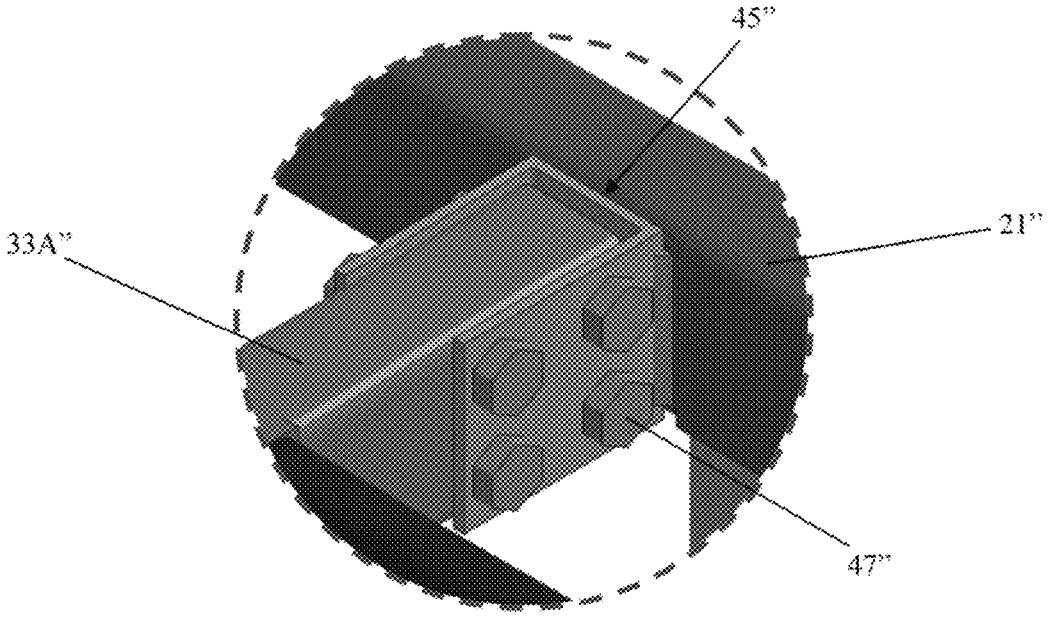
FIG. 27 is an enlarged fragmentary view of FIG. 26 showing connection elements.
Figure 28:
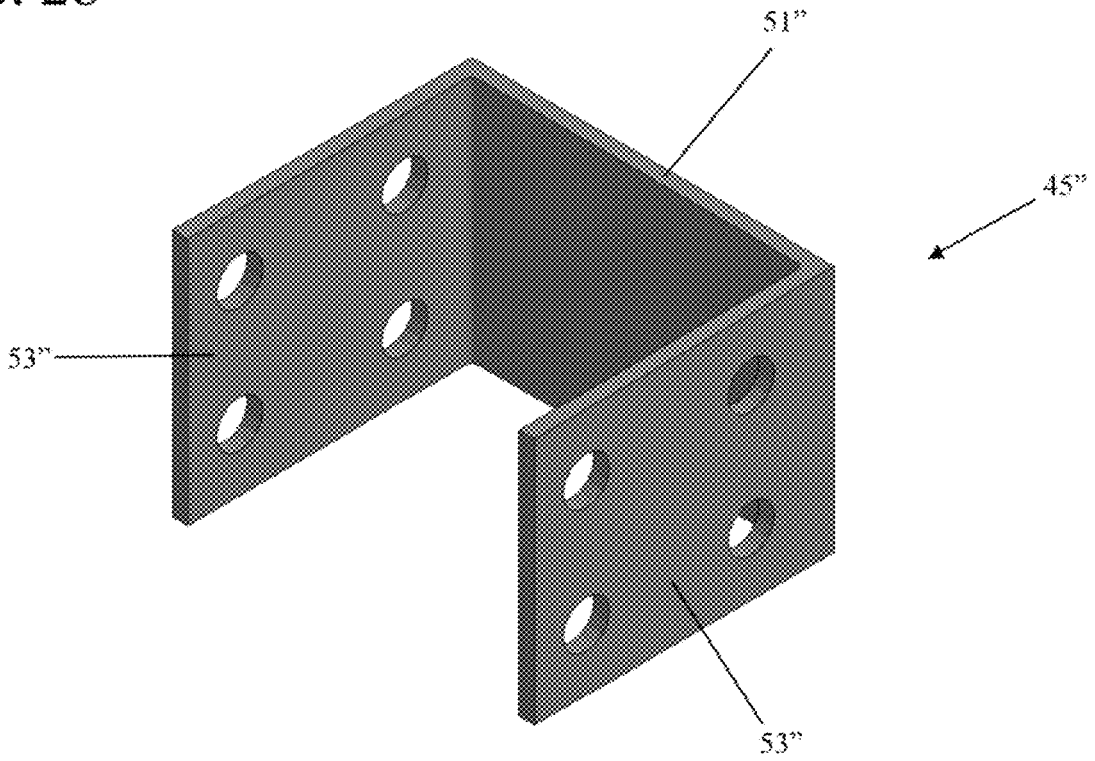
FIG. 28 is a perspective of a bracket in FIG. 26.

Referring to FIGS. 26-28, another embodiment of a module or frame is generally indicated at 11". The frame 11" is substantially similar to frame 11 of the previous embodiment. However, instead of pairs of connection plates 45, frame 11" includes U-shaped brackets 45" attached to the top and bottom members 21", 23 of the wall assemblies 15" for receiving ends of beams 33 (see beam 33A" in FIG. 27) of the ceiling assembly 13" and ends of bars 41" of the floor assembly 17", respectively. Each bracket 45" includes a base plate 51" and a pair of side plates 53" extending from opposite ends of the base plate. Fasteners (e.g., bolts) 47" are received in the fastener holes of the side plates 53" of the brackets 45" to attach the brackets to the beams on the ceiling assembly 13" and the bars 41" on the floor assembly 17".

Referring to FIGS. 29-41, another embodiment of a module or frame is generally indicated at 111. The frame 111 is substantially similar to frame 11 of the previous embodiment. However, the construction of the ceiling assembly 113 and floor assembly 117 is different. In particular, the ceiling assembly 113 comprises a plurality of ceiling units 120A, 120B. Each ceiling unit 120A, 120B includes a plurality of parallel cross members or beams 133 spaced apart along a length of the ceiling unit, and a plurality of parallel horizontal ceiling members or rafters 135 extending between the beams. In the illustrated embodiment, the ceiling assembly 113 includes a pair of ceiling units 120A, 120B. Each ceiling unit includes first beams 133A extending across the ceiling assembly unit, and rafters 135A extending between the first beams. In the illustrated embodiment, one of the first beams 133A defines an end of the ceiling unit 120A, 120B, and the other first beams define intermediate portions of the ceiling unit. A second beam 133B defines an opposite end of the ceiling unit 120A, 120B. Rafters 135A extend between the first means 133A in the interior of the ceiling unit 120A or 120B. Second rafters 135B extend between the second beam 133B and the nearest first beam 133A in the interior of the ceiling unit 120A or 120B. Third ceiling members or rafters 135C extend between both the second beam 133B and the intermediate first beams 133A, and between the two first beams 133A. The rafters 135C are on the perimeter of the ceiling unit 120A or 120B. Each ceiling unit 120A, 120B is a self-contained unit formed separately from any other ceiling unit. In one embodiment, each ceiling unit 120A, 120B may have a length of between about 5 and about 60 feet, and a width of between about 1 ft and about 14 ft. As will be understood, the width of ceiling units 120A, 120B is determined by the length of the first and second beams 133A, 133B.

Figure 29:
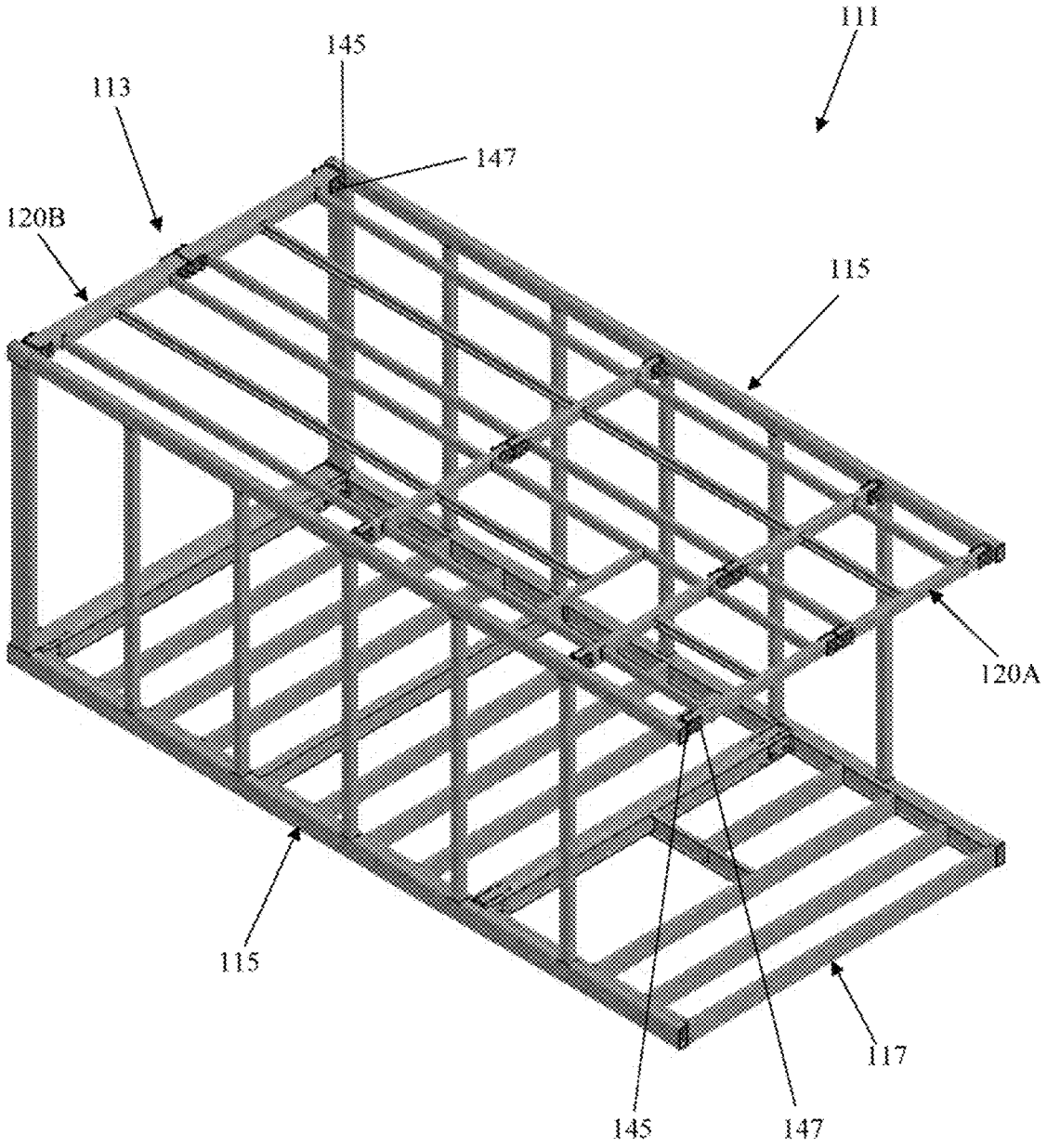
FIG. 29 is a perspective of a modular steel cage or skeleton frame of another embodiment as erected.
Figure 30:
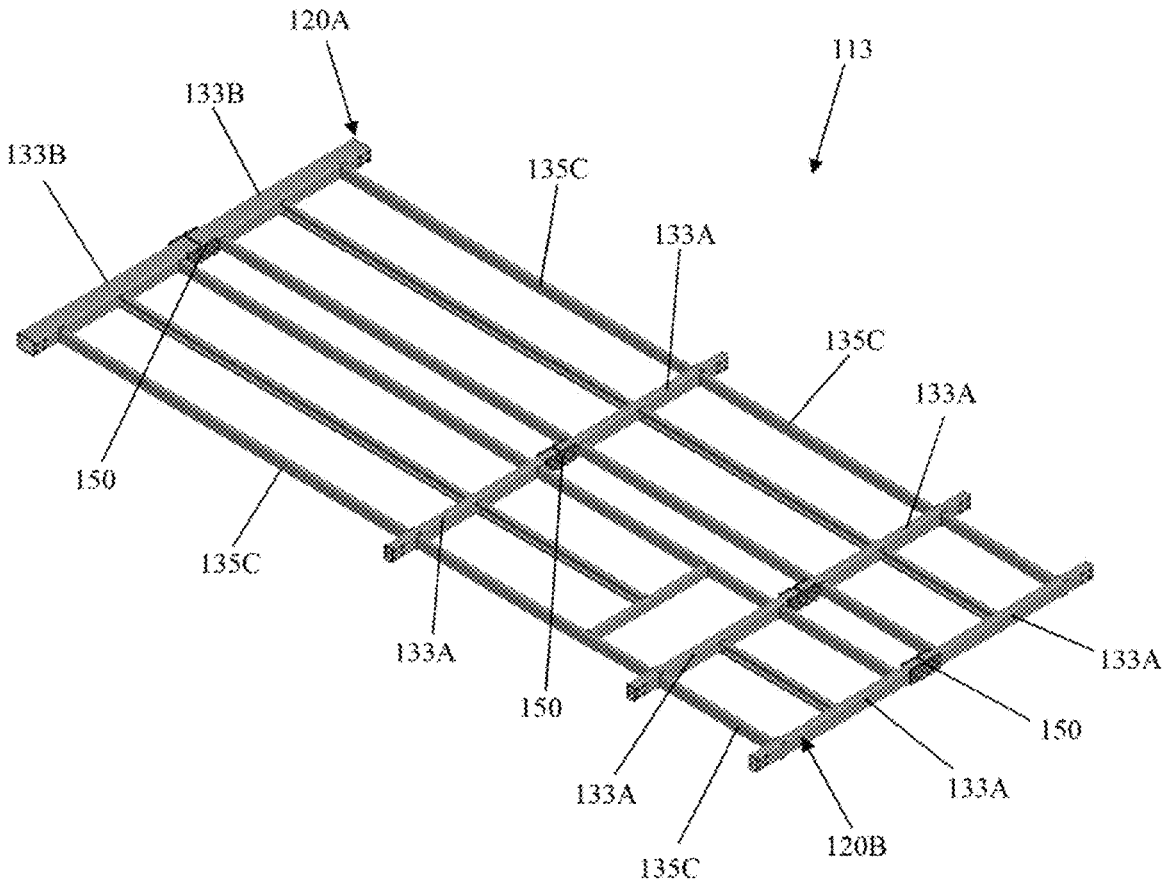
FIG. 30 is a perspective of a ceiling assembly in FIG. 29.
Figure 31:
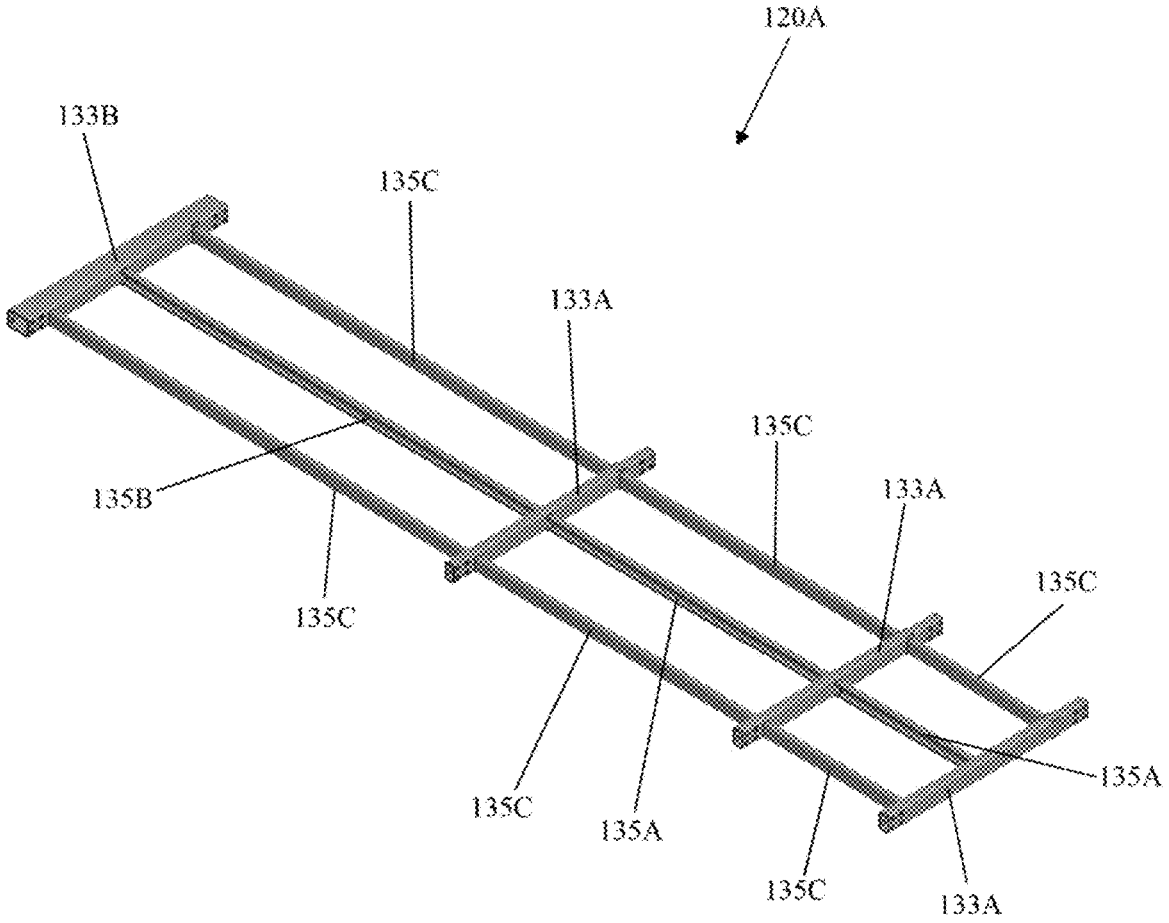
FIG. 31 is a perspective of a first ceiling unit of the ceiling assembly in FIG. 30.
Figure 32:
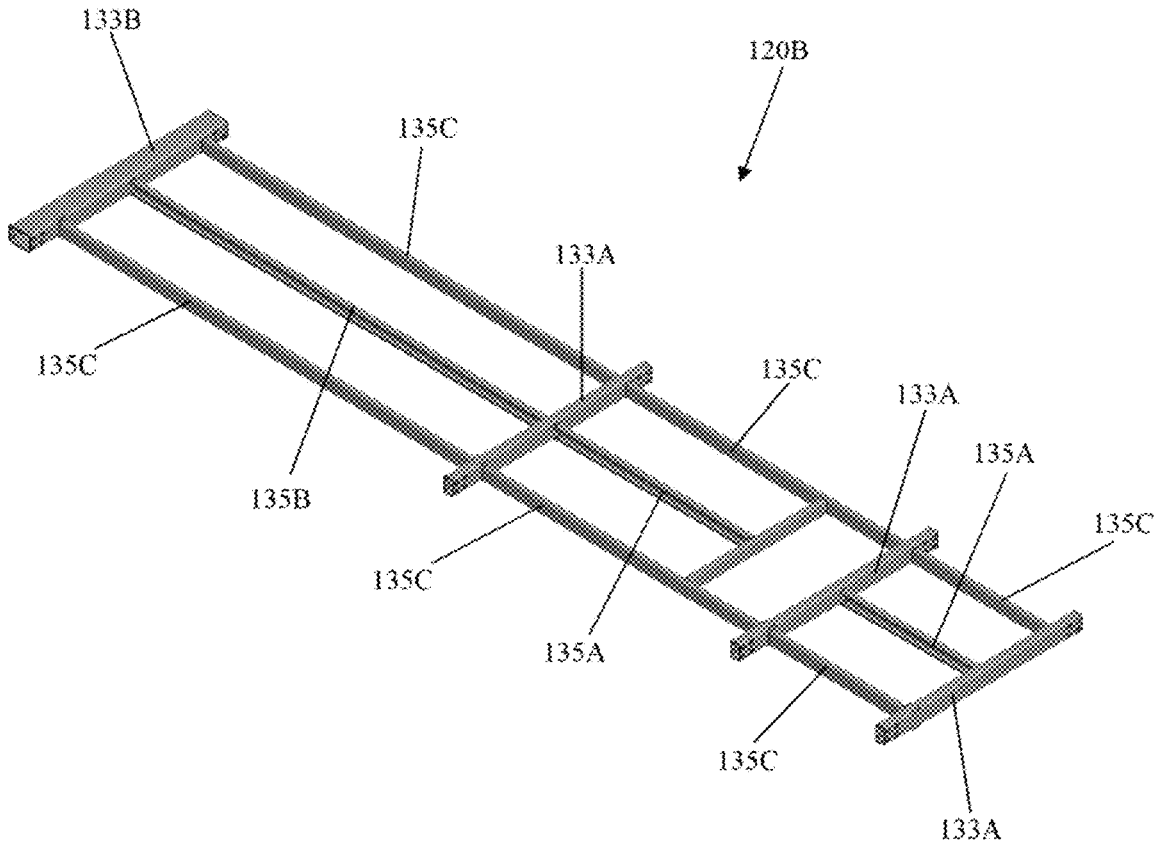
FIG. 32 is a perspective of a second ceiling unit of the ceiling assembly in FIG. 30.
Figure 33:
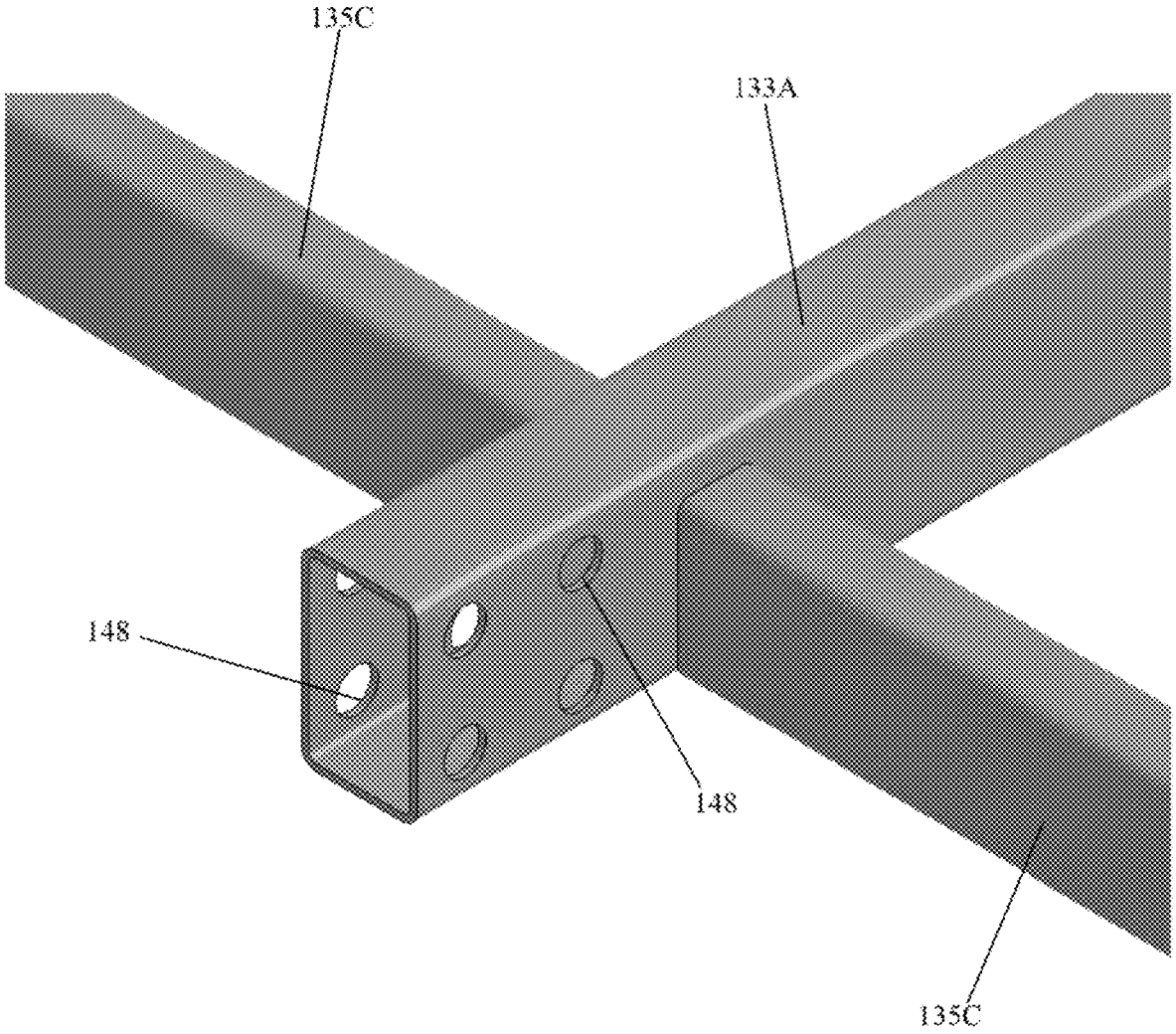
FIG. 33 is an enlarged fragmentary perspective of the second ceiling unit.
Figure 34:
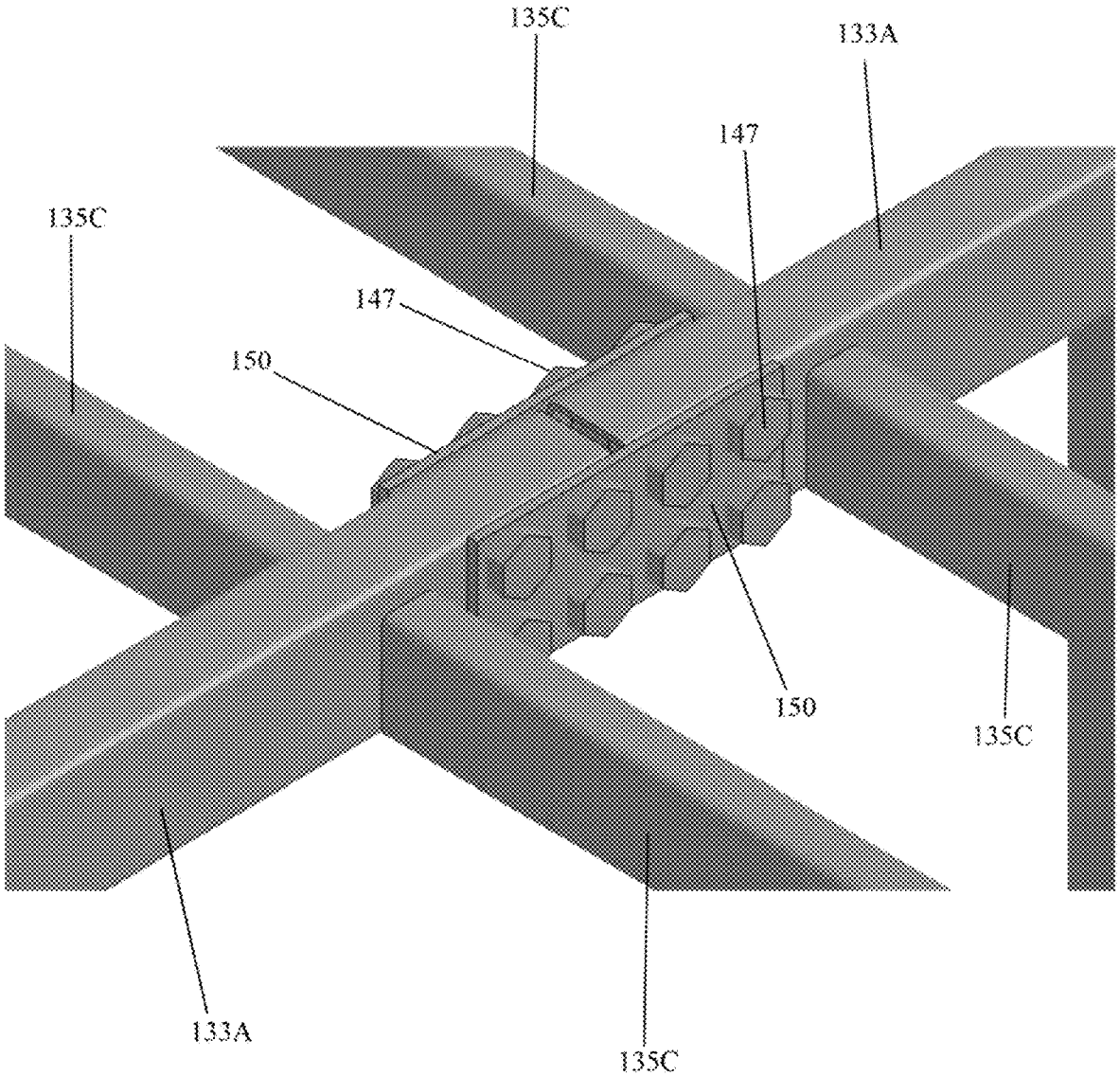
FIG. 34 is an enlarged fragmentary perspective of the frame of FIG. 29 showing connected ceiling units.
Figure 35:
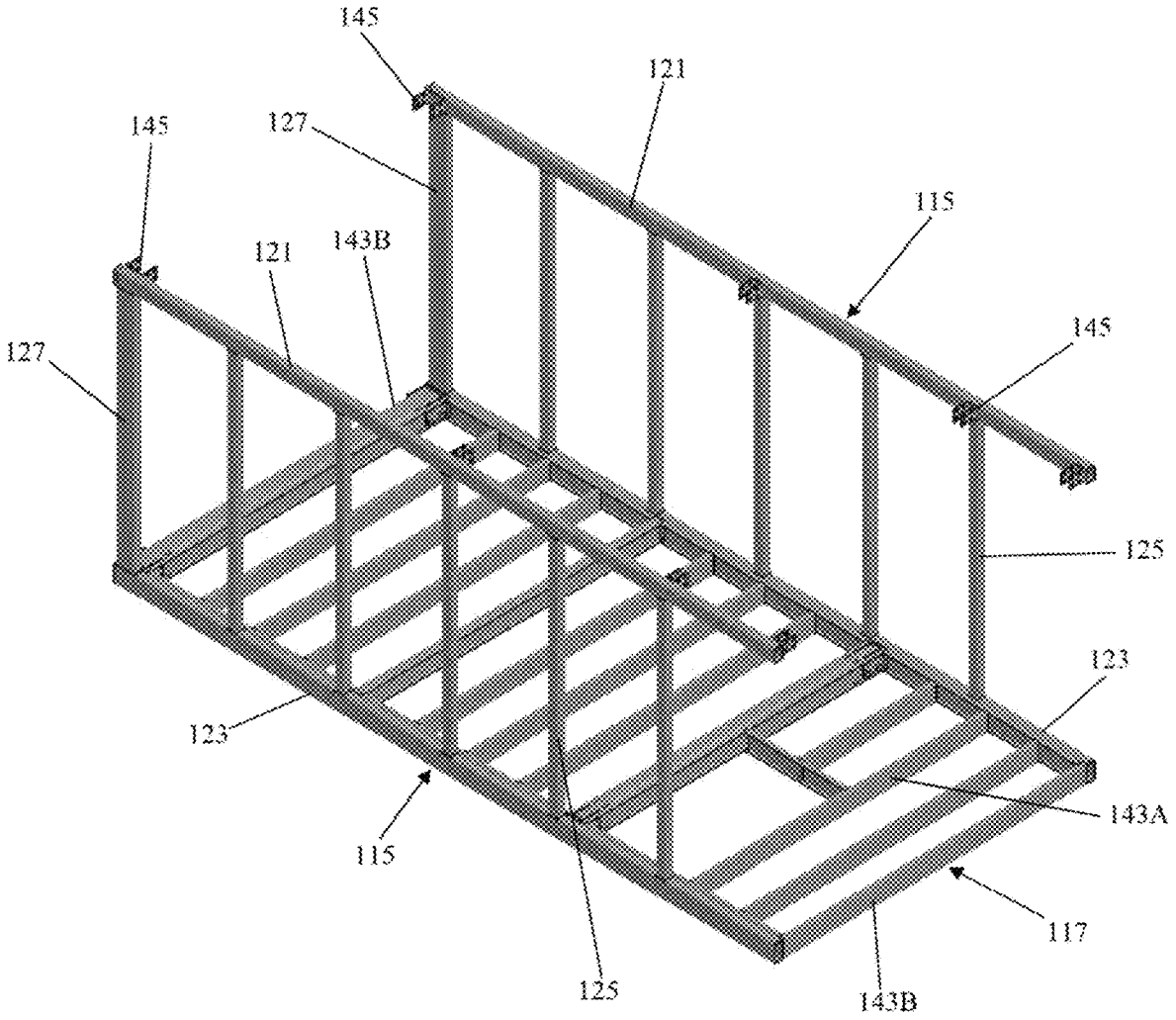
FIG. 35 is a perspective of the floor and wall assemblies in FIG. 29 with the ceiling assembly removed.
Figure 36:
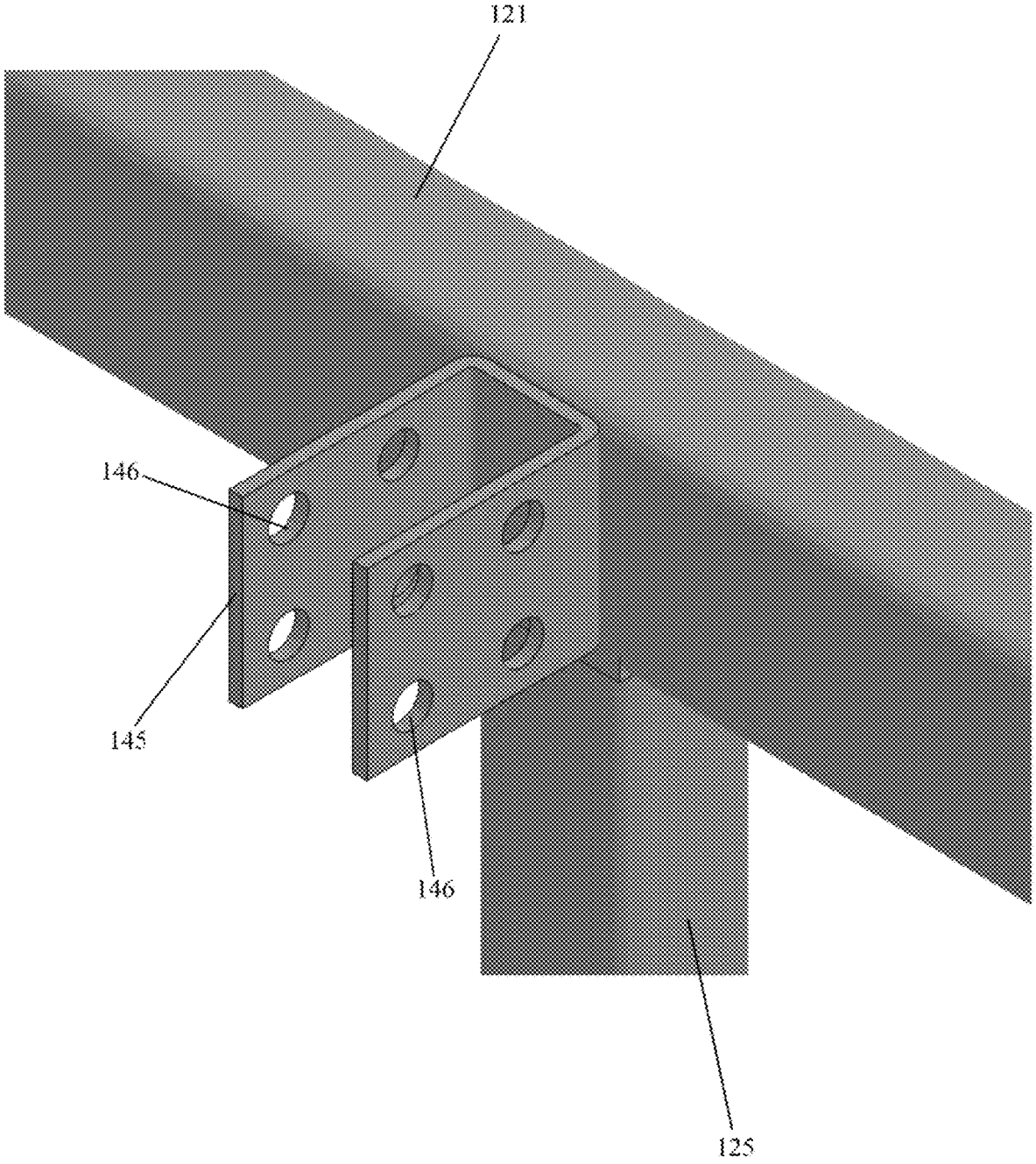
FIG. 36 is an enlarged fragmentary perspective of the frame of FIG. 35 showing a bracket.
Figure 37:
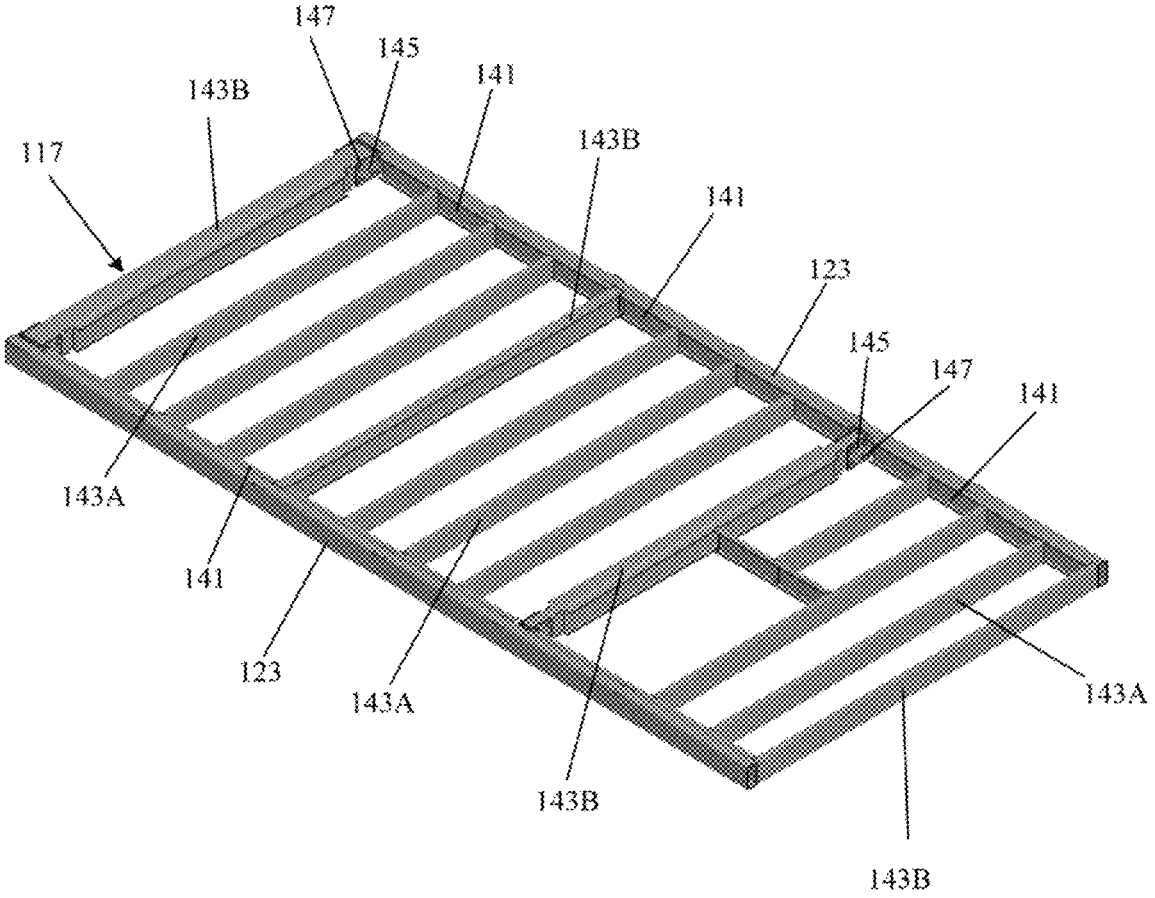
FIG. 37 is a perspective of a floor assembly in FIG. 29 also showing bottom members of wall assemblies of the frame.
Figure 38:
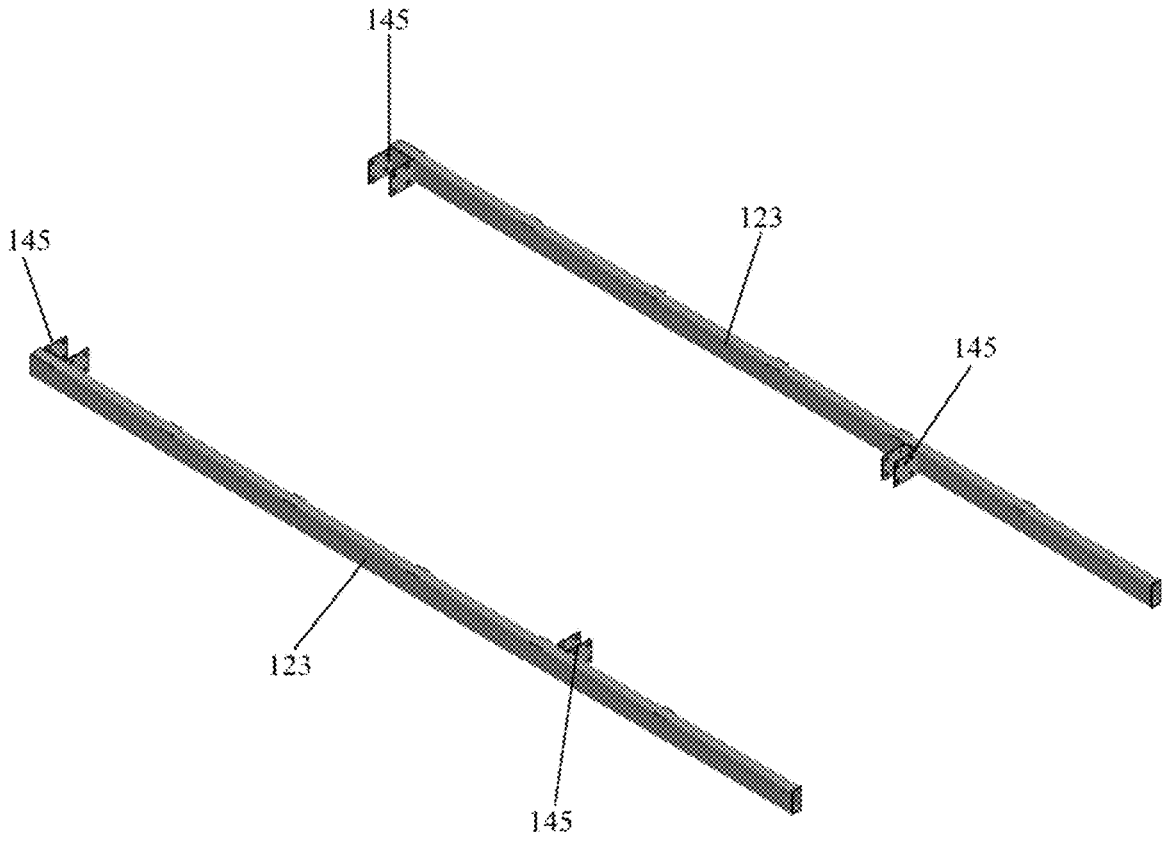
FIG. 38 is a perspective of the bottom members of the wall assemblies of the frame in FIG. 29 showing connector brackets/plates attached thereto.
Figure 39:
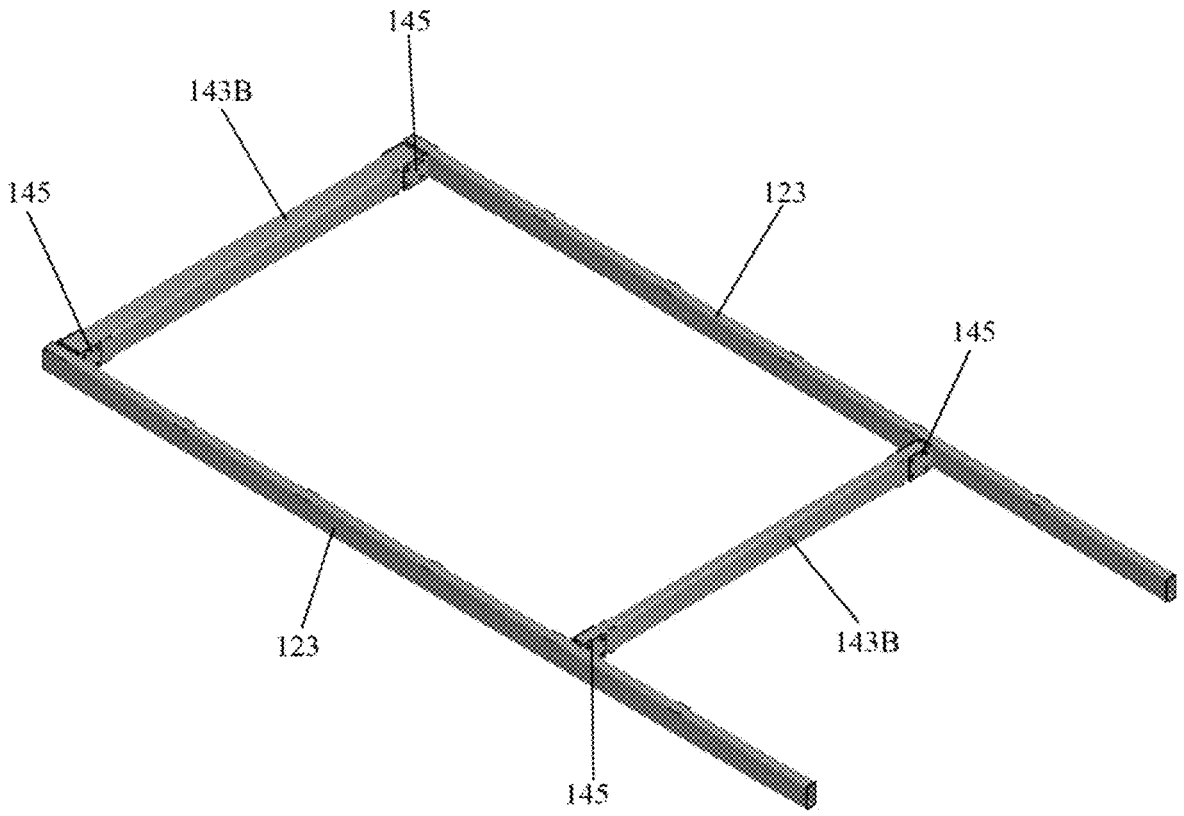
FIG. 39 is a perspective of the bottom members in FIG. 38 showing second floor members of the floor assembly attached thereto.
Figure 40:
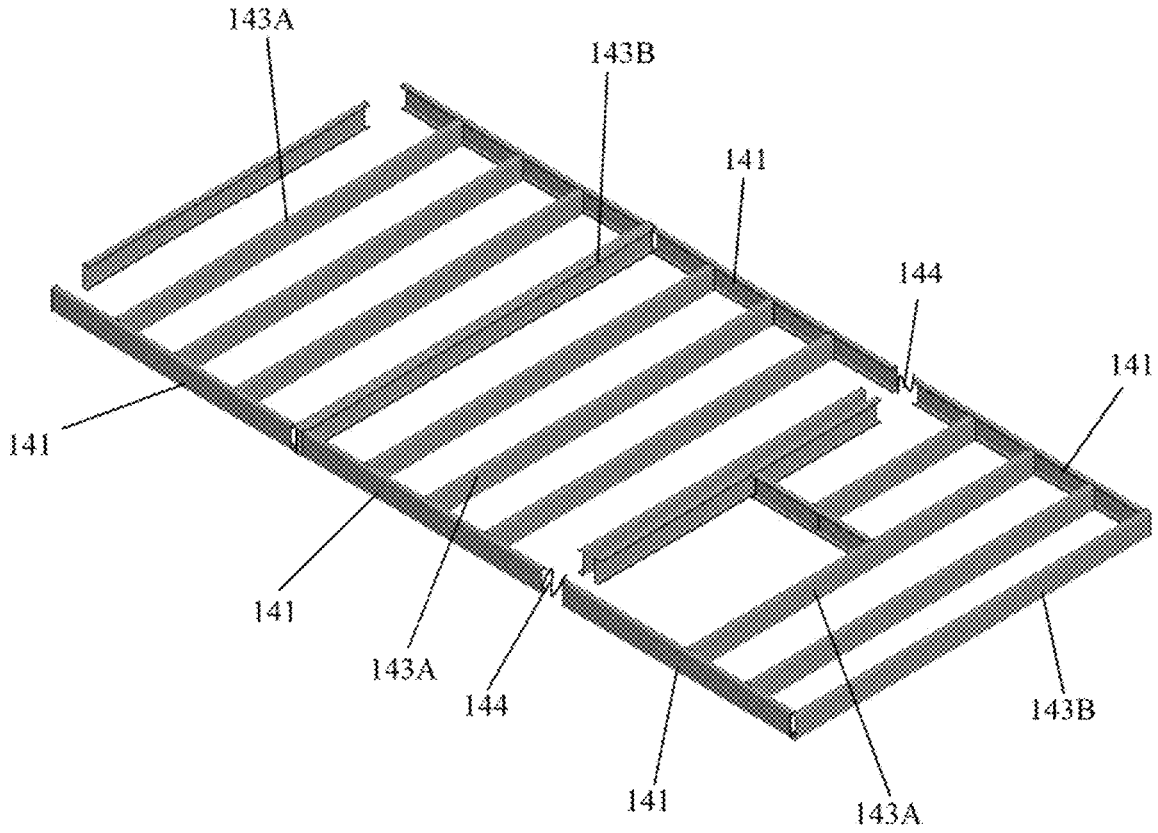
FIG. 40 is a perspective of the floor assembly in FIG. 37 with the second floor members removed.

Referring to FIGS. 30-34, a first ceiling unit 120A defines a right ceiling unit as shown in the orientation of the frame 111 in FIGS. 29 and 30. A second ceiling unit 120B is attached to the first ceiling unit 120A and defines a left ceiling unit as shown in FIGS. 29 and 30. The first and second beams 133A, 133B of each ceiling unit 120A, 120B extend laterally past the outer-most rafters 135C to define free end margins of the beams on both ends of the rafters. Fastener holes 148 (FIG. 33) are formed in the free end margins to facilitate attachment of the ceiling units 120A, 120B to each other. In particular, left free end margins of the first and second beams 133A, 133B of the first ceiling 120A are configured to be attached to right free end margins of the beams of the second ceiling unit 120B. In the illustrated embodiment, connector plates 150 having fastener holes are used to attach the ceiling units 120A, 120B together to form the ceiling assembly 113. The fastener holes in the connector plates 150 are alignable with the fastener holes 148 in the first and second beams 133A, 133B, and fasteners 147 are received in the aligned fastener holes to secure the beams to each other (FIG. 34). Each joint between the beams 133A, 133B of the ceiling units 120A, 120B includes a pair of connector plates 150 sandwiching the beams alongside surfaces of the beams. However, it will be understood that the connector plates 150 could sandwich the beams 133A, 133B along top and bottom surfaces of the beams 133A, 133B. Alternatively, a single connector plate 150 could be used to attach the beams 133A, 133B together. In the illustrated embodiment, the connector plates 150 comprise rectangular plate members. However, the connector plates 150 could have an alternative configuration without departing from the scope of the disclosure. Other ways of connecting the ceiling units 120A, 120B may be used within the scope of the present invention.

Figure 41:
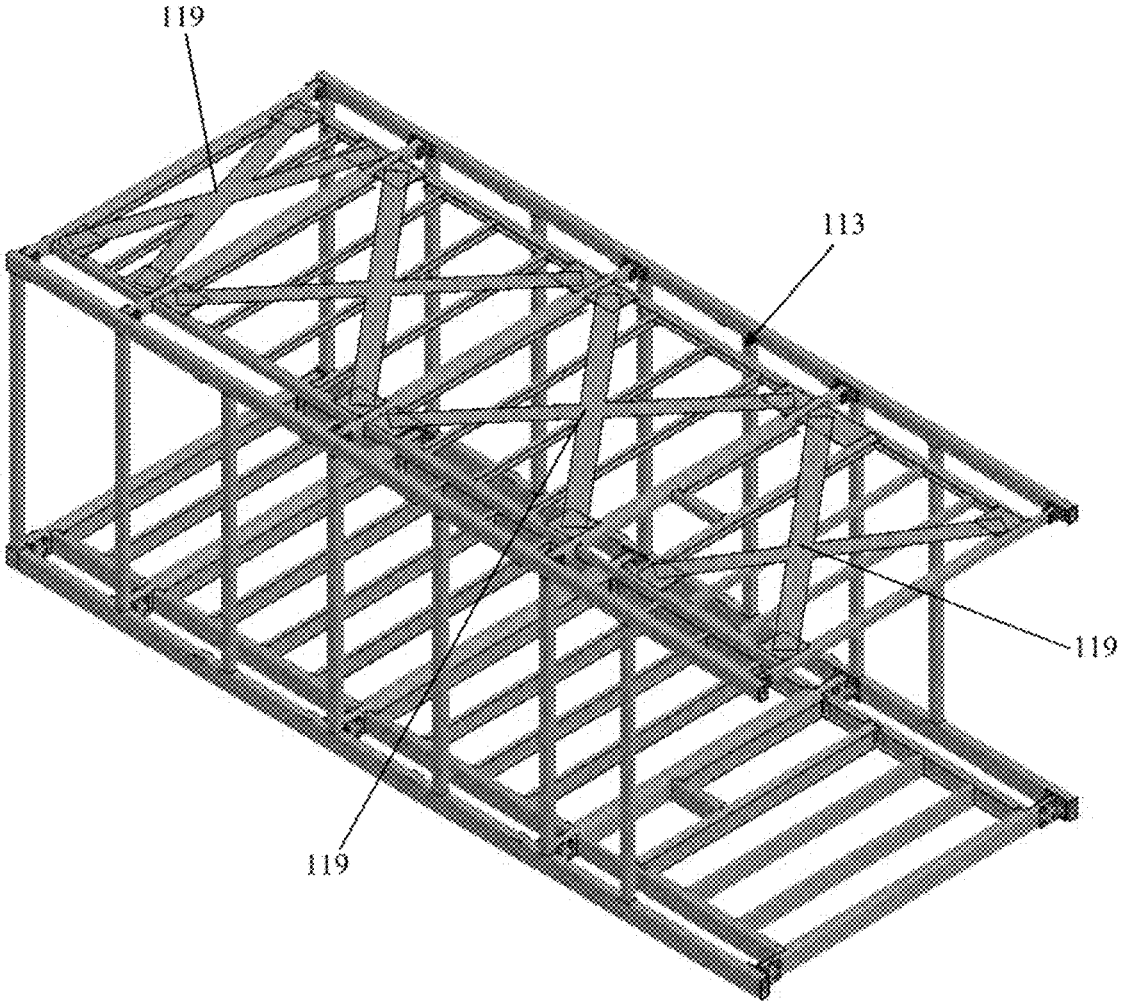
FIG. 41 is a perspective of a modular steel cage or "skeleton frame" of another embodiment as erected.

Referring to FIGS. 29, 30, 35, and 36, the free end margins on the right ends of the first and second beams 133A, 133B in the first ceiling unit 120A, and the free end margins on the left end of the beams in the second ceiling unit 120B are configured for attachment to the right and left wall assemblies 115, respectively. U-shaped brackets 145 (FIGS. 35 and 36) like the bracket 45" shown in FIGS. 26 and 27 are used to attach the wall assemblies to the ceiling units 120A, 120B. In particular, the brackets 145 defining fastener holes 146 (FIG. 36) are attached to interior surfaces of the top members 121 of the wall assemblies 115 for receiving the free end margins of the first and second beams 133A, 133B of the ceiling assembly 113. Fasteners (e.g., bolts) 147 (FIG. 29) are received in the fastener holes 146 of the brackets 145 to quickly attach the brackets to the first and second beams 133A, 133B on the ceiling assembly 113. Additionally, the ceiling assembly 113 may have bracing straps 119 for reinforcing the frame 111 (FIG. 41).

The two ceiling units 120A, 120B allow the ceiling assembly 113 to be transported in separate connectable pieces to the construction site. For example, the ceiling units 120A, 120B can be stacked on top of each other and placed on a bed in a trailer. As a result, the total width of the ceiling assembly 113 in the transportation state will be less than the width of the ceiling assembly in the fully erected state. Additionally, the width of the ceiling assembly 113 in the transportation state will be less than the width, in the transportation state, of the ceiling assembly 13 of the previous embodiment. Therefore, the ceiling assembly 113 will more easily fit within a predetermined width. In one embodiment, the predetermined width is the width of the trailer of the truck allowing for transportation of the frame 111 without modification of a standard semi-trailer and/or without special permitting in most jurisdictions in the United States. Generally, the width of the entire unassembled frame 111 on the semi-trailer will be less than eight feet.

Referring back to FIGS. 29 and 35, wall assemblies 115 comprise a top member or beam 121, a bottom member or beam 123, and a plurality of first vertical members or studs 125 extending between the top and bottom members. The top and bottom members 121, 123 extend parallel to each other, and the first vertical members 125 extend parallel to each other. The first studs 125 are spaced inward from longitudinal ends of the top and bottom members 121, 123 such that the first studs extend from a top surface of the bottom member to a bottom surface of the top member. A second vertical member or stud 127 is disposed on one of the longitudinal ends of the top and bottom members 121, 123 and extends generally from a top surface of the bottom member to a bottom surface of the top member. The second studs 127 extend parallel to the first studs 125.

Referring to FIGS. 35 and 37-40, the floor assembly 117 comprises spaced apart parallel bars 141 extending along a length of the floor assembly. The bars 141 extend along the left and right sides of the floor assembly 117 and are secured to inner surfaces of the bottom members 123 of the left and right wall assemblies 115. Thus, the bars 141, in part, define the longitudinal sides of the wall assembly 117. A plurality of parallel horizontal first floor members or joists 143A extend laterally between the bars 141 and connect to interior sides of the bars. Second floor members 143B are spaced apart along the length of the floor assembly 117 and extend laterally between the bottom members 123 of the wall assemblies 115. One of the second floor members 143B is disposed at a first longitudinal end of the floor assembly 117, a second and third of the second floor members are disposed at intermediate locations along the length of the floor assembly, and a fourth second floor member is disclosed a second longitudinal end of the floor assembly. The first and third of the second floor members 143B may be attached in a suitable manner such as by welding to the interior surfaces of at least one of the bottom members 123, and the second and fourth of the second floor members may be bolted to the bottom members 123 as will be explained in greater detail below. It will be understood, however, that the components of the floor assembly 117 may be secured together by any suitable means.

Referring to FIGS. 35, 37-39, U-shaped connection brackets 145 are arranged along the length of the bottom members 123 of the wall assemblies 115. In the illustrated embodiment, a first pair of brackets 145 are located in gaps 144 (FIG. 40) between the bars 141, and a second pair of brackets are disposed at the second longitudinal end of the bottom members 123. Therefore, the brackets 145 are spaced such that the first pair of bracket are configured to receive ends of the second of the second floor members 143B, and the second pair of brackets are configured to receive ends of the fourth of the second floor members 143B. Fasteners (e.g., bolts) 147 are received in the fastener holes of the brackets 145 to attach the brackets to the second floor members 143B and thereby attach the wall assemblies 115 to the floor assembly 117.

Referring to FIGS. 42-54, another embodiment of a module or frame is generally indicated at 211. The frame 211 is substantially similar to frame 111 of the previous embodiment. However, both the ceiling assembly 213 and floor assembly 217 are comprised of multiple ceiling and floor units, respectively. In particular, each ceiling unit 220A-D includes a pair of parallel cross members or beams 233 spaced apart along a length of the ceiling unit, and a plurality of ceiling members or rafters 235 located between the beams. In the illustrated embodiment, the ceiling assembly 213 includes four ceiling units 220A-D spaced along a length of the ceiling assembly. However, any number of ceiling units 220A-D could be used without departing from the scope of the disclosure. In the illustrated embodiment, the beams 233 define ends of the ceiling units 220 along the length of the ceiling assembly 213. First ceiling members 235A extend between the beams 233 along the length of the ceiling assembly 213, and second ceiling members 235B extend between the first ceiling members and along a width of the ceiling assembly. In the current embodiment, the ceiling units 220 have lengths extending length-wise with respect to the length of the ceiling assembly 213, and widths extending width-wise of the ceiling assembly. In one embodiment, each ceiling unit 220 may have a length of between about 5 ft and about 60 ft feet, and a width of between about 1 ft and about 15 ft. It will be understood that the length and width of the ceiling units 220A-D could be otherwise defined.

Figure 43:
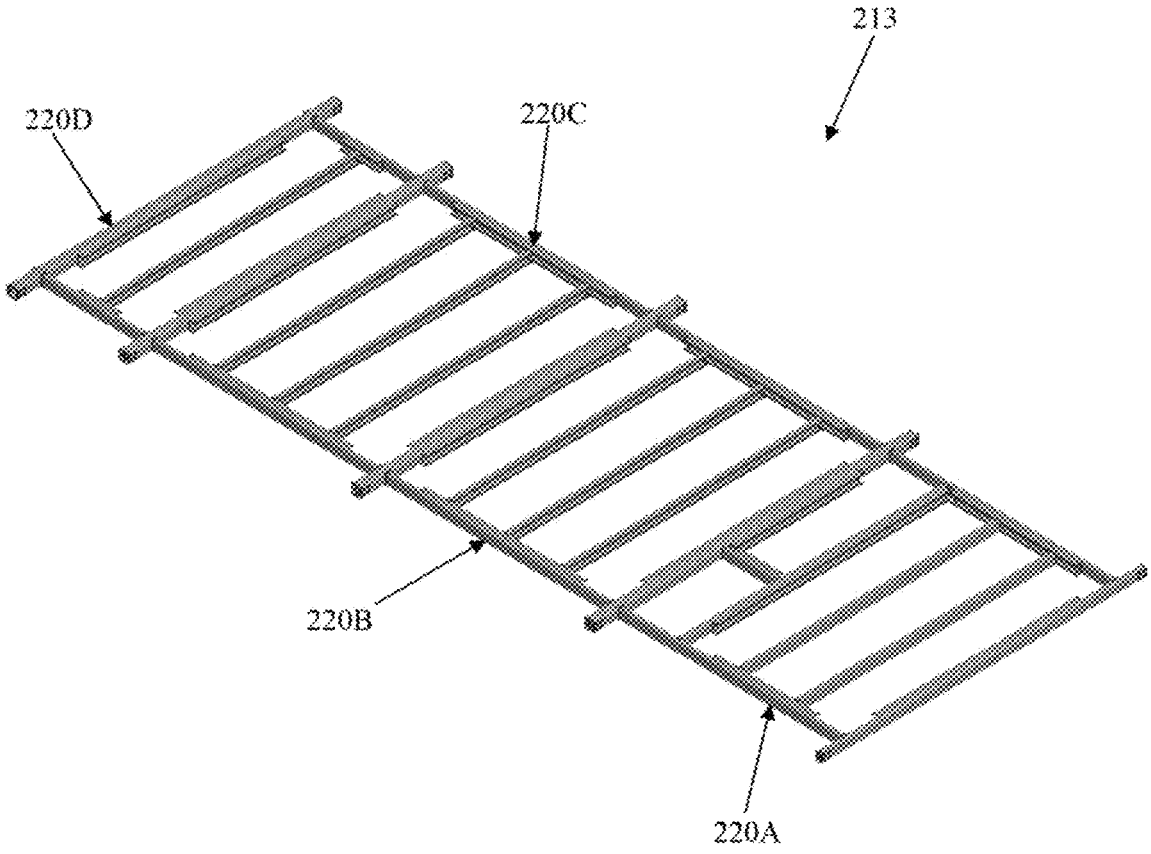
FIG. 43 is a perspective of a ceiling assembly in FIG. 42.
Figure 44:
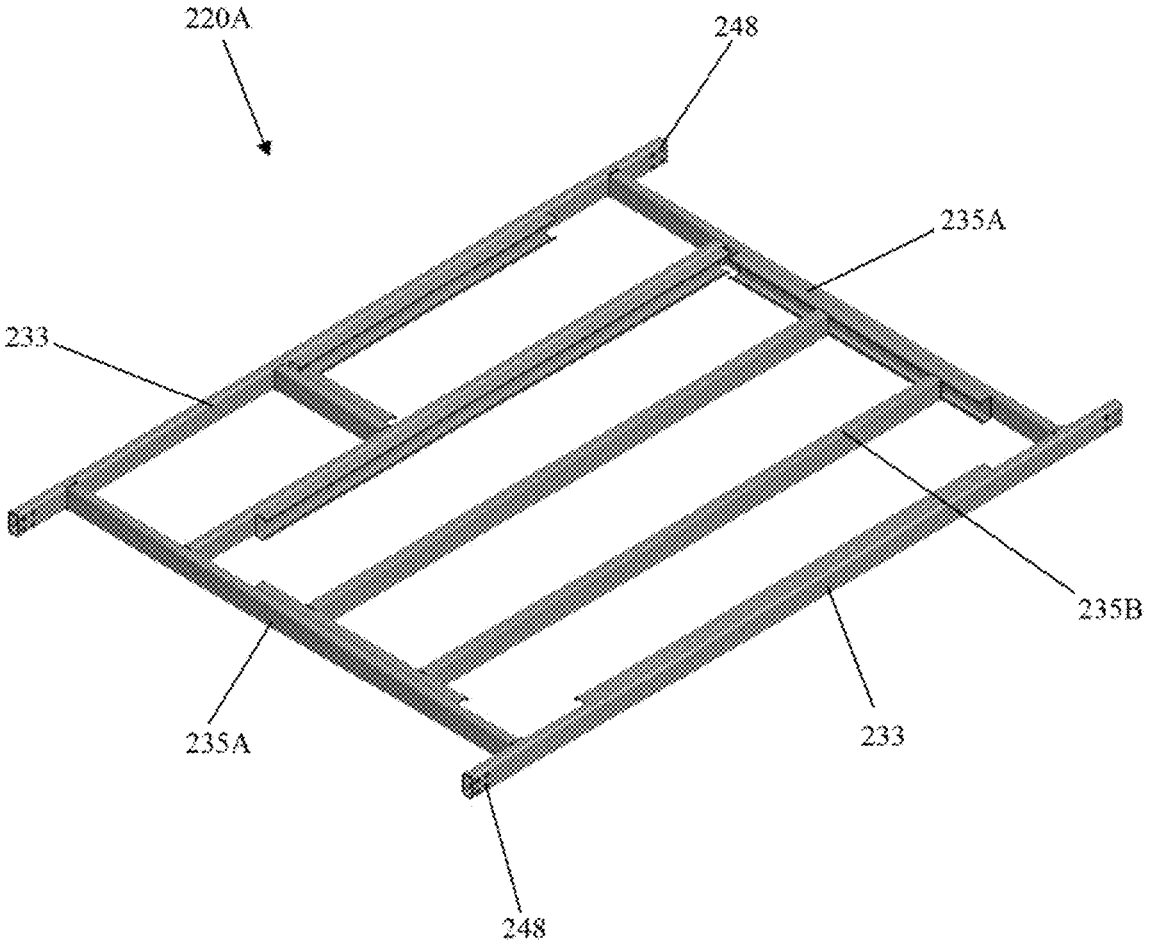
FIG. 44 is a perspective of a first ceiling unit of the ceiling assembly in FIG. 43.
Figure 45:
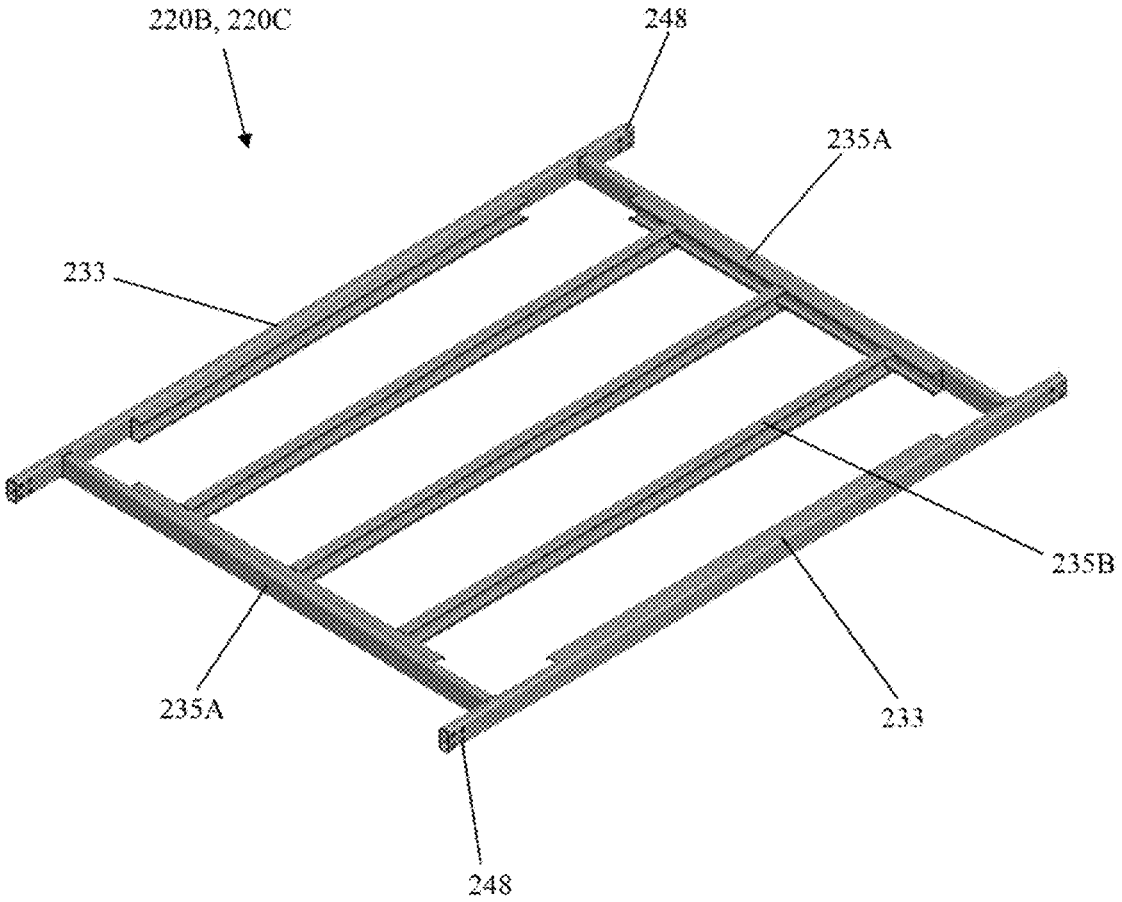
FIG. 45 is a perspective of a second and third ceiling unit of the ceiling assembly in FIG. 43.
Figure 46:
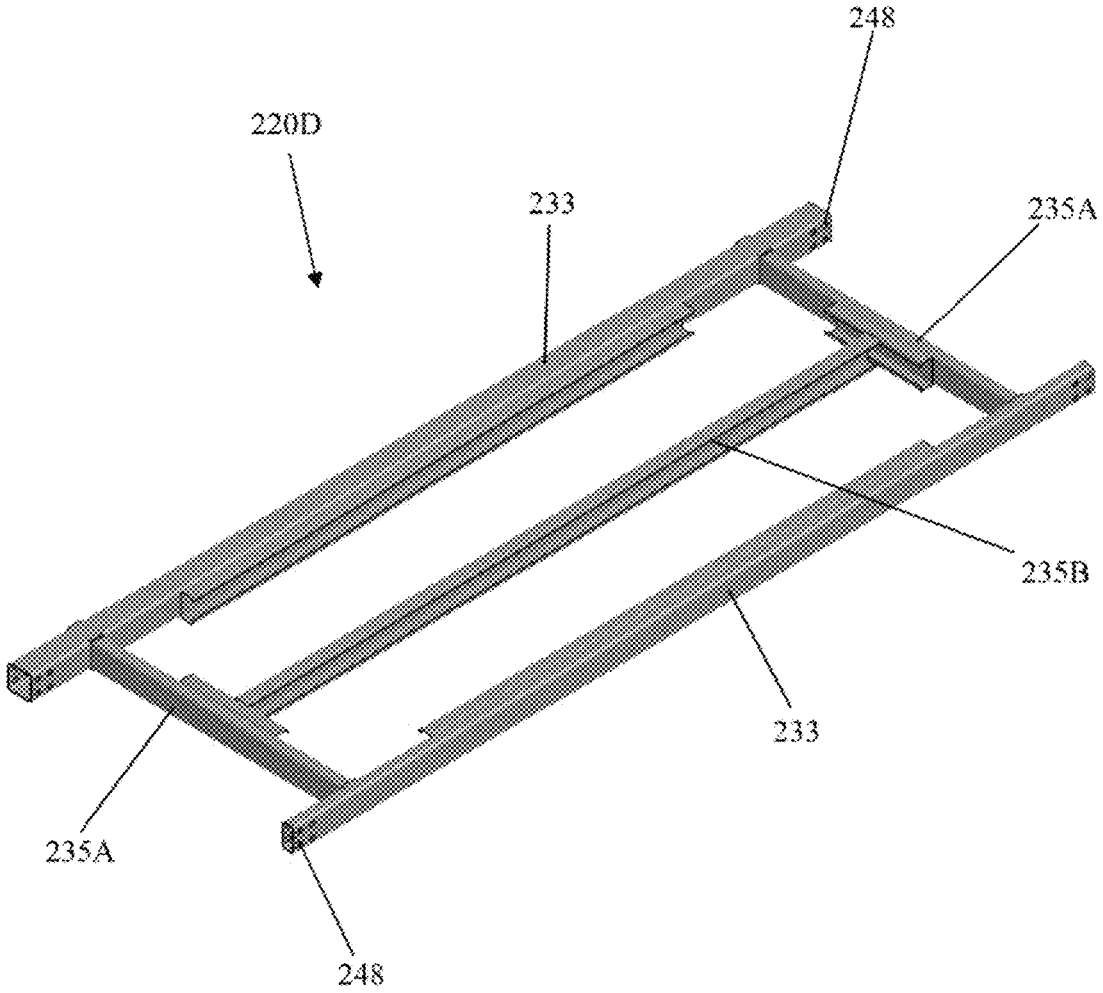
FIG. 46 is a perspective of a fourth ceiling unit of the ceiling assembly in FIG. 43.

Referring to FIGS. 43-46, a first ceiling unit 220A defines a first end ceiling unit as shown in the orientation of the frame 211 in FIG. 43. A second ceiling unit 220B defines a first intermediate ceiling unit, a third ceiling unit 220C defines a second intermediate ceiling unit, and a fourth ceiling unit 220D defines a second end ceiling unit. In the illustrated embodiment, the second and third ceiling units 220B, 220C have the same configuration. The beams 233 of each ceiling unit 220 extend past the outer-most rafters 235 to define free end margins of the beams on both ends of the beams. Fastener holes 248 are formed in the free end margins to facilitate attachment of the ceiling units 220A-D. In particular, the free end margins of the beams 233 in the ceiling units 220A-D are configured for attachment to the wall assemblies 215.

Figure 42:
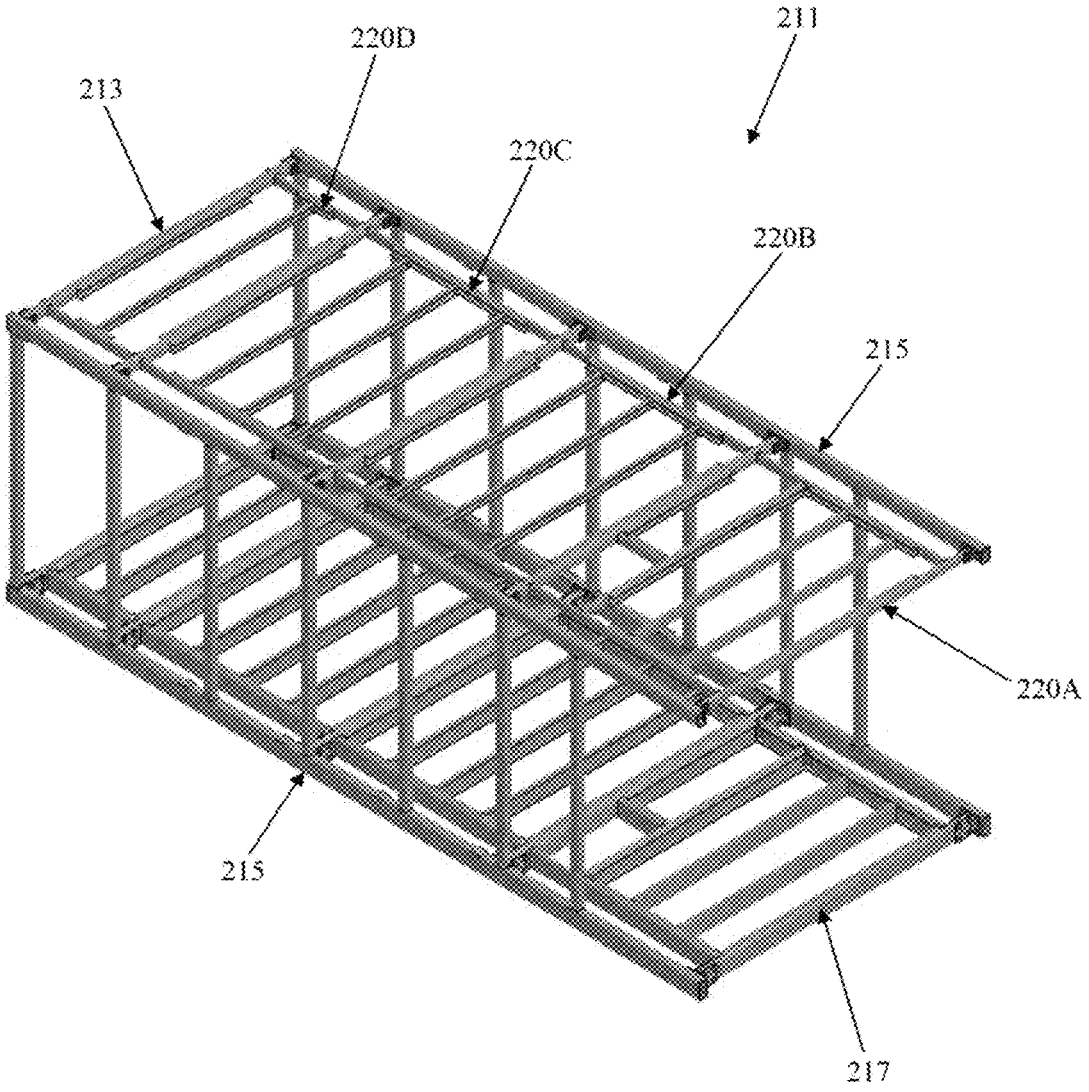
FIG. 42 is a perspective of a modular steel cage or "skeleton frame" of another embodiment as erected.
Figure 47:
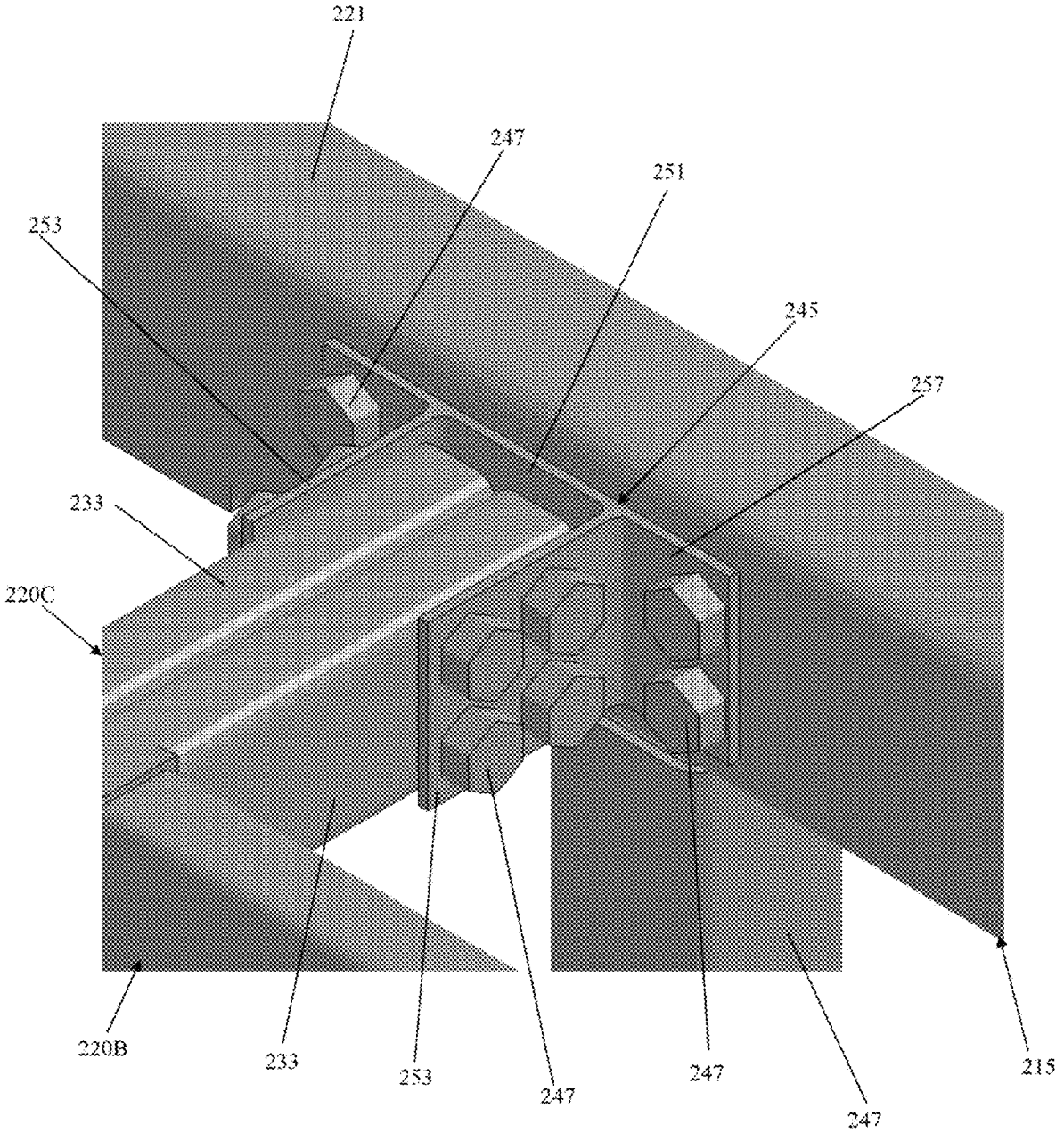
FIG. 47 is an enlarged fragmentary view of the frame of FIG. 42 showing connecting elements.
Figure 48:
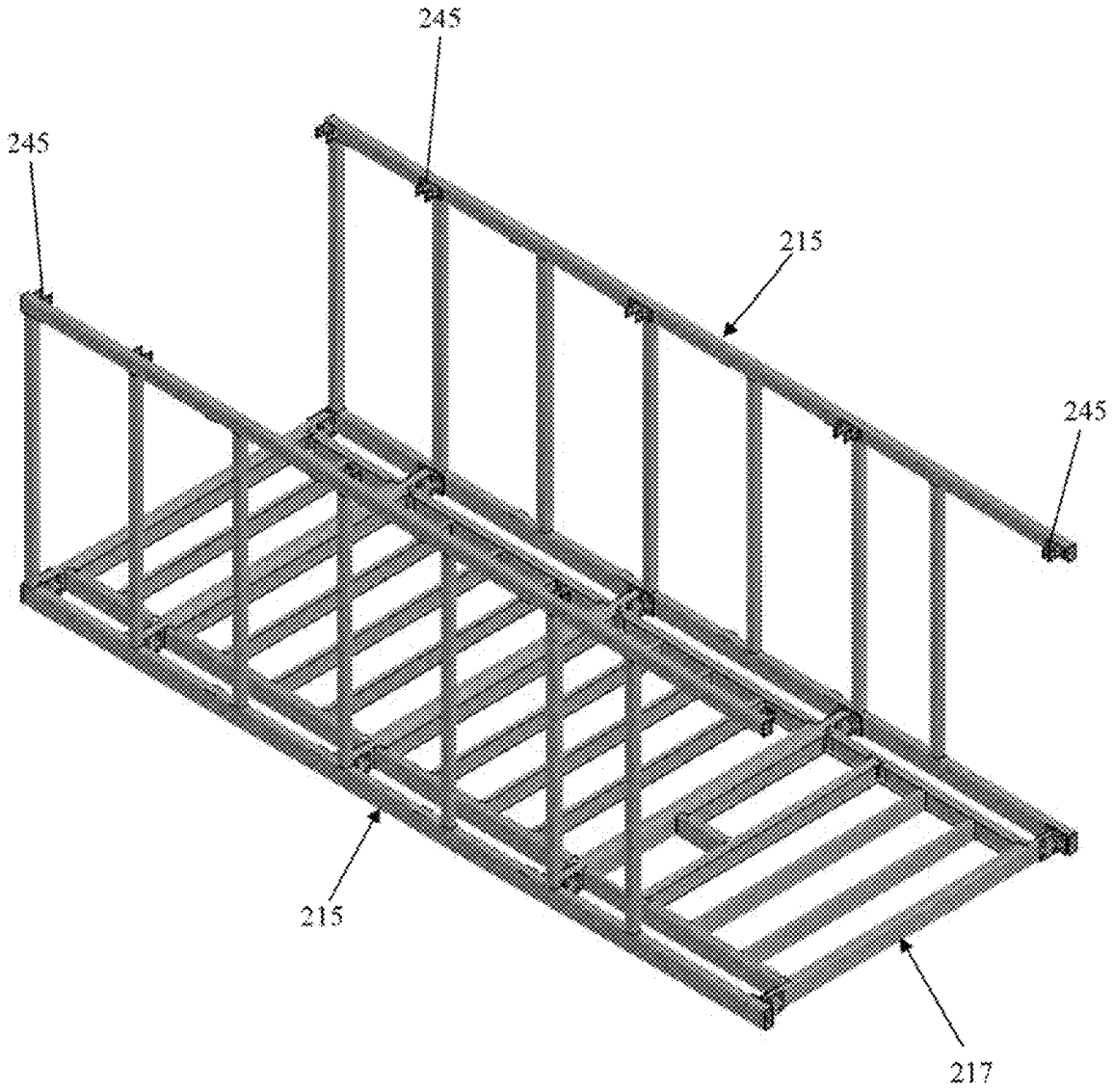
FIG. 48 is a perspective of the skeleton frame in FIG. 42 with the ceiling assembly removed.

As shown in FIGS. 47-50, U-shaped brackets 245 are used to attach the wall assemblies to the ceiling units 220A-D. In particular, the brackets 245 defining fastener holes 246 are attached to the top members 221 of the wall assemblies 215 for receiving the free end margins of the beams 233 of the ceiling assembly 213. Fasteners (e.g., bolts) 247 are received in the fastener holes of the brackets 245 to attach the brackets to the beams 233 on the ceiling assembly 113. In the illustrated embodiment, single brackets 245 receive the free end margins of the outer-most beams 233 on the first and fourth ceiling units 220A, 220D to secure the ceiling units to the wall assemblies 215 (FIG. 42). These beams 233 define the longitudinal ends of the ceiling assembly 213. Referring to FIGS. 42 and 47, single brackets 245 also receive free end margins of the beams 233 on adjacent ceiling units 220A-D along the interior of the ceiling assembly. Therefore, these brackets 245 secure adjacent ceiling units 220A-D together, and secure the ceiling units to the wall assemblies 215. Thus, the brackets 245 are sized and shaped to accommodate the component(s) received in the bracket.

Figure 49:
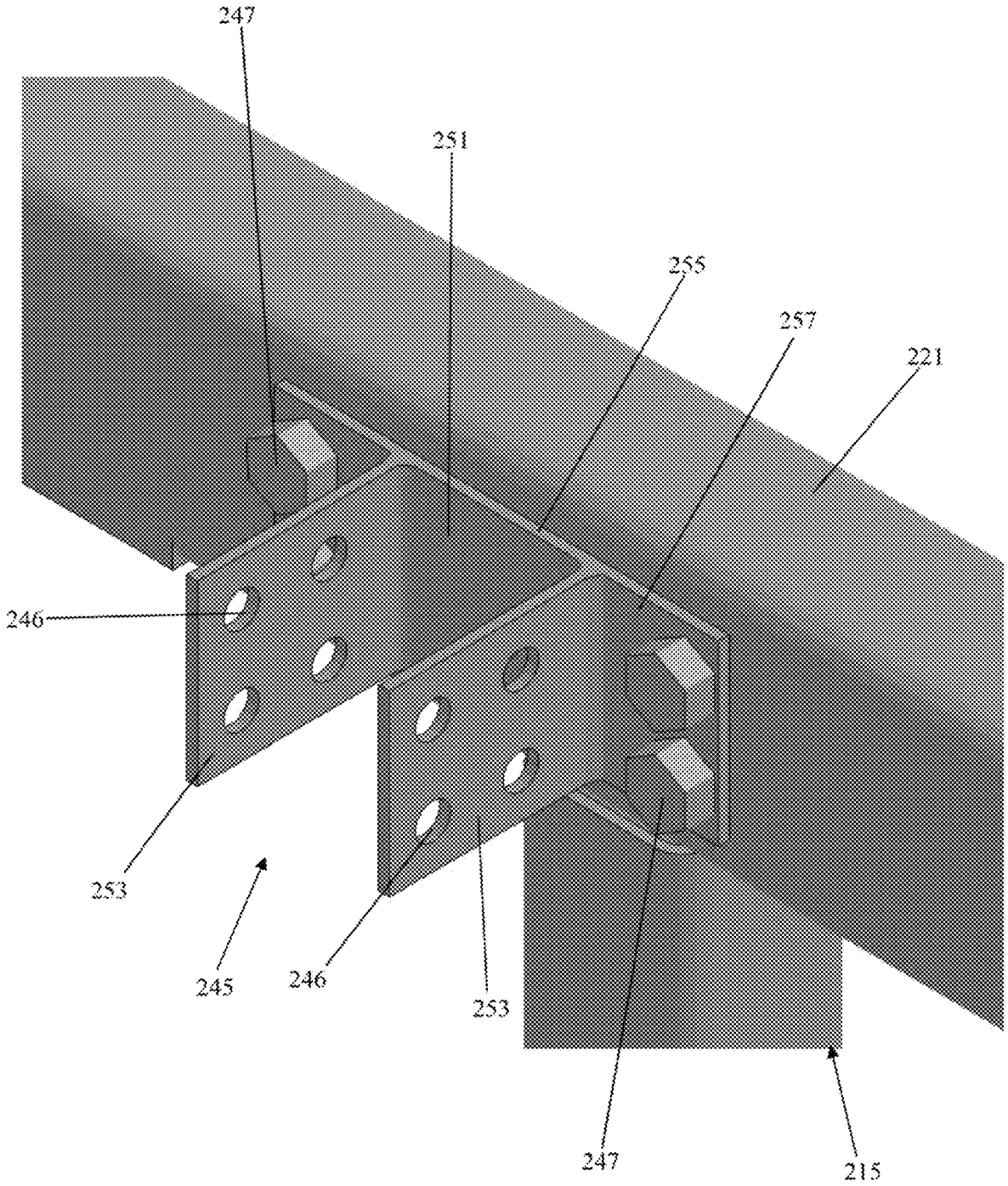
FIG. 49 is an enlarged fragmentary perspective of the frame of FIG. 48 showing a bracket.
Figure 50:
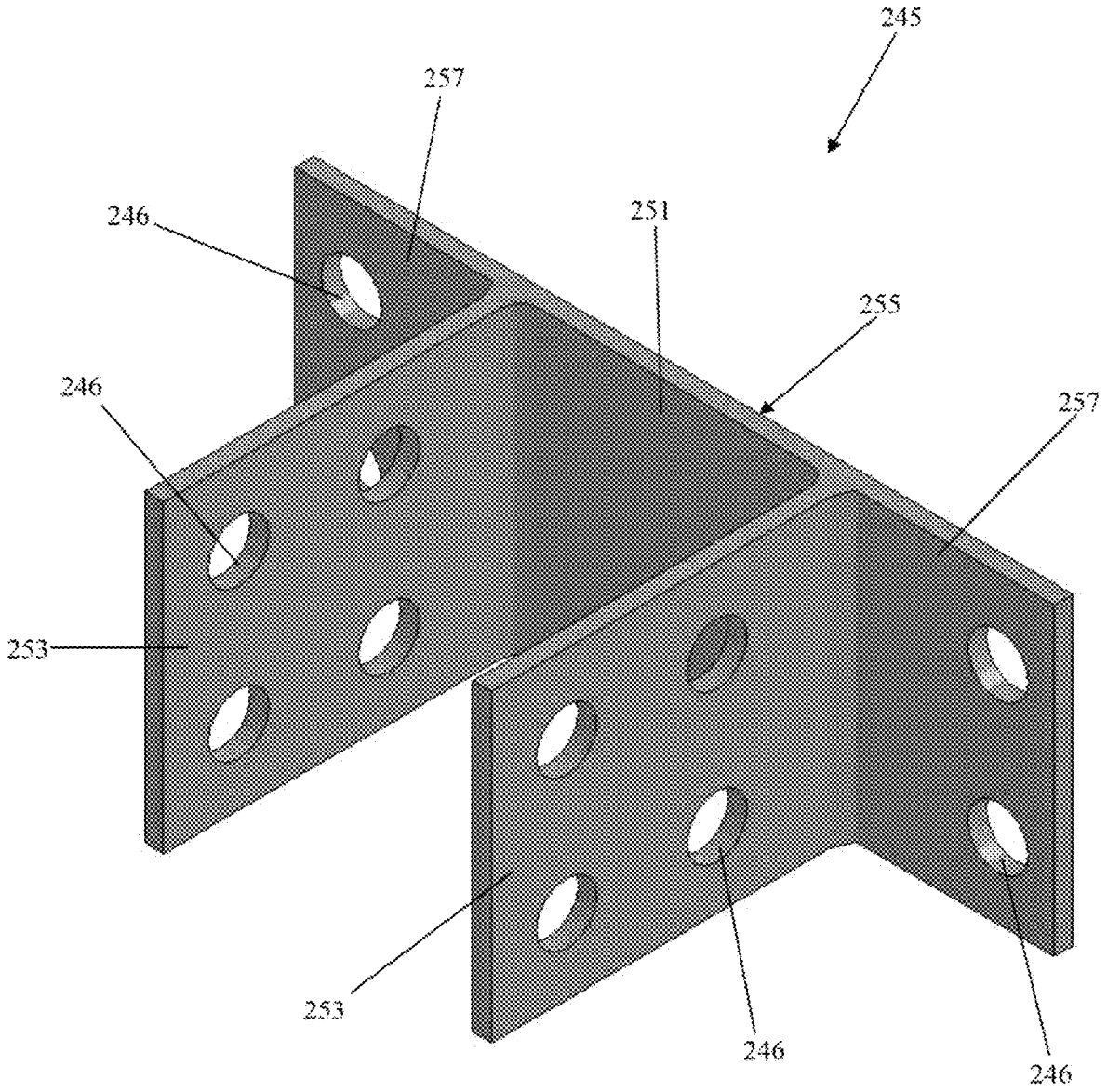
FIG. 50 is a perspective of a bracket in FIG. 42.
Figure 51:
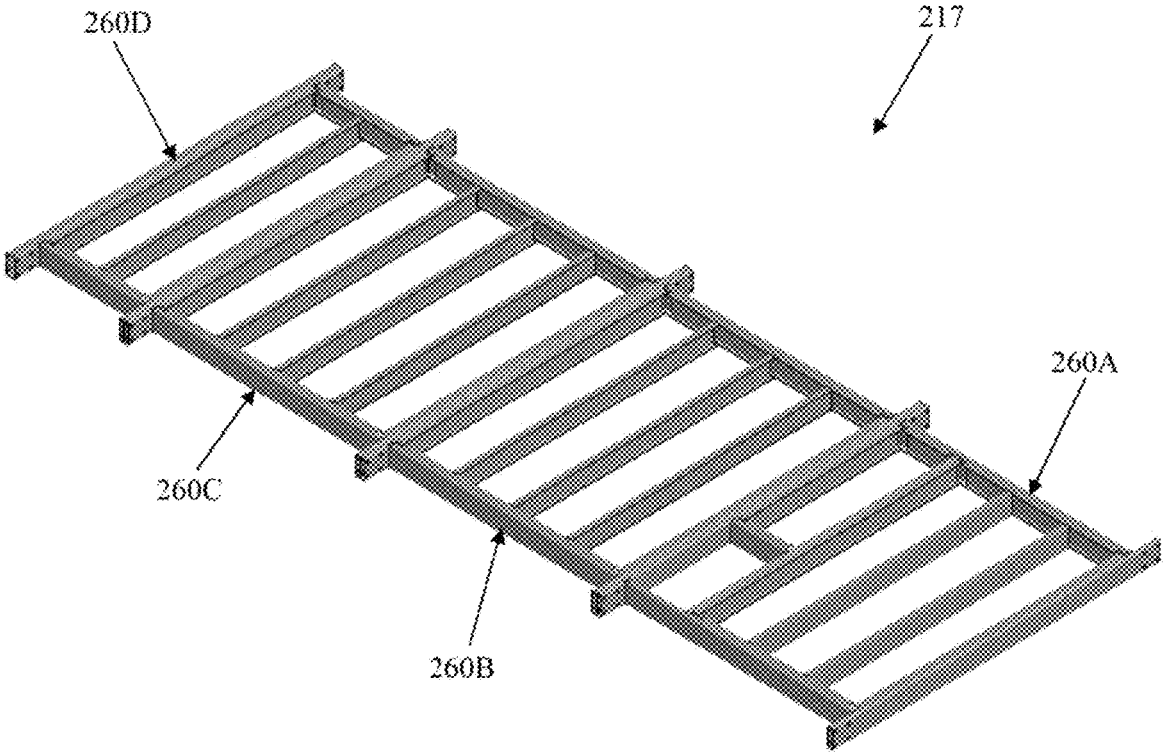
FIG. 51 is a perspective of a floor assembly of the skeleton frame in FIG. 42.
Figure 52:
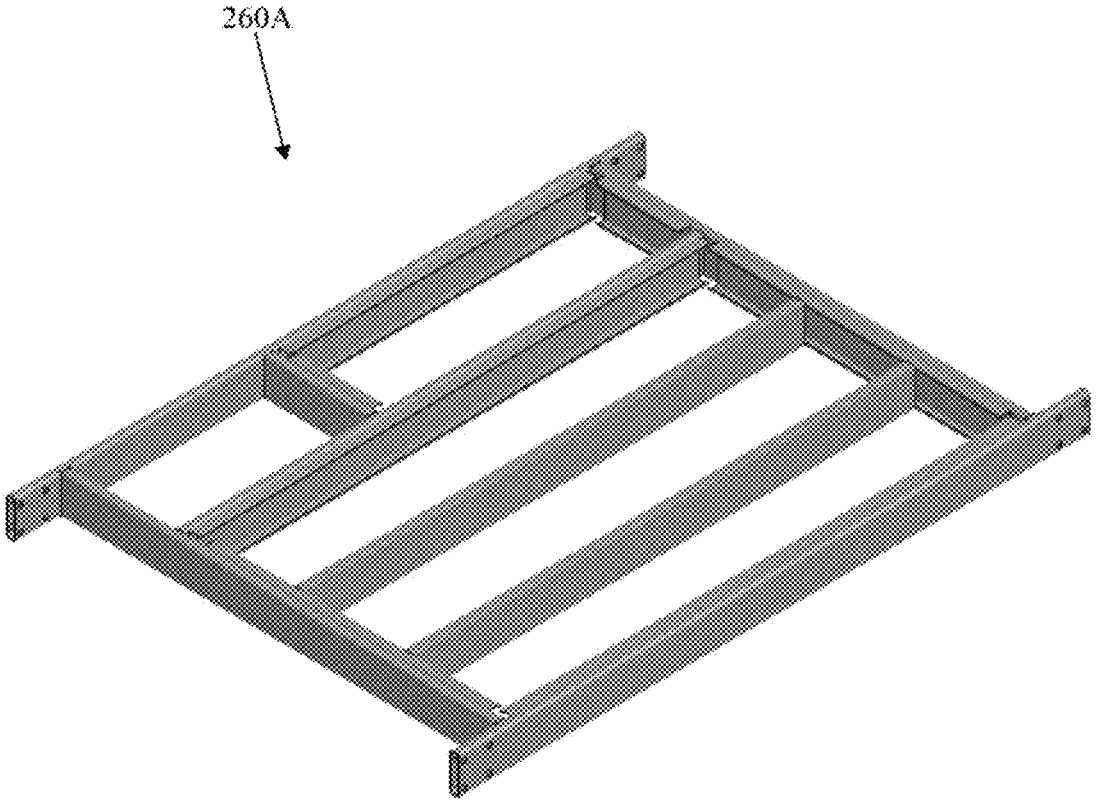
FIG. 52 is a perspective of a first floor unit of the floor assembly in FIG. 51.
Figure 53:
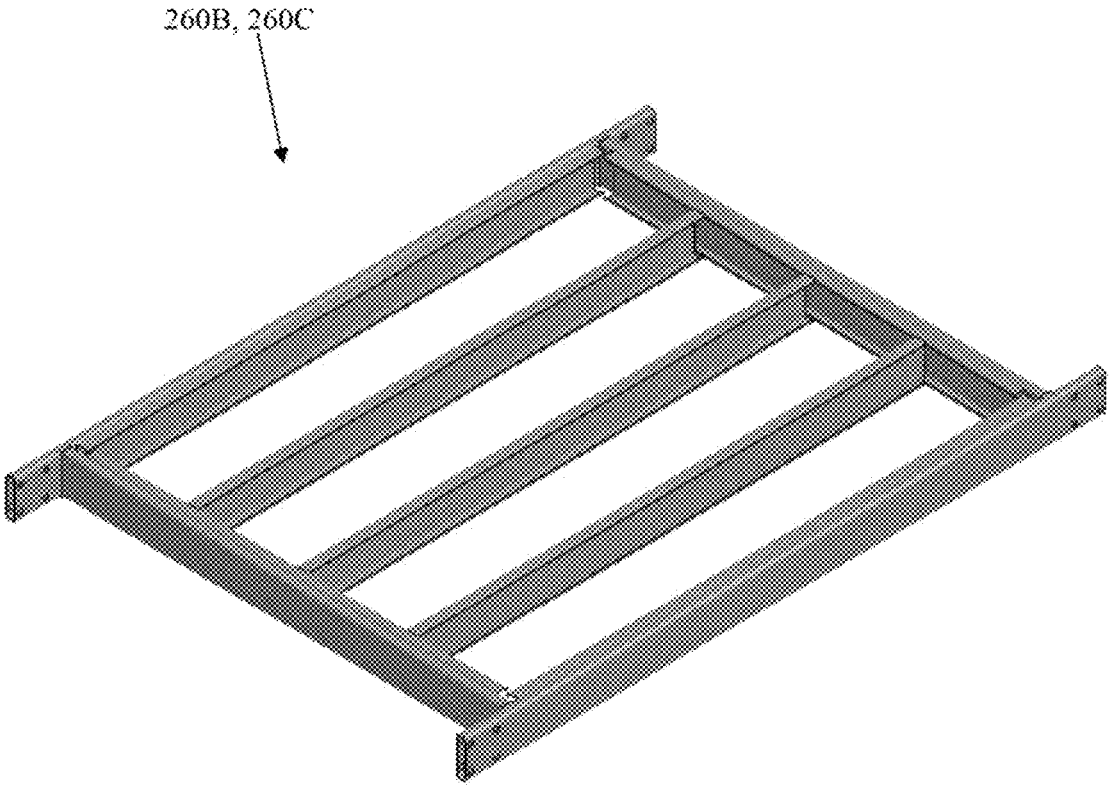
FIG. 53 is a perspective of a second and third floor unit of the floor assembly in FIG. 51.
Figure 54:
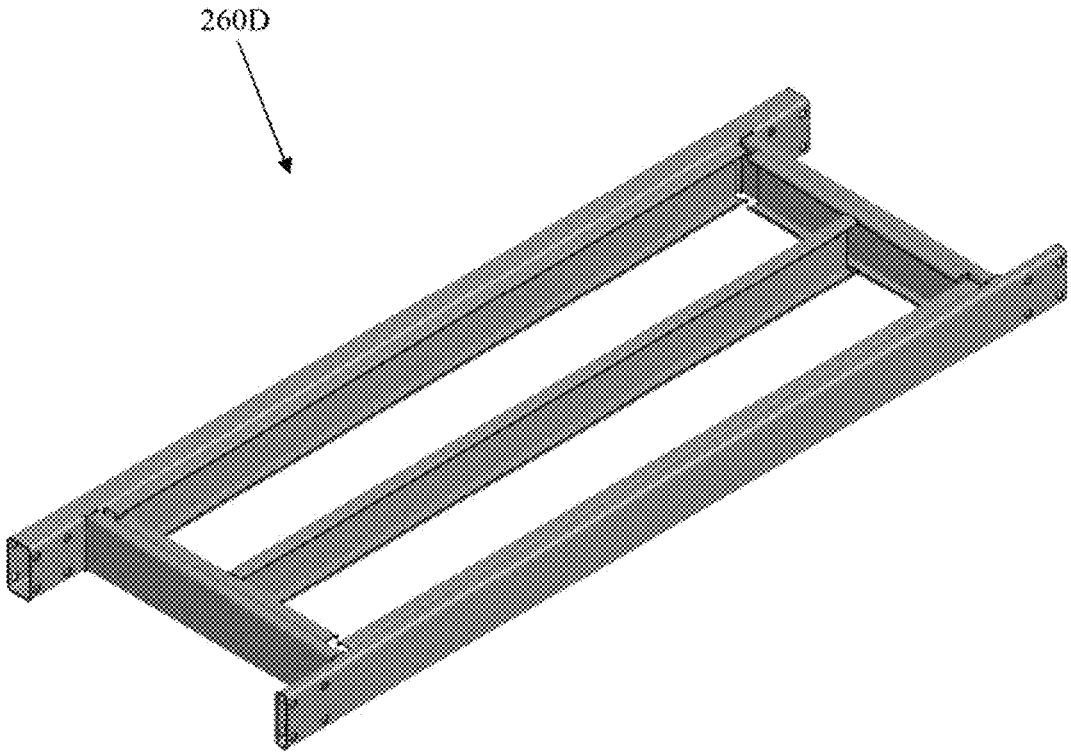
FIG. 54 is a perspective of a fourth floor unit of the floor assembly in FIG. 51.

Referring to FIGS. 49 and 50, the general construction of the brackets 245 is different to the construction of the brackets 45 and 145 of the previous embodiments. In particular, the brackets 245 comprise a U-shaped body 255 and flanges 257 extending from the U-shaped body. The U-shaped body 255 includes a base plate 251 and a pair of side plates 253 extending from opposite ends of the base plate in a direction perpendicular to the base plate. A first flange 257 extends from one end of the base plate 251 in a direction parallel to the base plate, and a second flange 257 extends from the opposite side of the base plate in a direction parallel to the base plate and opposite of the direction in which the first flange extends. Thus, a base plate 251 and flanges 257 define a continuous plate structure with the side plates 253 extending orthogonally from the continuous plate. The side plates 253 and flanges 257 define the fastener holes 246 so that the brackets 245 can be fastened (e.g., bolted) to the wall assemblies 215 via the flanges, and receive fasteners (e.g., bolts) to attach to the beams 233 of the ceiling assembly 213 via the side plates 253. Other ways of attaching the brackets 245 to the wall assemblies 215 and to the ceiling assembly 213 may be used.

Referring to FIGS. 51-54, the floor assembly 217 is configured similar to the ceiling assembly 213 and includes a plurality of floor units 260A-D secured together and connected to the wall assemblies 215 by brackets 245. The floor units 260A-D are secured together and to the wall assemblies in a similar manner to how the ceiling units 220A-220D are secured together. Therefore, a detailed explanation is not provided.

Referring to FIGS. 55-62, another embodiment of a module or frame is generally indicated at 311. The frame 311 is substantially similar to frame 211 of the previous embodiment. In particular, both the ceiling assembly 313 and floor assembly 317 are comprised of multiple ceiling and floor units, respectively. In particular, each ceiling unit 320A-C includes a pair of parallel cross members or beams 333 spaced apart along a length of the ceiling assembly 313, and a plurality of ceiling members or rafters 335 located between the beams. In the illustrated embodiment, the ceiling assembly 313 includes three ceiling units 320A-C spaced along a length of the ceiling assembly. However, another number of ceiling units 320A-C could be used without departing from the scope of the disclosure. In the illustrated embodiment, the beams 333 define longitudinal ends of the ceiling units 320A-C. First ceiling members 335A extend between the beams 333 along the length of the ceiling assembly 313, and second ceiling members 335B extend between the first ceiling members along a width of the ceiling assembly. In the current embodiment, the ceiling units 320A-C may have lengths extending length-wise of the ceiling assembly 313, and widths extending width-wise of the ceiling assembly. In one embodiment, each ceiling unit 320A-C may have a length of between about 5 ft and about 60 ft feet, and a width of between about 1 ft and about 15 ft. However, the length and width of the ceiling units 320A-C may be otherwise defined.

Figure 55:
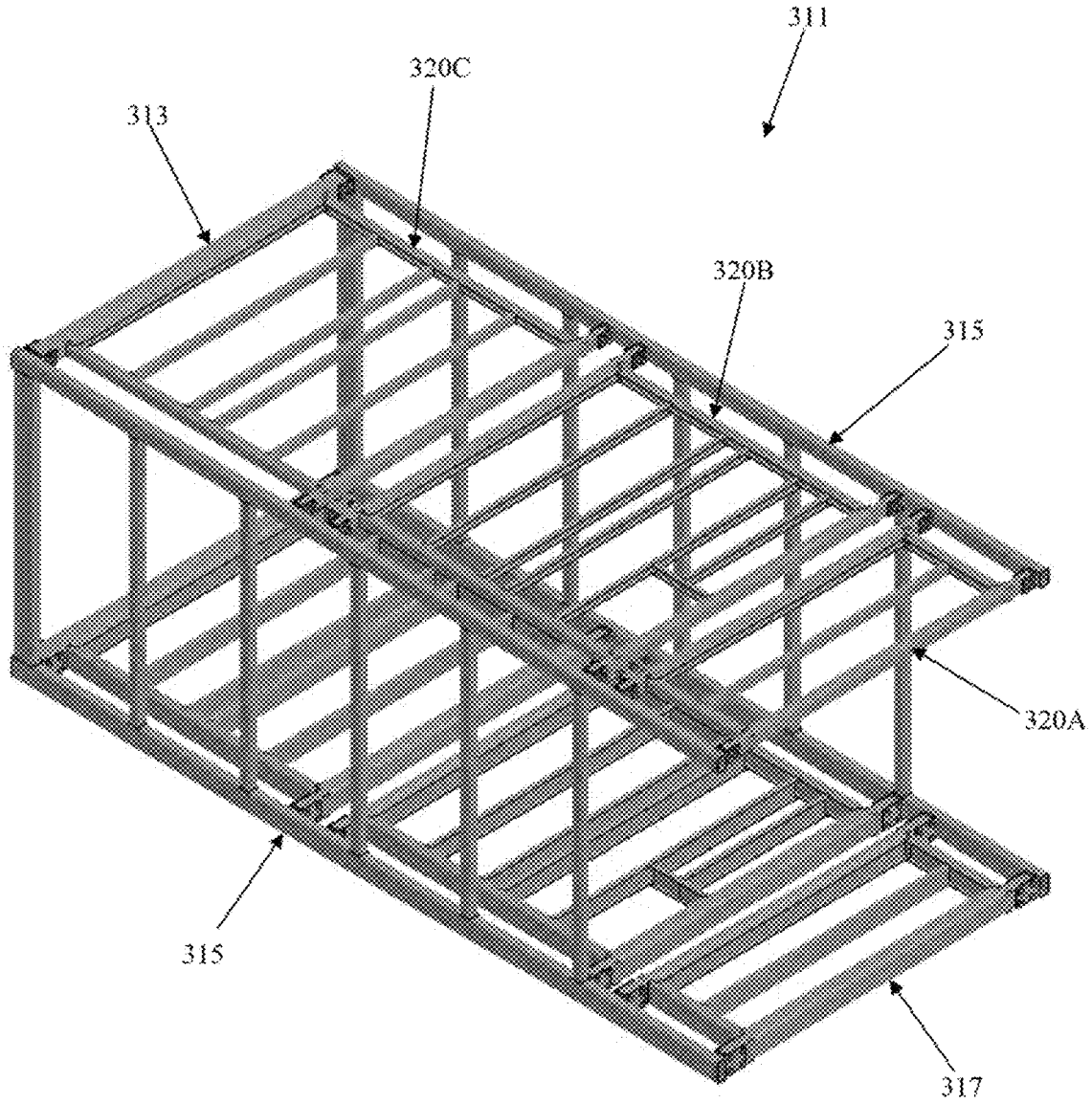
FIG. 55 is a perspective of a modular steel cage or "skeleton frame" of another embodiment as erected.
Figure 56:
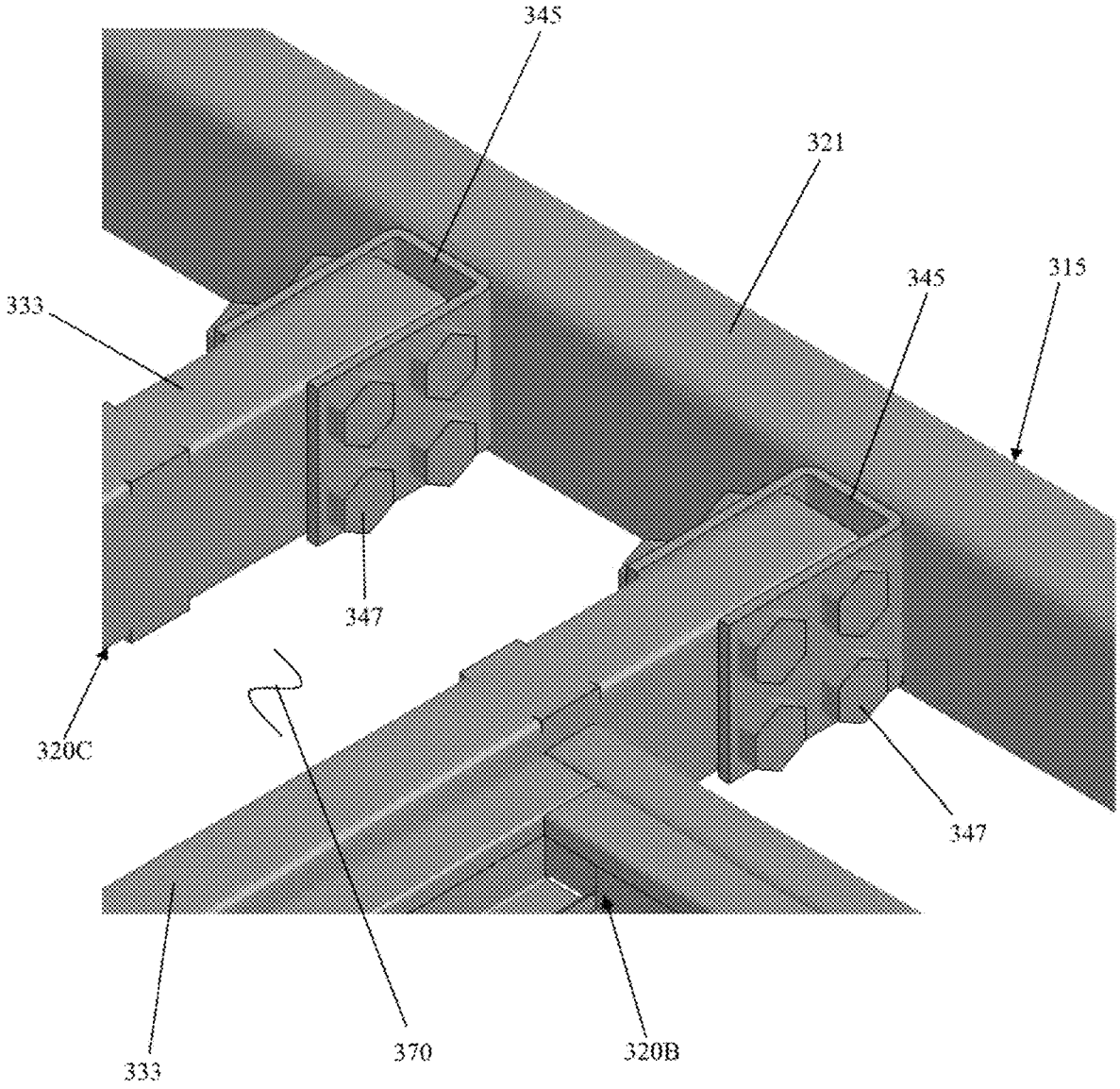
FIG. 56 is an enlarged fragmentary perspective of the frame of FIG. 55 showing connecting elements.
Figure 57:
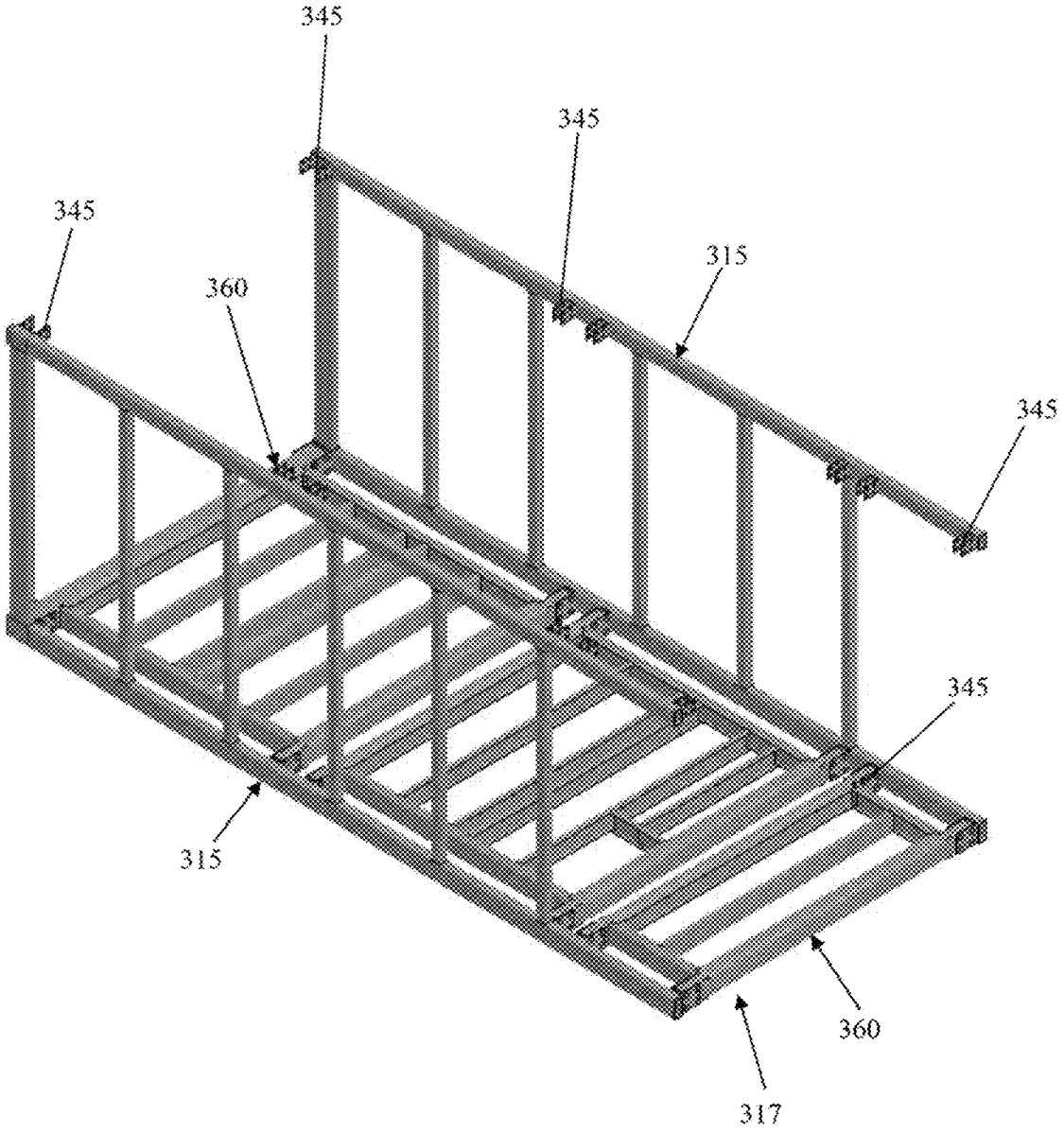
FIG. 57 is a perspective of the skeleton frame in FIG. 55 with a ceiling assembly removed.
Figure 58:
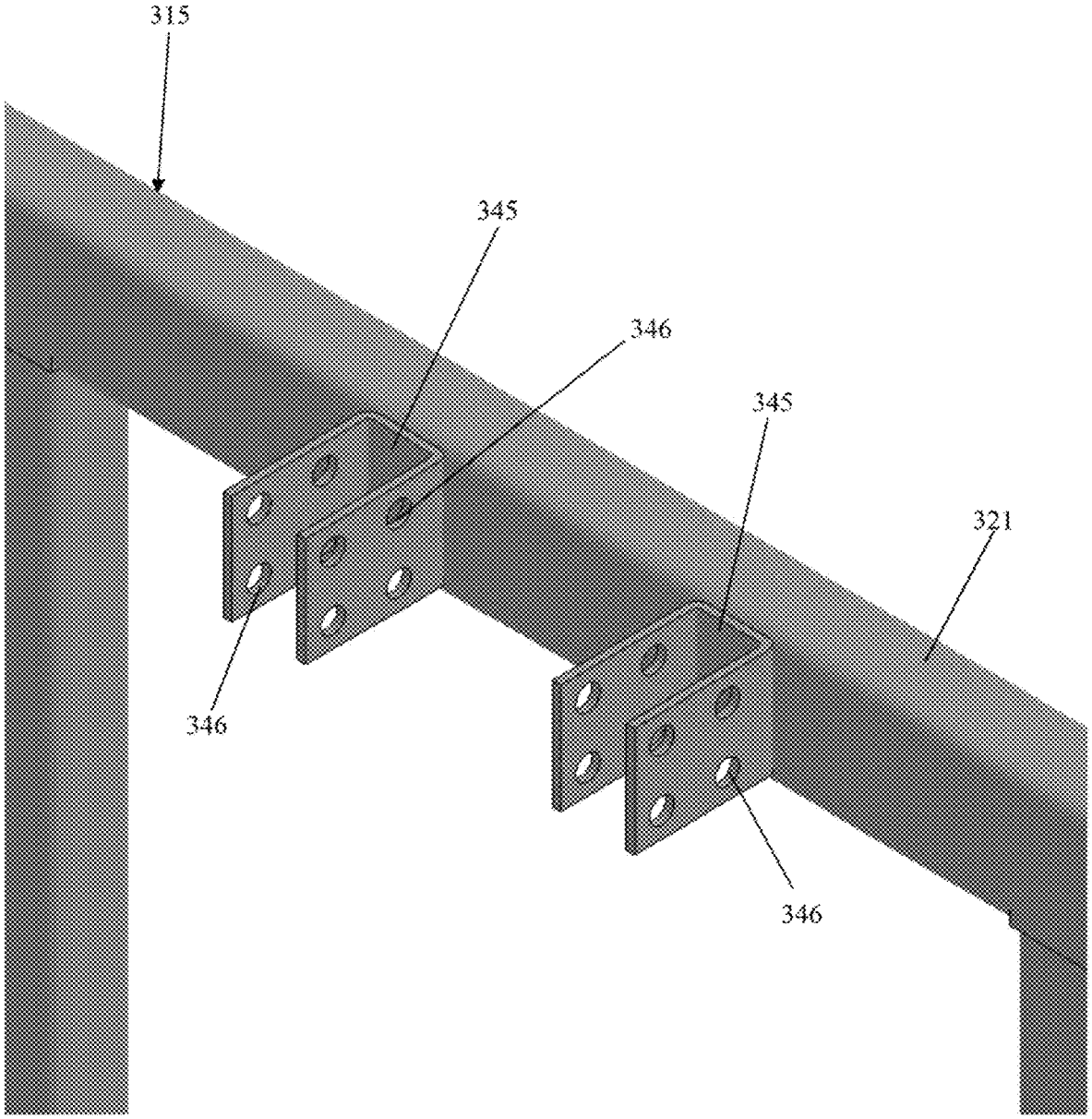
FIG. 58 is an enlarged fragmentary view of the frame of FIG. 57 showing connecting elements.
Figure 59:
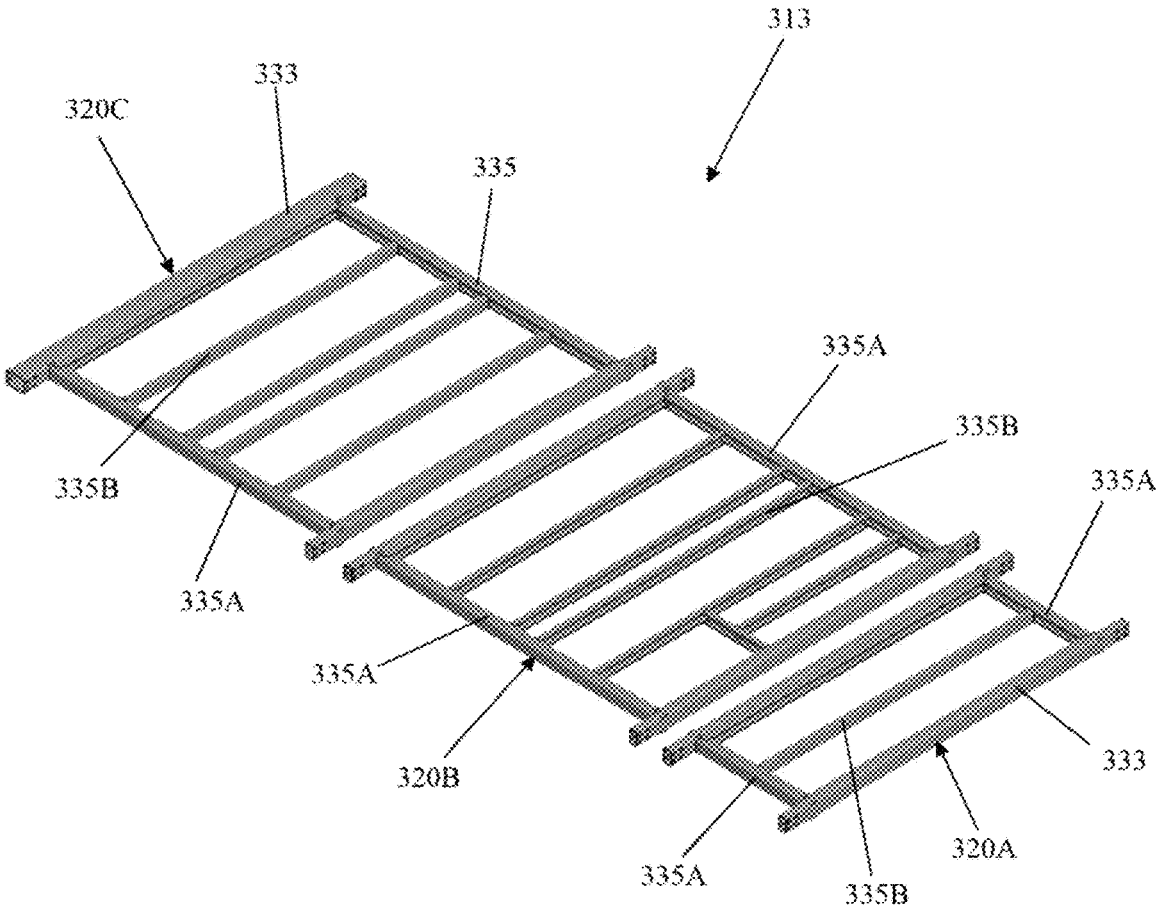
FIG. 59 is a partially exploded perspective of the ceiling assembly in FIG. 55.
Figure 60:
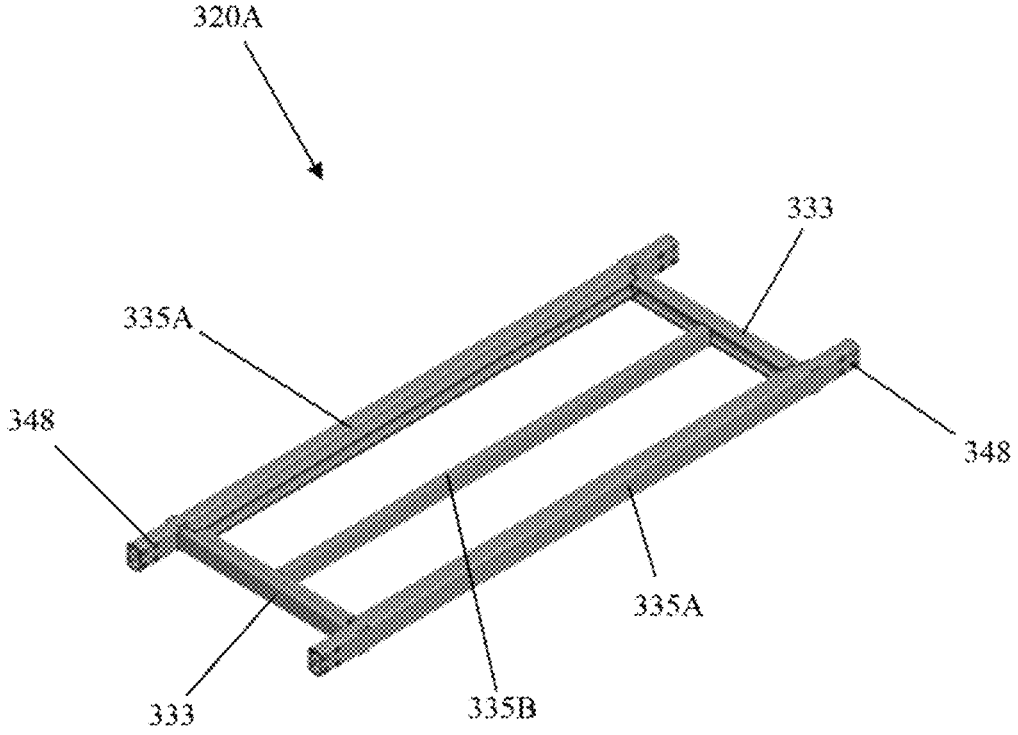
FIG. 60 is a perspective of a first ceiling unit of the ceiling assembly in FIG. 59.
Figure 61:
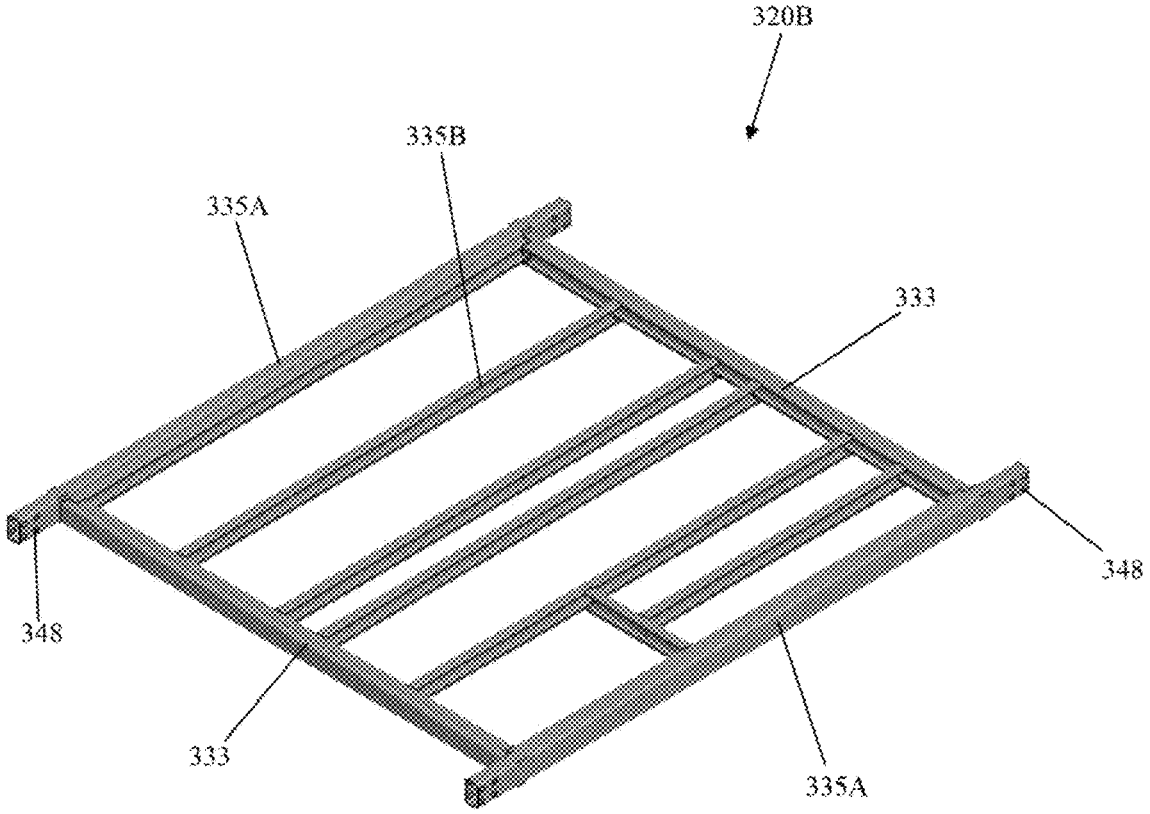
FIG. 61 is a perspective of a second ceiling unit of the ceiling assembly in FIG. 59.
Figure 62:
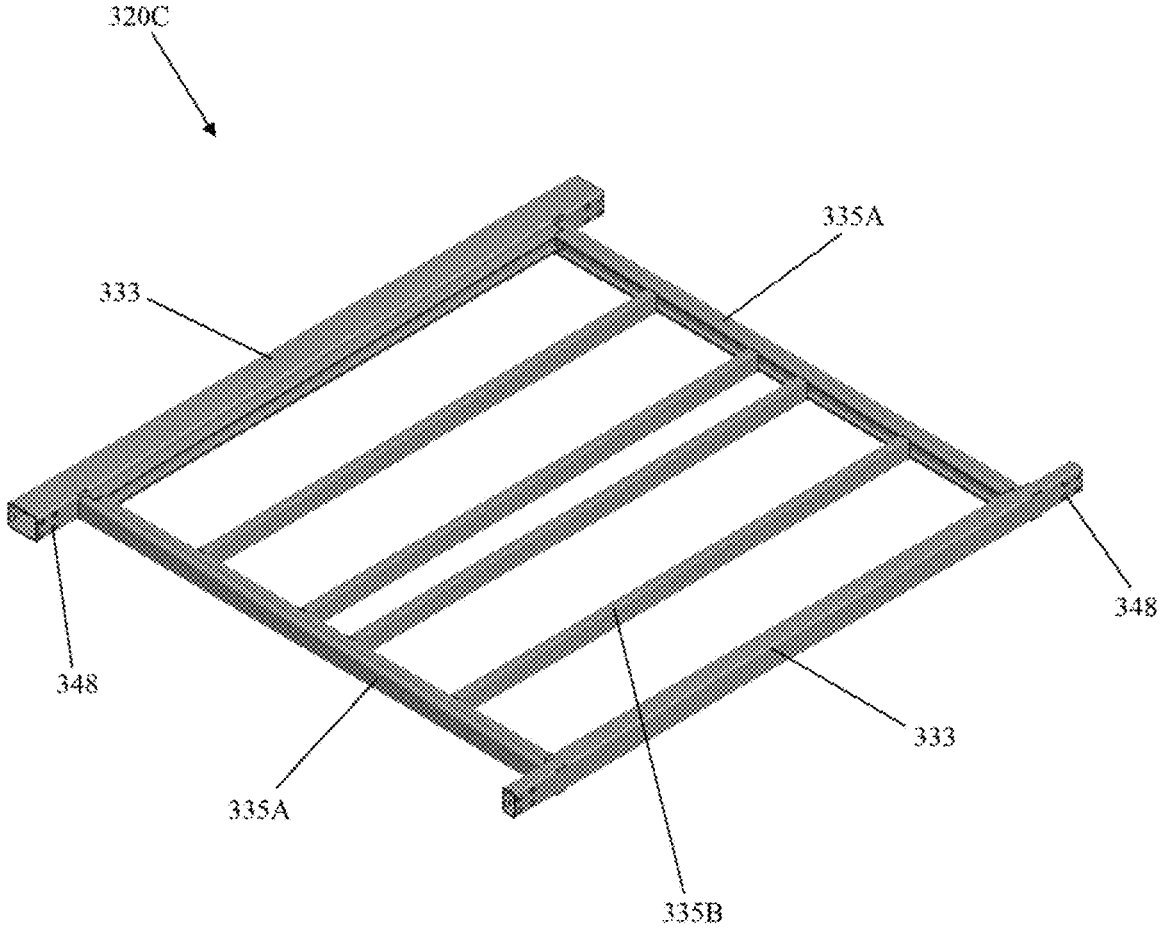
FIG. 62 is a perspective of a third ceiling unit of the ceiling assembly in FIG. 59.

Referring to FIGS. 59-62, a first ceiling unit 320A defines a first end ceiling unit as shown in the orientation of the frame 311 in FIG. 55. A second ceiling unit 320B defines an intermediate ceiling unit, and a third ceiling unit 320C defines a second end ceiling unit. The beams 333 of each ceiling unit 320A-C extend past the outer-most rafters 335A to define free end margins of the beams on both ends of the beams. Fastener holes 348 are formed in the free end margins to facilitate attachment of the ceiling units 320A-C within the frame 311. In particular, the free end margins of the beams 333 in the ceiling units 320A-C are configured for attachment to the wall assemblies 315. As shown in FIGS. 56-58, U-shaped brackets 345 are used to attach the wall assemblies 315 to the ceiling units 320A-C. In particular, the brackets 345 defining fastener holes 346 are attached (e.g., welded) to the top members 321 of the wall assemblies 315 for receiving the free end margins of the beams 333 of the ceiling assembly 313. Fasteners (e.g., bolts) 347 are received in the fastener holes of the brackets 345 to attach the brackets to the beams 333 on the ceiling assembly 113. In the illustrated embodiment, single brackets 345 receive the free end margins of respective beams 333 on the ceiling units 320A-C to secure the ceiling units to the wall assemblies 315. The difference between the connection of the ceiling units 320A-C of the frame 311 and the ceiling units 220A-D of the frame 211 is that the brackets 345 do not secure adjacent ceiling units directly together. Rather, each ceiling unit 320A-C is separately attached to the wall assemblies 315. Accordingly, gaps 370 (FIG. 56) are formed between adjacent ceiling units 320A-C.

Referring to FIGS. 55 and 57 the floor assembly 317 is configured similar to the ceiling assembly 313 and includes a plurality of floor units 360 connected to the wall assemblies 315 by brackets 345. The floor units 360 are secured to the wall assemblies in a similar manner to how the ceiling assembly 313 is secured therefore a detailed explanation is not provided.

Figure 63:
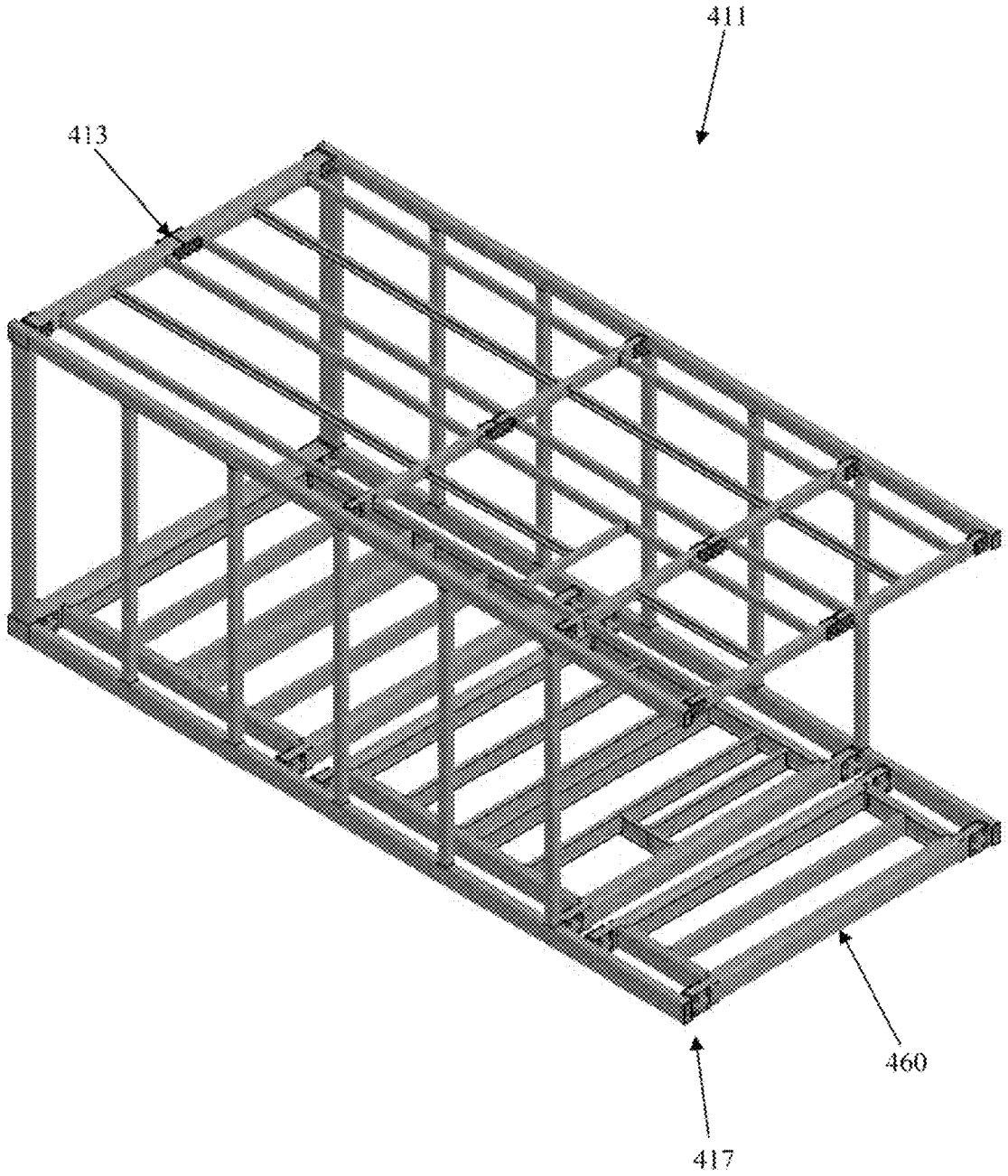
FIG. 63 is a perspective of a modular steel cage or "skeleton frame" of another embodiment as erected.

Referring to FIG. 63, another embodiment of a module or frame is generally indicated at 411. The frame 411 is substantially similar to frame 111 of the previous embodiment. In particular, the ceiling assembly 413 has the same configuration as the ceiling assembly 113. However, the construction of floor assembly 417 is different. In particular, the floor assembly 417 comprises a plurality of floor units 460 similar to floor assembly 317. In the illustrated embodiment, the floor assembly 417 includes four separate floor units 460. However, it is understood that the floor assembly 417 could have fewer than four or more than four floor units 460 without departing from the scope of the disclosure.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

OTHER STATEMENTS OF THE DISCLOSURE

A. A module or frame for use in constructing a building framework, the frame comprising a ceiling assembly, a pair of wall assemblies configured for attachment to opposite sides of the ceiling assembly at tops of the wall assemblies, and a floor assembly configured for attachment to a bottom of the wall assemblies.

AB. The module or frame as set forth in claim A wherein the frame is configurable in a collapsed state and an expanded state.

AC. The module or frame as set forth in claim AB wherein in the collapsed state wall members of the wall assemblies extend generally parallel to wall members of the ceiling assembly.

AD. The module or frame as set forth in either claim AB or AC wherein the wall assemblies are movable relative to one of the ceiling assembly and the floor assembly to configure the frame from the collapsed state to the expanded state.

AE. The module or frame as set forth in claim AD wherein the wall assemblies are pivotally attached to said one of the ceiling assembly and floor assembly in the collapsed state.

AF. The module or frame as set forth in claim AE wherein pivot points between the wall assemblies and the ceiling assembly and floor assembly are designed in such a way that the wall assemblies and one of the ceiling assembly and the floor assembly do not collide when collapsed or expanded.

AG. The module or frame as set forth in claim AF wherein a pivot point between a first wall assembly and one of the ceiling assembly and floor assembly is located higher than a pivot point between a second wall assembly and one of the ceiling assembly and floor assembly.

AH. The module or frame as set forth in any one of claims AD-AG wherein the wall assemblies pivot downward under the force of gravity as the ceiling assembly is raised.

AI. The module or frame as set forth in any one of claims AD-AH wherein the frame further comprises a cable extending between the ceiling assembly and one of the wall assemblies to control pivotal movement of the wall assembly when the ceiling assembly is elevated above the ground.

AJ. The module or frame as set forth in claim A wherein the frame further comprises connection plates fixedly attached to the wall assemblies for attaching the wall assemblies to the ceiling assembly and floor assembly.

AK. The module or frame as set forth in claim AJ wherein the connection plates are attached to one of the ceiling assembly and the floor assembly in the collapsed state such that one of the wall assemblies is disposed above the other wall assembly.

AL. The module or frame as set forth in either claim AJ or AK wherein the connection plates are arranged in pairs on the wall assemblies, each pair of connection plates being configured to receive a ceiling member of the ceiling assembly or a floor member of the floor assembly.

AM. The module or frame as set forth in any one of claims AJ-AL wherein the connection plates define fastener holes for receiving fasteners to attach the wall assemblies to the ceiling assembly and floor assembly.

AN. The module or frame as set forth in claim AM wherein at least four fasteners are used to attach the wall assemblies to said one of the ceiling assembly and floor assembly in the collapsed state.

B. A building framework assembly comprising a plurality of frames, each frame being configurable in a collapsed state for stacking the frames on top of each other.

BA. The building framework assembly as set forth in claim B wherein each frame comprises a ceiling assembly, a pair of wall assemblies, and a floor assembly, the wall assemblies being attached to one of the ceiling assembly and the floor assembly in the collapsed state.

BB. The building framework assembly as set forth in claim BA wherein the wall assemblies are free of attachment to the other of the ceiling assembly and floor assembly in the collapsed state.

BC. The building framework assembly as set forth in either one of claims BA or BB wherein at least four fasteners are used to attach the wall assemblies to said one of the ceiling assembly and floor assembly in the collapsed state.

BD. The building framework assembly as set forth in any one of claims BA-BC wherein the wall assemblies are pivotally attached to said one of the ceiling assembly and floor assembly in the collapsed state.

BE. The building framework assembly as set forth in any one of claims BB-BE wherein in the collapsed state wall members of the wall assemblies extend generally parallel to wall members of the ceiling assembly.

BF. The building framework assembly as set forth in claim BD or BE wherein floor members and ceiling members extend parallel to an axis of rotation about which a wall assembly pivots with respect to a ceiling assembly.

C. A method of building a modular building comprising the steps of: fabricating modules at a manufacturing facility such that each module is made up of separate component parts; loading the component parts onto a semi-trailer with the component parts separated from each other and arranged so that a width of the loaded components does not exceed a predetermined dimension; transporting the component parts of the frame on the semi-trailer to a desired location; and assembling the component parts from the load on the semi-trailer to form at least part of one module; and transporting an assembled module to the construction site.

CA. The method as set forth in claim C further comprising connecting the module to other modules to form at least part of the modular building.

CB. The method as set forth in claim C wherein a smallest transverse dimension of the module is less than eight feet.

CC. The method as set forth in claim C wherein the component parts are constructed for quick connection to form the module.

CD. The method as set forth in claim CC wherein the component parts are constructed for bolt-together connection to form the module.

What is claimed is:

1. A module for use in constructing a building, the module comprising:

a ceiling assembly comprising a plurality of beams spaced along a length of the ceiling assembly and a plurality of rafters extending between the beams;

a plurality of wall assemblies configured for attachment to opposite sides of the ceiling assembly generally at tops of the wall assemblies, each wall assembly comprising a top beam, a bottom beam, and a plurality of studs extending between the top and bottom beams;

a floor assembly configured for attachment generally to bottoms of the wall assemblies, the floor assembly comprising a plurality of bars spaced along a length of the floor assembly and a plurality of joists extending between the bars;

a plurality of connector plates attached to the wall assemblies, the connector plates being configured to receive fasteners for attaching the ceiling assembly and floor assembly to the wall assemblies to form a module configured to be placed with other modules to form at least a portion of the building, each connector plate comprising a base plate attached to one of the top beam and bottom beam of a wall assembly and a pair of side plates extending from opposite ends of the base plate in a direction perpendicular to the base plate such that the side plates are disposable on opposite sides of said one of the beams of the ceiling assembly and the bars of the floor assembly, each side plate defining a plurality of fastener holes; and a plurality of fasteners extending through the fastener holes and into said one of the ceiling assembly and floor assembly such that the fasteners extend into opposite sides of said one of the beams of the ceiling assembly and the bars of the floor assembly for attaching the ceiling assembly or floor assembly to the wall assemblies.

2. The module of claim 1, wherein each wall assembly includes a plurality of wall members, and wherein the plurality of connector plates comprise a plurality of planar plate members attached to the wall members of the wall assemblies.

3. The module of claim 1, wherein the plurality of connector plates comprise a plurality of U-shaped brackets.

4. The module of claim 3, wherein the U-shaped brackets include flanges extending from opposite sides of each bracket, the flanges being attached to at least one of the wall assemblies.

5. The module of claim 1, wherein each wall assembly includes a plurality of wall members, and wherein the wall members of each wall assembly include a top member, a bottom member, and a plurality of vertical members extending between the top and bottom members, the connector plates being attached to the top and bottom members of the wall assemblies.

6. The module of claim 5, wherein the ceiling assembly includes a plurality of ceiling members, and wherein the ceiling members of the ceiling assembly include a plurality of elongate first members extending across a width of the ceiling assembly and spaced apart along a length of the ceiling assembly, and a plurality of elongate second members extending along the length of the ceiling assembly and disposed between the first members of the ceiling assembly, at least some of the connector plates being attached to the first members of the ceiling assembly to attach the ceiling assembly to the wall assemblies.

7. The module of claim 6, wherein the floor assembly includes a plurality of floor members, and wherein the floor members of the floor assembly include a plurality of elongate first members extending across a width of the floor assembly and spaced apart along a length of the floor assembly, and a plurality of elongate second members extending along the length of the floor assembly and disposed between the first members of the floor assembly, at least some of the connector plates being attached to the first members of the floor assembly to attach the floor assembly to the wall assemblies.

8. The module of claim 7, wherein the connector plates, the first members of the ceiling assembly, and the first members of the floor assembly each define fastener holes, the fastener holes in the first members being alignable with the connector plates such that fasteners can be inserted through the connector plates and the fastener holes in the first members to attach the ceiling assembly and floor assembly to the wall assemblies.

9. The module of claim 1, wherein the fasteners comprise bolts.

10. The module of claim 1, wherein the module is configurable in a stacked configuration whereby the plurality of wall assemblies are pivotally attached to one of the ceiling assembly and floor assembly and free of a pivotable attachment to the other of the ceiling assembly and floor assembly.

11. The module of claim 1, wherein the side plates of the connector plates extend perpendicularly from the beams of the wall assemblies.

12. The module of claim 1, wherein the base plate is free of fastener holes.

13. A module for use in constructing a building, the module comprising:

a ceiling assembly including a plurality of ceiling units each including a plurality of ceiling members fixedly attached together such that each ceiling unit is a self-contained unit formed separately from any other ceiling unit, the ceiling units being operatively coupled to each other so that the ceiling units are generally coplanar, each ceiling unit including a plurality of beams spaced along a length of the ceiling unit and a plurality of rafters extending between the beams;

a plurality of wall assemblies configured for attachment to opposite sides of the ceiling assembly generally at tops of the wall assemblies, each wall assembly comprising a top beam, a bottom beam, and a plurality of studs extending between the top and bottom beams;

a floor assembly configured for attachment generally to bottoms of the wall assemblies, wherein the ceiling assembly, wall assemblies and floor assembly form a module configured to be placed with other modules to form at least a portion of the building; and connectors attached to the wall assemblies for connecting the ceiling assembly to the wall assemblies, each connector including base plate attached to a top beam of a wall assembly and a pair of side plates extending from opposite ends of the base plate in a direction perpendicular to the base plate such that the side plates are disposable on opposite sides of a beam of the ceiling assembly, each side plate defining fastener holes for receiving fasteners for attaching the connectors to the beam of the ceiling assembly.

14. The module of claim 13, wherein each ceiling unit comprises at least four ceiling members.

15. The module of claim 14, wherein each ceiling unit comprises a plurality of elongate first members extending across a width of the ceiling assembly and spaced apart along a length of the ceiling assembly, and a plurality of elongate second members extending along the length of the ceiling assembly and disposed between the first members of the ceiling assembly.

16. The module of claim 15, wherein the first members are attached to one of the wall assemblies.

17. The module of claim 15, wherein the first members extend transversely across the length of the ceiling assembly.

18. The module of claim 13, wherein the floor assembly includes a plurality of floor units each including a plurality of floor members fixedly attached together such that each floor unit is a self-contained unit formed separately from any other floor unit, the floor units being operatively connected to each other.

19. The module of claim 18, wherein each floor unit comprises a plurality of first members spaced apart along a length of the floor assembly, and a plurality of second members disposed between the first members of the floor assembly.

20. The module of claim 19, wherein the first members of the floor assembly are attached to at least one of the wall assemblies.

21. The module of claim 13, wherein each wall assembly has an uppermost surface, the ceiling member being disposed below the uppermost surfaces of the wall assemblies when attached to the wall assemblies.

22. The module of claim 13, wherein each connector is dedicated to a single ceiling unit for connecting the single ceiling unit to one of the wall assemblies.

* * * * *